US012635765B2

(12) United States Patent
Meschter

(10) Patent No.: US 12,635,765 B2
(45) Date of Patent: May 26, 2026

(54) INDEPENDENTLY MOVABLE SOLE STRUCTURE

(71) Applicant: NIKE, Inc., Beaverton, OR (US)

(72) Inventor: James C. Meschter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/051,122

(22) Filed: Oct. 31, 2022

(65) Prior Publication Data

US 2023/0078361 A1 Mar. 16, 2023

Related U.S. Application Data

(63) Continuation of application No. 16/178,098, filed on Nov. 1, 2018, now Pat. No. 11,490,682, which is a continuation of application No. 14/689,436, filed on Apr. 17, 2015, now Pat. No. 10,123,586.

(51) Int. Cl.

| | |
|---|---|
| ***A43B 13/18*** | (2006.01) |
| ***A43B 13/12*** | (2006.01) |
| ***A43B 13/16*** | (2006.01) |
| ***A43B 13/22*** | (2006.01) |
| ***A43B 13/26*** | (2006.01) |

(52) U.S. Cl.

CPC ..... *A43B 13/184* (2013.01); *A43B 13/12* (2013.01); *A43B 13/122* (2013.01); *A43B 13/16* (2013.01); *A43B 13/181* (2013.01); *A43B 13/186* (2013.01); *A43B 13/223* (2013.01); *A43B 13/26* (2013.01)

(58) Field of Classification Search

CPC ..... A43B 13/181; A43B 13/16; A43B 13/122; A43B 13/12; A43B 13/184; A43B 13/145; A43B 13/223; A43B 7/1485; A43B 7/087; A43B 7/023; A43B 23/30

See application file for complete search history.

(56) References Cited

U.S. PATENT DOCUMENTS

| | | | |
|---|---|---|---|
| 1,552,022 | A | 9/1925 | Willson |
| 1,559,450 | A | 10/1925 | Oakley |
| 2,155,166 | A | 4/1939 | Kraft |
| 3,006,085 | A | 10/1961 | Bingham, Jr. |
| 3,751,833 | A | 8/1973 | Humphrey et al. |

(Continued)

FOREIGN PATENT DOCUMENTS

| | | | |
|---|---|---|---|
| EP | 1832191 | A1 | 9/2007 |
| JP | 2002085106 | A | 3/2002 |
| WO | WO-2010137068 | A1 | 12/2010 |

OTHER PUBLICATIONS

International Search Report and Written Opinion mailed Jul. 4, 2016 for International Patent Application No. PCT/US2016/026695.

(Continued)

*Primary Examiner* — Katharine G Kane

(74) *Attorney, Agent, or Firm* — Honigman LLP; Matthew H. Szalach; Jonathan P. O'Brien

(57) ABSTRACT

An article of footwear and method of making an article of footwear are disclosed. The article includes an outsole having an outsole member. The outsole member includes a first piece and a second piece. The first piece is spaced from a base by a first vertical distance. The second piece is spaced from the base by a second vertical distance, the first vertical distance being greater than the second vertical distance.

20 Claims, 31 Drawing Sheets

(56) References Cited

U.S. PATENT DOCUMENTS

| | | | | |
|---|---|---|---|---|
| 3,757,774 | A | 9/1973 | Hatuno | |
| 4,096,649 | A | 6/1978 | Saurwein | |
| 4,521,979 | A | 6/1985 | Blaser et al. | |
| 4,534,121 | A | 8/1985 | Autry | |
| 4,653,206 | A * | 3/1987 | Tanel | A43B 3/0042 36/134 |
| 5,014,449 | A | 5/1991 | Richard et al. | |
| 5,048,203 | A | 9/1991 | Kling | |
| 5,203,097 | A | 4/1993 | Blair | |
| 5,313,718 | A | 5/1994 | McMahon et al. | |
| 5,337,492 | A | 8/1994 | Anderie | |
| 5,469,639 | A | 11/1995 | Sessa | |
| 5,713,140 | A | 2/1998 | Baggenstoss | |
| 5,784,808 | A | 7/1998 | Hockerson | |
| 5,879,725 | A | 3/1999 | Potter | |
| 6,115,945 | A | 9/2000 | Ellis, III | |
| 6,405,456 | B1 | 6/2002 | Nichelson | |
| 6,557,274 | B2 | 5/2003 | Litchfield et al. | |
| 7,080,467 | B2 | 7/2006 | Marvin et al. | |
| 7,707,743 | B2 | 5/2010 | Schindler | |
| 7,793,430 | B2 | 9/2010 | Ellis | |
| 8,104,197 | B2 | 1/2012 | Flannery | |
| D664,753 | S | 8/2012 | Santos et al. | |
| 8,307,569 | B2 | 11/2012 | Mcinnis et al. | |
| 8,578,630 | B2 | 11/2013 | Diepenbrock | |
| 9,301,566 | B2 | 4/2016 | Dojan | |
| D770,740 | S | 11/2016 | Teteriantnikov | |
| D779,179 | S | 2/2017 | Christensen et al. | |
| 9,717,304 | B2 | 8/2017 | Bernhard | |
| 9,763,493 | B2 | 9/2017 | Nishiwaki | |
| D809,252 | S | 2/2018 | Brunner | |
| 9,999,276 | B2 | 6/2018 | Adeagbo | |
| 11,589,646 | B1 * | 2/2023 | Weschler | A43B 5/12 |
| 2003/0024134 | A1 | 2/2003 | Howlett et al. | |
| 2004/0148803 | A1 | 8/2004 | Grove et al. | |
| 2005/0132610 | A1 | 6/2005 | Foxen | |
| 2006/0026865 | A1 | 2/2006 | Grisoni et al. | |
| 2006/0059717 | A1 | 3/2006 | Mitchell | |
| 2008/0216355 | A1 | 9/2008 | Becker | |
| 2008/0244926 | A1 | 10/2008 | Yu et al. | |
| 2009/0013558 | A1 | 1/2009 | Hazenberg | |
| 2009/0265956 | A1 | 10/2009 | Richards | |
| 2009/0293318 | A1 | 12/2009 | Garneau et al. | |
| 2010/0223810 | A1 | 9/2010 | Lekhtman | |
| 2010/0257755 | A1 | 10/2010 | Gerber | |
| 2011/0047832 | A1 | 3/2011 | O'Mary | |
| 2011/0083340 | A1 | 4/2011 | Leary et al. | |
| 2011/0126422 | A1 | 6/2011 | Vattes et al. | |
| 2011/0138652 | A1 | 6/2011 | Lucas | |
| 2011/0167672 | A1 | 7/2011 | Bond | |
| 2012/0005921 | A1 * | 1/2012 | Diepenbrock | A43B 13/186 36/43 |
| 2012/0042539 | A1 | 2/2012 | Miner | |
| 2012/0042541 | A1 | 2/2012 | Miner | |
| 2012/0180341 | A1 | 7/2012 | Crowley et al. | |
| 2013/0031804 | A1 * | 2/2013 | Abshire | A43B 13/188 36/103 |
| 2013/0036629 | A1 | 2/2013 | Braman | |
| 2013/0086821 | A1 | 4/2013 | Lussier | |
| 2013/0212909 | A1 | 8/2013 | Bates | |
| 2013/0263469 | A1 | 10/2013 | Braunschweiler et al. | |
| 2014/0049883 | A1 | 2/2014 | Kim | |
| 2014/0075777 | A1 | 3/2014 | Bruce | |
| 2014/0215729 | A1 | 8/2014 | Curl | |
| 2014/0215849 | A1 | 8/2014 | Litchfield et al. | |
| 2014/0259749 | A1 | 9/2014 | Taylor | |
| 2014/0259788 | A1 | 9/2014 | Dojan | |
| 2015/0257483 | A1 | 9/2015 | Meschter | |
| 2015/0289586 | A1 * | 10/2015 | Wan | A43B 13/16 36/31 |
| 2016/0015122 | A1 | 1/2016 | Nishiwaki | |
| 2017/0150777 | A1 * | 6/2017 | Youngs | A43B 13/125 |
| 2017/0280822 | A1 | 10/2017 | Langvin | |
| 2018/0160773 | A1 | 6/2018 | Goldman | |
| 2020/0253327 | A1 | 8/2020 | Fujita | |

OTHER PUBLICATIONS http://store.nike.com/us/en_us/pd/lunarglide-6-running-shoe/pid-10264912/pgid-10273112.

http://www.nike.com/us/en_us/c/launch/2014-02/nike-flyknit-lunar2.

United States Patent and Trademark Office, Office Action for U.S. Appl. No. 14/689,436, mailed Sep. 11, 2017.

United States Patent and Trademark Office, Office Action for U.S. Appl. No. 14/689,436, mailed Jan. 19, 2018.

United States Patent and Trademark Office, Office Action for U.S. Appl. No. 14/689,436, mailed Mar. 8, 2017.

USPTO, Final Office Action for U.S. Appl. No. 16/178,098, mailed Mar. 8, 2022.

USPTO, Non-Final Office Action for U.S. Appl. No. 16/178,098, mailed Sep. 10, 2021.

* cited by examiner

INDEPENDENTLY MOVABLE SOLE STRUCTURE

CROSS REFERENCE TO RELATED APPLICATION

This application is a Continuation of U.S. application Ser. No. 16/178,098, filed Nov. 1, 2018, which is a Continuation of U.S. application Ser. No. 14/689,436, filed Apr. 17, 2015, the contents of which are hereby incorporated by reference in their entirety.

BACKGROUND

Articles of footwear including an outsole pattern have previously been proposed. While conventional outsole patterns generally include grooves and ridges, the patterns are typically designed with a monolithic sole. In some instances, the outsole is formed of a single piece.

SUMMARY

In some embodiments, an article of footwear includes an outsole comprising a first outsole member centered at a first center position, the first outsole member including a first piece and a second piece. The article of footwear further includes a midsole comprising a protrusion structure corresponding to the outsole member, the protrusion structure extending outward in a vertical direction from a base of the midsole. The vertical direction is approximately normal to the base. The first piece is attached to the protrusion structure and the first piece is centered at the first center position. The second piece is attached to the protrusion structure and the second piece is centered at the first center position. The first piece is spaced from the base by a first vertical distance. The second piece is spaced from the base by a second vertical distance, the first vertical distance being greater than the second vertical distance. The first piece is separated from the second piece.

In some embodiments, a method includes providing a midsole having a first protrusion structure. The first protrusion structure extends from a base of the midsole. The method further includes providing a first piece for an outsole. The method further includes providing a second piece for the outsole. The method further includes providing an elastic layer. The method further includes attaching the first piece to the elastic layer. The method further includes attaching the second piece to the elastic layer. The method further includes attaching the elastic layer to the midsole. The elastic layer elastically attaches the first piece and the second piece. The first protrusion structure, the attached first piece, and the attached second piece have a common first center position.

In another embodiment, an article of footwear includes an upper, a midsole attached to the upper, and an outsole attached to the midsole. The outsole comprises a first outsole member centered at a first center position, the first outsole member including a first piece and a second piece. The first piece is attached to the midsole and wherein the first piece is centered at the first center position. The second piece is attached to the midsole and wherein the second piece is centered at the first center position. The first piece is spaced apart from the second piece. The first piece is spaced in a vertical direction from the second piece by a resting vertical separation distance during a resting state of the midsole. The vertical direction is approximately normal to a base of the midsole. The first piece is spaced in a horizontal direction from the second piece by a resting horizontal separation distance during the resting state of the midsole, the vertical direction being perpendicular to the horizontal direction. The first piece is spaced in the vertical direction from the second piece by a compressed vertical separation distance during a compressed state of the midsole, the compressed vertical separation distance being less than the resting vertical separation distance. A position of the second piece in the vertical direction remains unchanged between the resting state of the midsole and the compressed state of the midsole. The first piece is spaced in the horizontal direction from the second piece by a compressed horizontal separation distance during the compressed state of the midsole, the compressed horizontal separation distance being substantially equal to the resting horizontal separation distance.

In some embodiments, a sole structure for an article of footwear includes a midsole and an outsole. The midsole has at least a tactile component. The outsole is attached to the midsole. The outsole including at least a tactile outsole member. The tactile outsole member includes at least a first tactile piece and a second tactile piece. The first tactile piece and the second tactile piece are attached to the tactile component of the midsole. A first sipe surrounds the first tactile piece. The second tactile piece surrounds the first sipe. The first tactile piece is substantially aligned with a contour of the tactile outsole member. The second tactile piece is substantially aligned with the contour of the tactile outsole member.

In a further embodiment, a sole structure for an article of footwear includes a midsole and an outsole. The midsole has at least a tactile component. The tactile component includes at least a first tactile surface and a second tactile surface. The second tactile surface surrounds the first tactile surface. An outsole is attached to the midsole. The outsole includes at least a tactile outsole member. The tactile outsole member includes at least a first tactile piece attached to the first tactile surface and a second tactile piece attached to the second tactile surface. The first tactile piece moves independently from the second tactile piece.

In some embodiments, a sole structure for an article of footwear includes a midsole, exposed sidewall, first sipe, and second sipe. The midsole has an outer side surface. The exposed sidewall extends over a substantial portion of the outer side surface of the midsole. The exposed sidewall is attached to the outer side surface of the midsole. The first sipe extends through the exposed sidewall, the first sipe extending along a longitudinal direction of the article of footwear. The second sipe extends through the exposed sidewall. The second sipe extends along the longitudinal direction of the article of footwear. The second sipe is spaced closer to a ground engaging surface of the article of footwear than the first sipe.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
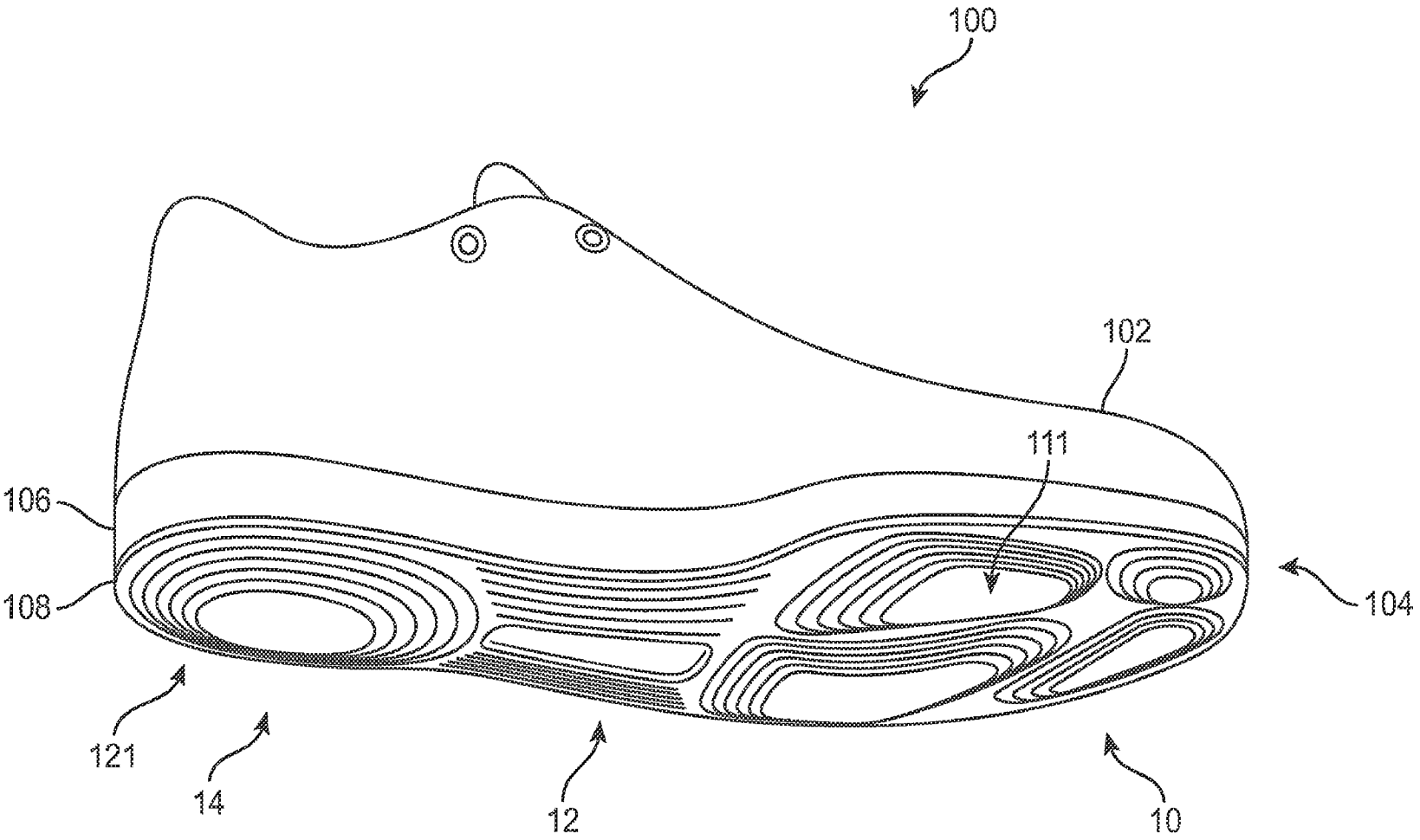
FIG. 1 is an isometric view of an article of footwear, in accordance with an exemplary embodiment.

FIG. 1 illustrates an embodiment of an article of footwear 100, also referred to simply as article 100, including an upper 102 and a sole structure 104. As shown, in some embodiments, the sole structure 104 includes a midsole 106 and an outsole 108.

Article 100 may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments, article 100 may be configured as various other kinds of non-sports related footwear, including, but not limited to: slippers, sandals, high heeled footwear, and loafers.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. Some embodiments may include fastening provisions, including, but not limited to: laces, cables, straps, buttons, zippers as well as any other provisions known in the art for fastening articles.

As shown, the upper 102 may be attached to the sole structure 104 by any known mechanism or method. For example, upper 102 may be stitched to sole structure 104 or upper 102 may be glued to sole structure 104. The upper may be configured to receive a foot. For example, as shown in FIG. 1, the upper 102 includes a throat portion to receive a foot. In some embodiments, the upper may include another type of design. For instance, the upper 102 may be a seamless warp knit tube of mesh.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used. Examples of ground surfaces include, but are not limited to: natural turf, synthetic turf, dirt, hardwood flooring, as well as other surfaces.

A sole structure may be characterized as having various portions or components associated with different portions or components of a foot. The sole structure may include a forefoot portion disposed proximate a wearer's forefoot. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole structure 104 may include lateral side 16 and medial side 18 (see FIG. 2). In particular, lateral side 16 and medial side 18 may be opposing sides of sole structure 104. Furthermore, both lateral side 16 and medial side 18 may extend through forefoot portion 10, midfoot portion 12, and heel portion 14.

It will be understood that forefoot portion 10, midfoot portion 12, and heel portion 14 are only intended for purposes of description and are not intended to demarcate precise components of sole structure 104. Likewise, lateral side 16, and medial side 18 are intended to represent generally two sides of a sole structure, rather than precisely demarcating sole structure 104 into two halves. Moreover, throughout the embodiments, forefoot portion 10, midfoot portion 12, heel portion 14, lateral side 16 and medial side 18 may be used to refer to portions and/or sides of individual components of sole structure 104, including a midsole member and an outsole member as well as possibly other components of sole structure 104.

For consistency and convenience, directional adjectives are employed throughout this detailed description corresponding to the illustrated embodiments. The term "longitudinal" as used throughout this detailed description and in the claims refers to a direction extending a length of a component, such as, a sole structure. In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where a sole structure is planted flat on a ground surface, the vertical direction may extend from the ground surface upward. This detailed description makes use of these directional adjectives in describing a sole structure and various components of the sole structure.

The midsole 106 may be made from materials known in the art for making articles of footwear. For example, the midsole 106 may be made from a cushioning material. In some embodiments, cushioning material includes an expanded rubber, foam rubber, polyurethane, and the like. In addition, midsole 106 may attenuate ground reaction forces when compressed between the foot and the ground during walking, running, or other ambulatory activities. The configuration of midsole 106 may vary significantly in different embodiments to include a variety of conventional or non-conventional structures. In some cases, the configuration of midsole 106 can be configured according to one or more types of ground surfaces on which midsole 106 may be used. Examples of such ground surfaces include, but are not limited to: natural turf, synthetic turf, dirt, hardwood flooring, as well as other surfaces.

Embodiments may include provisions for improving shock absorbency in the sole structure. In some embodiments, it is desirable for an outsole to include a telescoping component to allow for improved shock absorbency. Referring to FIG. 1, the sole structure 104 may include telescoping component 111. In other embodiments, a telescoping component may be omitted from the sole structure.

In those embodiments where a sole structure includes a telescoping component, any number of telescoping components may be used. In some embodiments, a sole structure may include multiple telescoping components. Referring to FIG. 1, the sole structure 104 may include telescoping component 111 as well as second telescoping component 121. In other embodiments, a sole structure may include a telescoping component (not shown).

Figure 2:
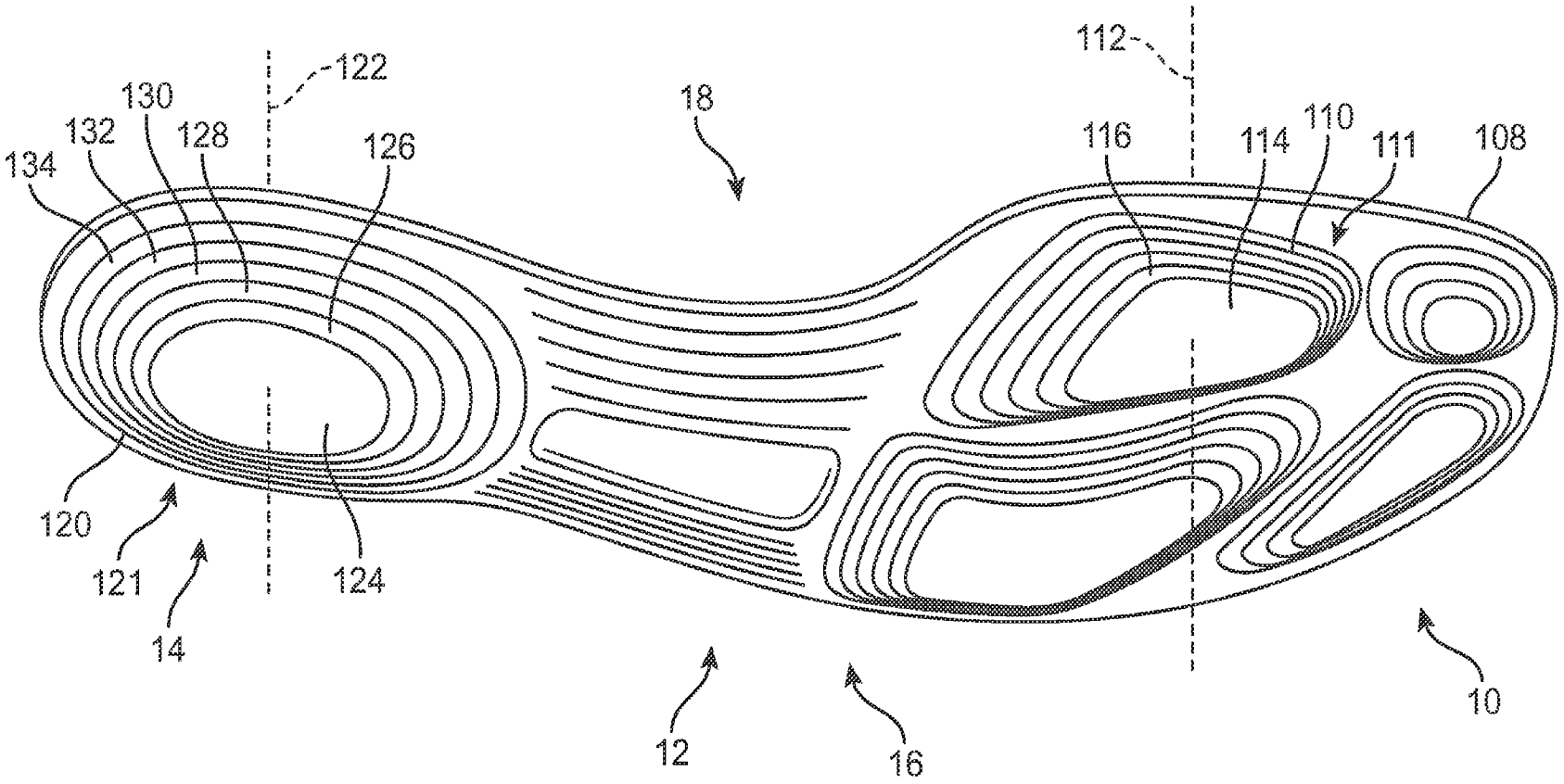
FIG. 2 is a schematic view of an outsole of FIG. 1, in accordance with an exemplary embodiment.
Figure 3:
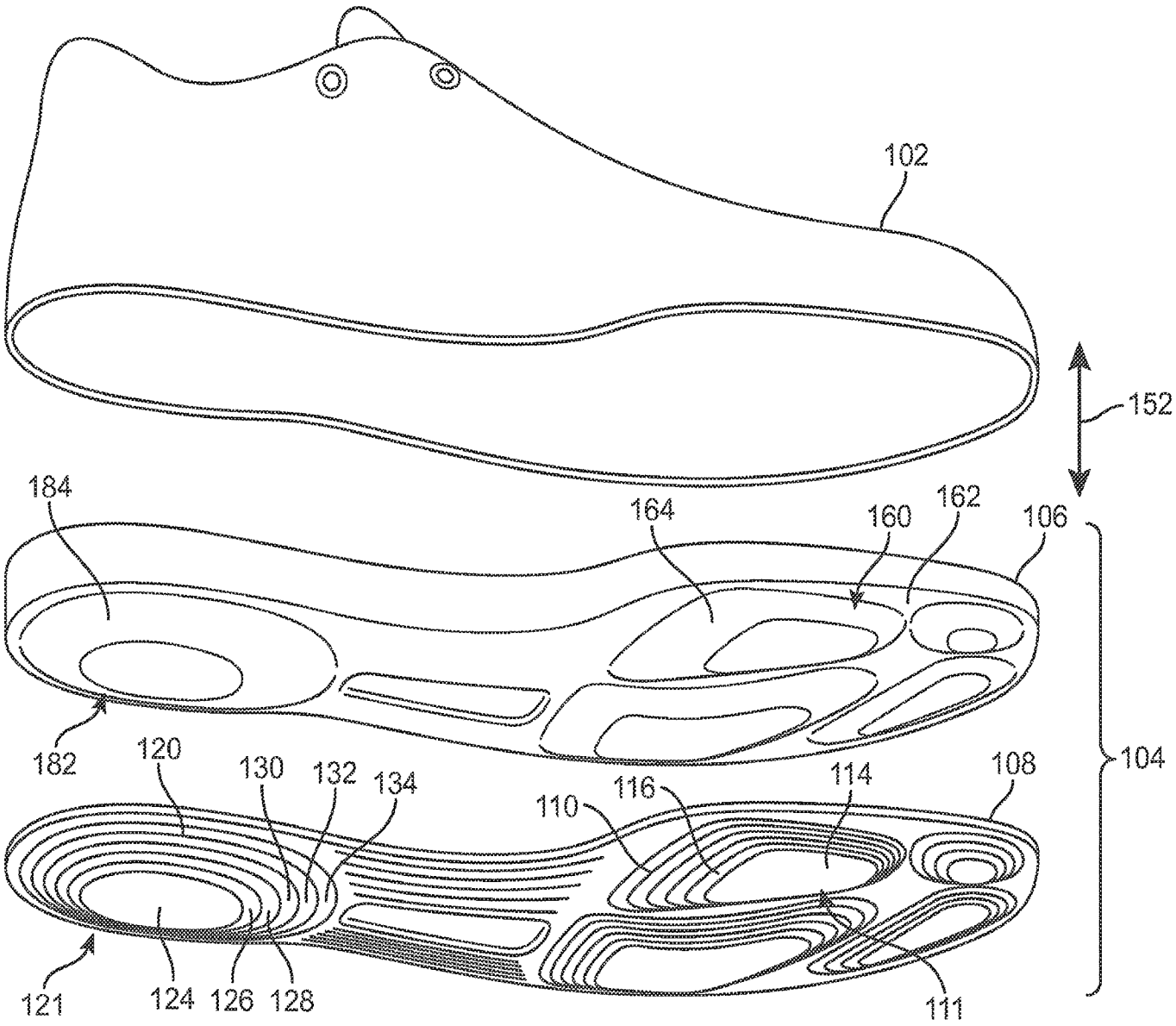
FIG. 3 is an exploded view of an article of footwear having a midsole with a smooth surface, in accordance with an exemplary embodiment.

In those embodiments where a sole structure includes a telescoping component, a telescoping component may be formed of any suitable portions of a sole structure. In some embodiments, a telescoping component may include portions of a midsole and of an outsole. Referring to FIGS. 2-3, first telescoping component 111 may include first telescoping outsole member 110 of outsole 108 and first protrusion structure 160 of midsole 106. In the example, second telescoping component 121 may include second telescoping outsole member 120 of outsole 108 and second protrusion structure 182 of midsole 106. In other embodiments, a telescoping component may be formed of other portions of sole structure.

In some embodiments, the first telescoping component may be centered at a first center position. Referring to FIG. 2, first telescoping component 111 may be centered at first center position 112. In the example, first center position 112 may be represented by a vertical axis that is approximately perpendicular with sole structure 104. In other embodiments, the first telescoping component may be disposed differently on the sole structure.

In some embodiments, a telescoping outsole member of a telescoping component may include multiple pieces centered at a position. Referring to FIG. 2, first telescoping outsole member 110 may include three or more pieces. In other embodiments, the first telescoping outsole member has two pieces (not shown). In some embodiments, as shown in FIG. 2, telescoping outsole member 110 may include first piece 114 and second piece 116. As seen in FIG. 2, telescoping outsole member 110 may include five pieces, of which first piece 114 and second piece 116 may be representative.

In some embodiments, the first piece may be centered at the first center position. For example, the first piece 114 may be centered at the first center position 112. In some embodiments, the second piece may be centered at the first center position. For example, the second piece 116 may be centered at the first center position 112. As used herein, a piece may be said to be "centered" about a position when a component interior to the piece includes the position. For example, a piece may be said to be "centered" about a center position when a component interior to the piece includes the center position. For example, a piece may be said to be "centered" about a center axis when a component interior to the piece includes the center axis. Therefore, a piece may be centered about a position or axis even if not all portions of the piece are equidistant from the position or axis. Thus, an interior component of first piece 114 includes (or is intersected by) first center position 112. Likewise, an interior component of second piece 116 includes (or is intersected by) second center position 122.

In those instances where an article of footwear includes a second telescoping component, the second telescoping component may be disposed in any suitable position of the article of footwear. In some embodiments, the second telescoping component may be centered at a second center position. Referring to FIG. 2, second telescoping component 121 may be centered at the second center position 122. In other embodiments, the second telescoping component may be disposed in another position of the article of footwear.

In those instances where an article of footwear includes a second telescoping component having a second telescoping outsole member, the second telescoping outsole member may include any suitable number of pieces. Referring to FIG. 2, second telescoping outsole member 120 may include four or more pieces. In other embodiments, the second telescoping outsole member has fewer pieces. For example, the second telescoping outsole member 120 may include two pieces or three pieces (not shown). As shown in FIG. 2, the second telescoping outsole member 120 may include a third piece 124 centered at the second center position 122. Moreover, the second telescoping outsole member 120 may include a fourth piece 126 centered at the second center position 122. Further, the second telescoping outsole member 120 may include a fifth piece 128 centered at the second center position 122. Additionally, the second telescoping outsole member 120 may include a sixth piece 130 centered at the second center position 122. Moreover, the second telescoping outsole member 120 may include a seventh piece 132 centered at the second center position 122. Further, the second telescoping outsole member 120 may include an eight piece 134 centered at the second center position 122. In other embodiments, the second telescoping outsole member may include a different number of pieces.

FIG. 3 illustrates an exploded isometric view of article 100, including midsole 106 and outsole 108. In some embodiments, it may be desirable for the midsole to include protrusion structures to further improve shock absorption of the sole structure. For example, as shown in FIG. 3, the midsole 106 may include a first protrusion structure 160.

In some embodiments, the first protrusion structure extends vertically outward from a base of the midsole. For example, as shown, the first protrusion structure 160 extends along the vertical direction 152 outward from a base 162 of the midsole 106. In some embodiments, the vertical direction is approximately normal to the base. As used, a direction is approximately normal to a surface when it is within twenty degrees from perpendicular to the surface.

In some embodiments, the base 162 is an outer surface of the midsole that is vertically spaced relatively close to the upper 102. For example, as shown, the base 162 is vertically spaced closer to the upper 102 than the first piece 114. In another example, the base 162 is vertically spaced closer to the upper 102 than the second piece 116.

In some embodiments, the midsole includes a second protrusion structure. Referring to FIG. 3, midsole 106 may include second protrusion structure 182. In other embodiments, the midsole may omit a second protrusion structure.

In those instances where the midsole includes a second protrusion structure, the second protrusion structure may extend outward from the sole structure along any suitable direction. In some embodiments, the second protrusion structure may extend along the vertical direction outward from a base of the midsole. Referring to FIG. 3, second protrusion structure 182 may extend along vertical direction 152 outward from base 162 of the midsole 106. In other embodiments, the midsole may omit a second protrusion structure.

In some embodiments, second protrusion structure 182 may include a second smooth surface. For example, as shown in FIG. 3, second protrusion structure 182 includes a second smooth surface 184. As shown, the second smooth surface 184 may have a profile having a linear slope. In other embodiments, the second smooth surface 184 has a profile having a non-linear shape (not shown).

Figure 4:
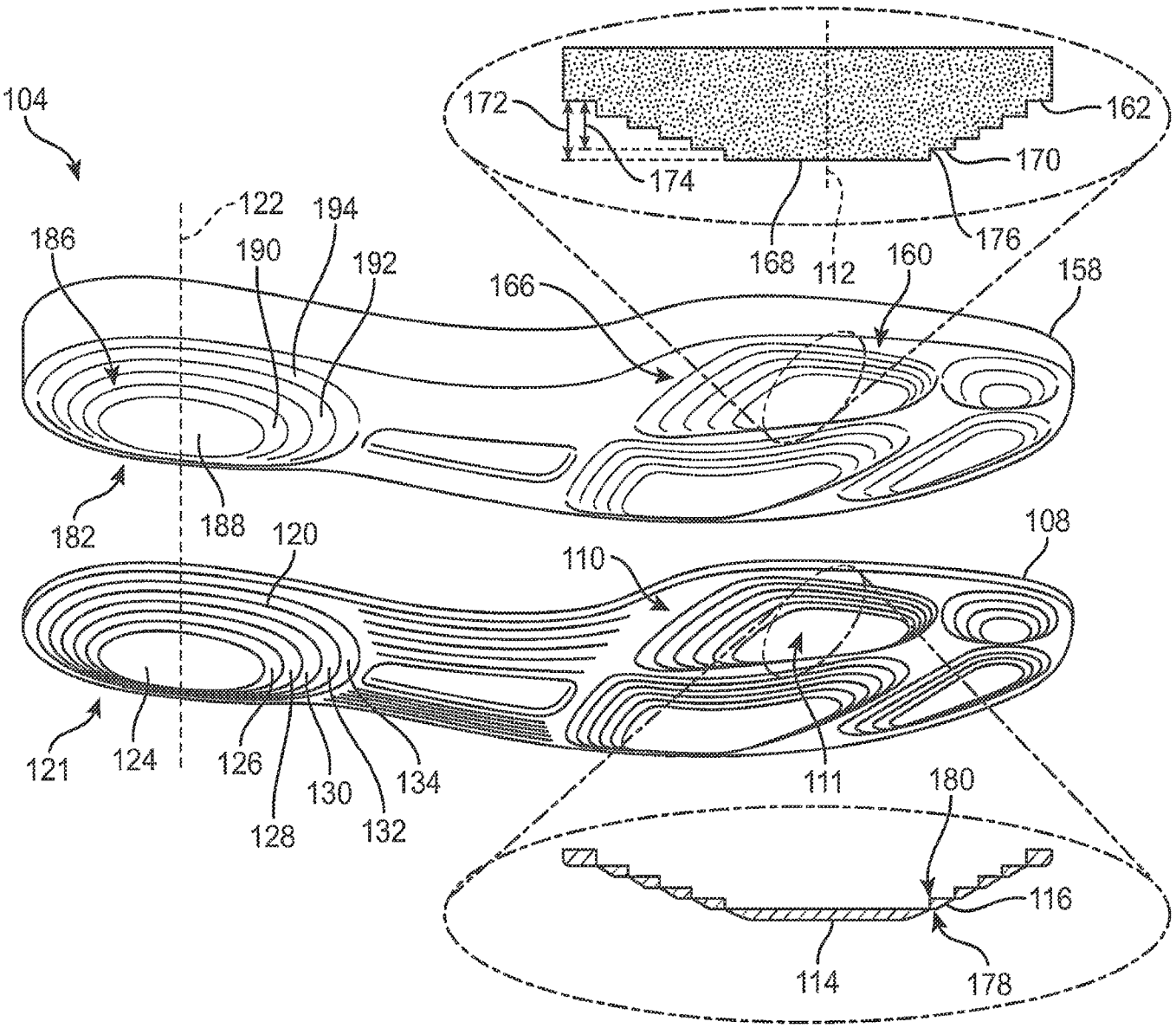
FIG. 4 is an exploded view of an article of footwear having a midsole with a stepped surface, in accordance with an exemplary embodiment.

In various embodiments, it may be desirable for the first protrusion structure and/or the second protrusion structure to have a surface geometry that improves an attachment of the midsole to the outsole. For example, as shown in FIG. 4, the first protrusion structure 160 of the midsole 158 alternatively includes a first stepped surface 166. Such a stepped surface may improve an attachment of the outsole 108 to the midsole 158.

In some embodiments, the first stepped surface includes a first surface corresponding to the first piece. For example, the first stepped surface 166 includes a first surface 168 corresponding to the first piece 114. Similarly, in some embodiments, the first stepped surface further includes a second surface corresponding to the second piece. For example, the first stepped surface 166 further includes a second surface 170 corresponding to the second piece 116. The stepped surface may include any number of surfaces. For example, the first stepped surface 166 may include two or more surfaces. In some embodiments, the first stepped surface includes other surfaces substantially similar to the first surface and/or the second surface. For example, the first stepped surface 166 may include a third surface corresponding to a third piece. In some embodiments, the first stepped surface has the same number of surfaces as corresponding pieces. For example, as shown, the first stepped surface 166 has six surfaces for six corresponding pieces of the outsole 108. In other embodiments, the first stepped surface has fewer or more surfaces than corresponding pieces (not shown).

In some embodiments, the first surface is spaced further from the base than the second surface. For example, as shown in FIG. 4, the first surface 168 is spaced from the base 162 by a first separation distance 172. In the example, the second surface 170 is spaced from the base 162 by a second separation distance 174. Moreover, as illustrated in FIG. 4, the first separation distance 172 is greater than the second separation distance 174.

In some embodiments, the first separation distance and the second separation distance are vertical distances. For example, the first separation distance 172 is a distance extending along the vertical direction 152. In another example, the second separation distance 174 is a distance extending along the vertical direction 152.

In some embodiments, the first surface is within an inner edge of the second surface. For example, as shown in FIG. 4, the first surface 168 is within the inner edge 176 of the second surface 170. In other embodiments, the first surface may be arranged differently with the second surface.

In some embodiments, an edge of a surface and an edge of a corresponding piece may have a substantially similar curvature. As used herein, edges may have substantially similar curvatures when a difference of spacing between the edges at a first position and a second position is within ten percent. Referring to FIG. 4, inner edge 176 of first surface 168 may have a curvature substantially similar to outer edge 178 of the first piece 114. In other embodiments, an edge of a surface and an edge of a corresponding piece may have different curvatures.

In some embodiments, edges of adjacent pieces may have a substantially similar curvature. Referring to FIG. 4, outer edge 178 of the first piece 114 may have a curvature substantially similar to inner edge 180 of second piece 116. In other embodiments, edges of adjacent pieces may have different curvatures.

In some instances, the first surface is centered at the first center position. For example, as shown in FIG. 4, the first surface 168 is centered at the first center position 112. In some embodiments, the second surface is centered at the first center position. For example, as shown in FIG. 4, the second surface 170 is centered at the first center position 112.

Moreover, as shown in FIG. 4, in some embodiments, the midsole may include additional protrusion structures having stepped surfaces. For example, the midsole 106 may include a second stepped surface 186. As shown, In some embodiments, the second stepped surface 186 may be similar to the first stepped surface 166. For example, the second stepped surface 186 includes a third surface 188. In another example, the second stepped surface 186 includes a fourth surface 190. In yet another example, the second stepped surface 186 includes a fifth surface 192. In one example, the second stepped surface 186 includes a sixth surface 194. In some embodiments, the second stepped surface has the same number of surfaces as corresponding pieces. For example, as shown, the second stepped surface 186 has six surfaces for six corresponding pieces of the outsole 108. In other embodiments, the second stepped surface has fewer or more surfaces than corresponding pieces (not shown).

Figure 5:
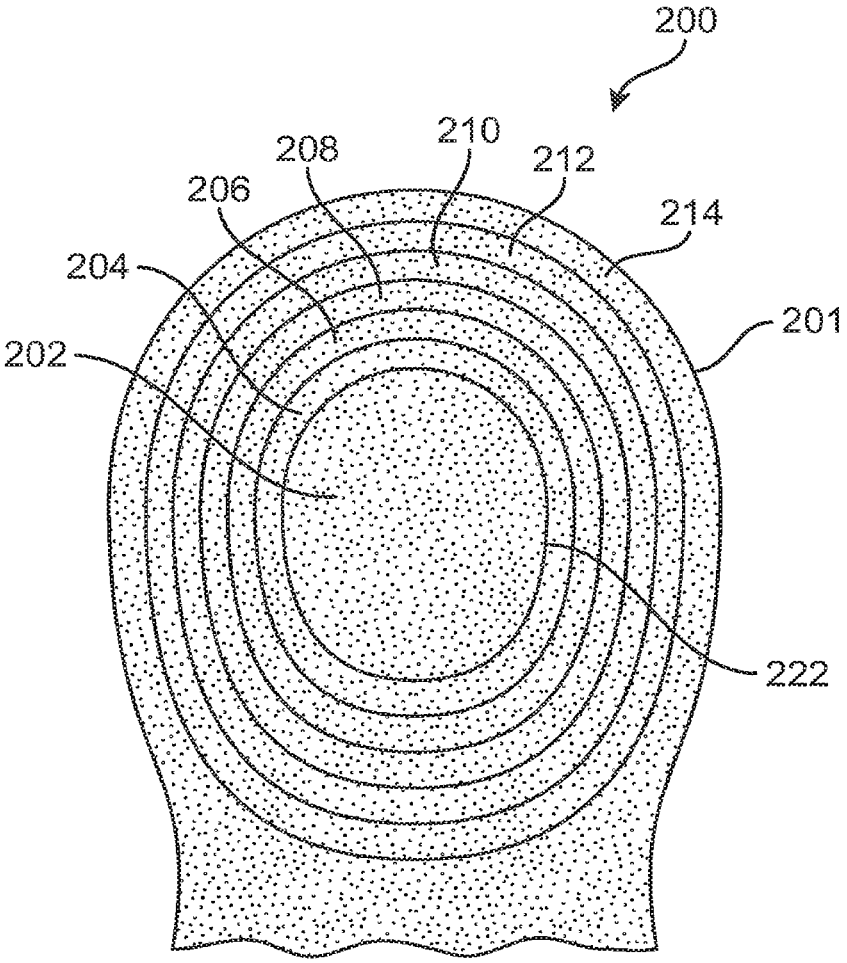
FIG. 5 is a schematic view of a telescoping component of an outsole, in accordance with an exemplary embodiment.
Figure 6:
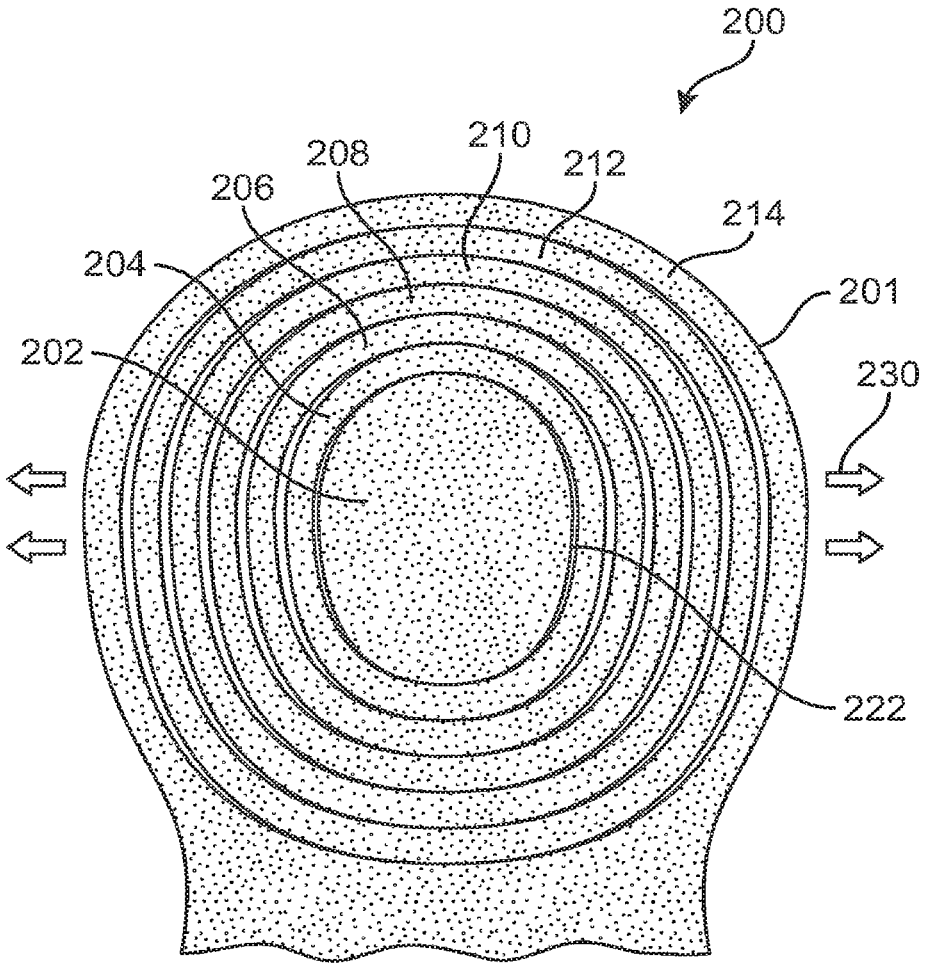
FIG. 6 is a schematic view of the telescoping component of FIG. 5 during a moderate pulling, in accordance with an exemplary embodiment.
Figure 7:
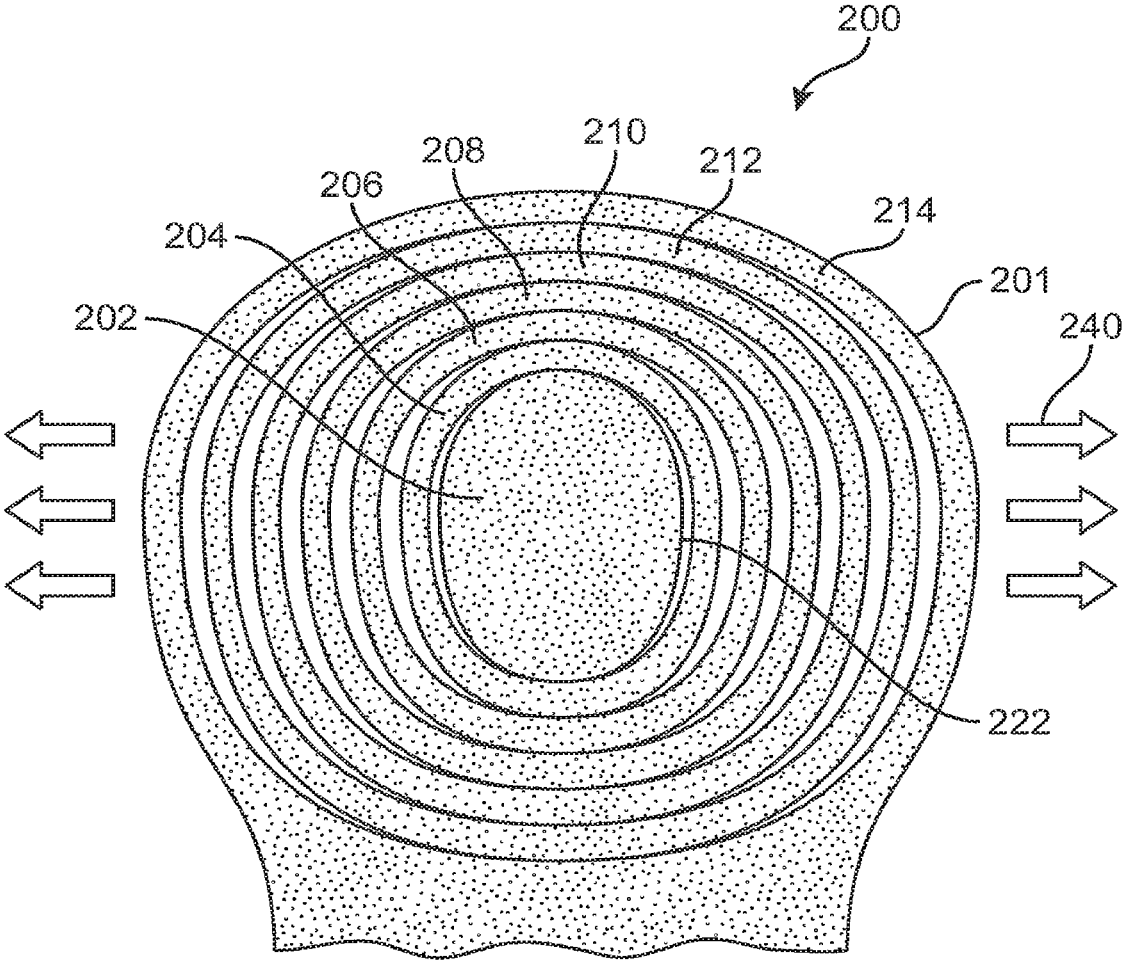
FIG. 7 is a schematic view of the telescoping component of FIG. 5 during a severe pulling, in accordance with an exemplary embodiment.

FIGS. 5-7 illustrate a telescoping component 200 that may be exposed to a moderate pulling (see FIG. 6) and a severe pulling (see FIG. 7). In some embodiments, telescoping component 200 may be substantially similar to first telescoping component 111. In some embodiments, telescoping component 200 may be substantially similar to second telescoping component 121. In other embodiments, telescoping component 200 may be different than first telescoping component 111 and telescoping component 200 may be different than second telescoping component 121.

In some instances, it is desirable for each piece of a telescoping outsole member to move independently from other pieces of the telescoping outsole member in order to facilitate a compression and/or expansion of a sole structure. For example, as shown in FIG. 5, the telescoping outsole member 201 of telescoping component 200 may include a first piece 202, a second piece 204, a third piece 206, a fourth piece 208, a fifth piece 210, a sixth piece 212, and a seventh piece 214. As the first piece 202 may move independently to the second piece 204 and/or to the third piece 206, the telescoping outsole member 201 may facilitate a compression and/or expansion of a sole structure.

In some embodiments, the first piece and the second piece are representative to the other pieces of the telescoping outsole member 201. For example, the first piece 202 has an outer edge corresponding to an inner edge of the second piece 204, the second piece 204 has an outer edge corresponding to an inner edge of the third piece 206, and the third piece 206 has an outer edge corresponding to an inner edge of the fourth piece 208. In other embodiments, the first piece and the second piece are different to the other pieces of the telescoping outsole member 201 (not shown).

In some embodiments, the telescoping outsole member 201 includes fewer pieces. For example, the telescoping outsole member 201 may be formed of two pieces or a single piece. In other embodiments, the telescoping outsole member may include additional pieces. For example, the telescoping outsole member 201 may be formed of eight or more pieces.

In various embodiments, it is desirable to adapt the outsole to a changing geometry of the midsole to facilitate shock absorption. In some embodiments, a sipe separates the first piece and the second piece to allow the pieces of the telescoping outsole member to move independently from each other. For example, as shown in FIG. 5, the first sipe 222 separates the first piece 202 and the second piece 204. As used herein, pieces are separated (or disjoined) when the pieces may be moved toward each other and/or moved away from each other without damaging either piece. In some embodiments, separated or disjoined pieces are elastically attached. As used herein, elastically attached pieces elastically move toward each other and/or move away from each other in response to a displacement of the pieces.

As shown in FIG. 6, a telescoping outsole member may allow for the first piece and the second piece to move independently from each other in order to facilitate shock absorption. For example, as shown, a small horizontal force 230 may move the second piece 204 a small distance away from the first piece 202. In the example, the small horizontal force 230 may move the third piece 206 a small distance away from the second piece 204. In another example, as shown in FIG. 7, a large horizontal force 240 may move the second piece 204 a large distance (relative to the small distances shown in FIG. 6) away from the first piece 202. In the example, the small horizontal force 230 may move the third piece 206 a large distance away from the second piece 204.

Some embodiments may illustrate a four sided piece and/or a circular piece. FIGS. 1-7 illustrate first piece 114 having four sides and third piece 124 being circular. However, some embodiments may utilize pieces having other geometries. For example, a piece may have a polygon shape, curved shape, or other shape. A polygon shape may include a triangle, a quadrilateral, a pentagon, and the like. A curved shape may include a circle, an ellipse, an oval, and the like. Similarly, embodiments, may utilize pieces having varying sizes. For example, pieces may have varying widths, diameters, thickness, and the like. Moreover, while a first piece has a disc-like geometry (with a filled interior), subsequent pieces may have ring or annulus-like geometries with interiors that are empty and may therefore receive an adjacent piece. For example, while first piece 114 may have a disc-like geometry with a filled interior, second piece 116 may have ring or annulus-like geometries with interiors that are empty and may therefore receive first piece 114.

Figure 8:
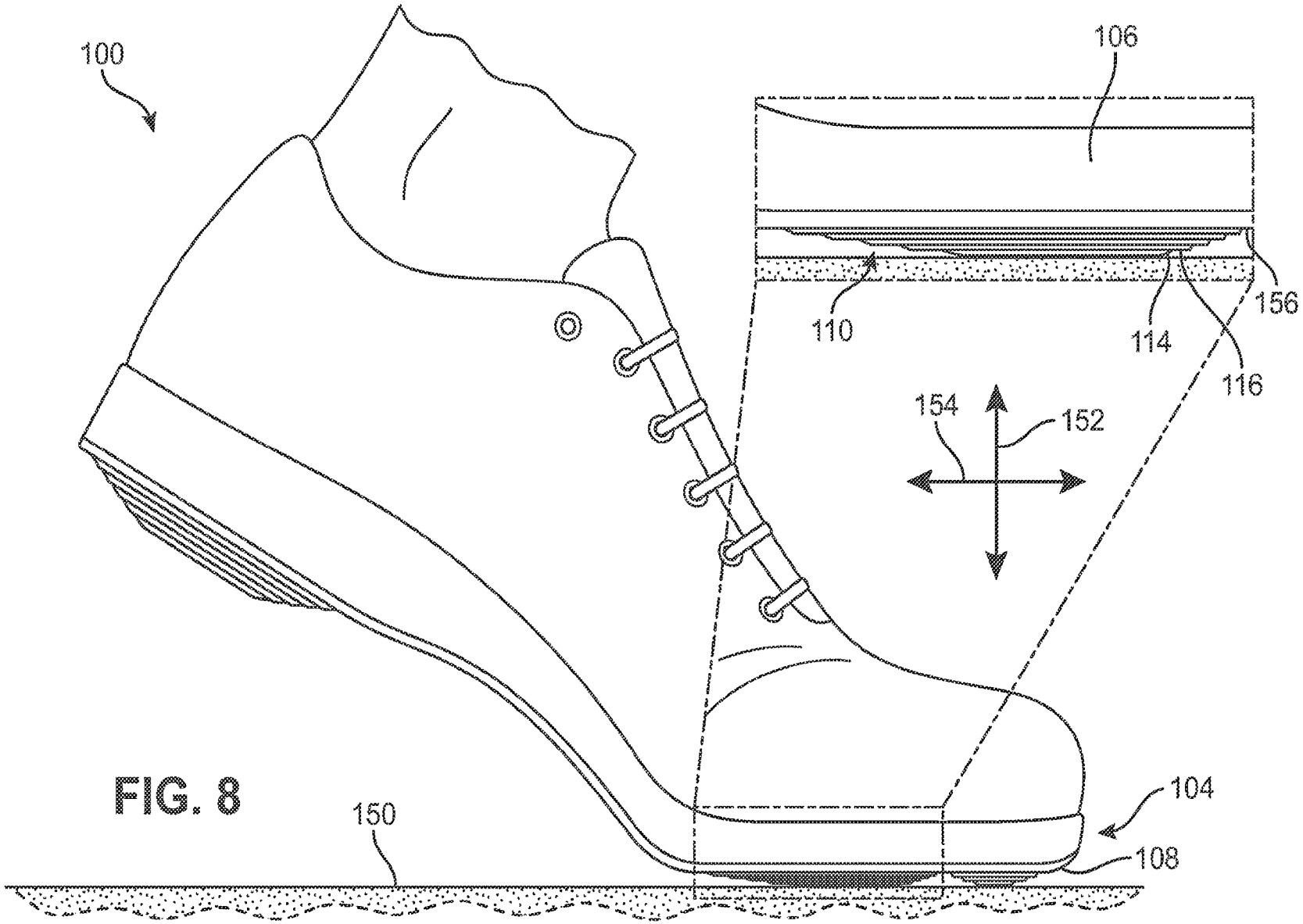
FIG. 8 is a schematic view of a telescoping component during a compression, in accordance with an exemplary embodiment.
Figure 9:
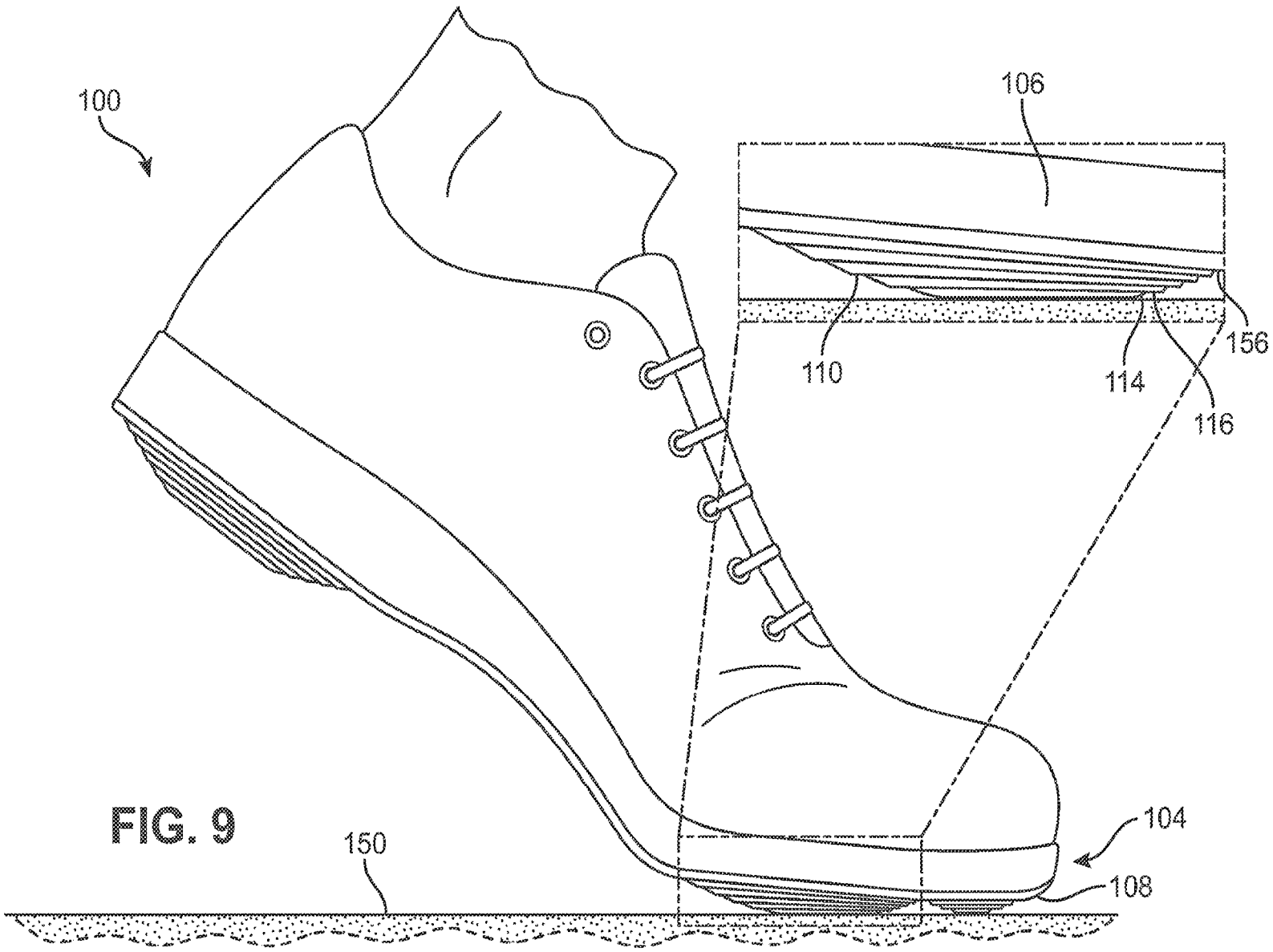
FIG. 9 is a schematic view of the telescoping component of FIG. 8, during a telescoping of the sole.

FIGS. 8 and 9 illustrate schematic views of sole structure 104 as portions of sole structure 104 are compressed and expanded, respectively. For purposes of reference, article 100 is associated with a vertical direction 152 and a horizontal direction 154. Vertical direction 152 may be a direction that is approximately normal to a planar surface of sole structure 104, while horizontal direction 154 may be perpendicular to vertical direction 152 and approximately parallel with a surface of sole structure 104. When article 100 is planted on a ground surface, vertical direction 152 may generally coincide with the usual notion of vertical and horizontal direction 154 may generally coincide with the usual notion of horizontal. For example, a vertical direction may be perpendicular to the ground. For example, a horizontal direction may be parallel to the ground.

As seen in FIG. 8, as article 100 is pressed down against playing surface 150 during use, sole structure 104 may partially compress. Specifically, both midsole 106 and outsole 108 may compress in the vertical direction 152. This compression may help to facilitate cushioning and reduce the impact on a foot. As seen in FIG. 8, outsole 108 may telescope inwardly such that the pieces of outsole move closer to one another along the vertical direction 152. As an example, first telescoping component 111 is seen to telescope inwardly. Specifically, for example, the first piece 114 and the second piece 116 of first telescoping outsole member 110 are both pushed upwards towards base 156 of the midsole 106. In the example, a relative vertical distance between the first piece 114 and the second piece 116 may decrease. In a similar manner, each of the remaining pieces of first telescoping outsole member 110 may be all moved inwardly towards the base 156 and the relative distance between each of these pieces is decreased. For example, first piece 114 and second piece 116 may be moved inwardly towards the base 156 and the relative distance between the first piece 114 and second piece 116 may be decreased.

In various embodiments, the outsole is configured to telescope out from a compressed state to enter a rest state, thereby further facilitating shock absorption for a sole structure. As shown in FIG. 9, the midsole 106 begins to decompress, thereby forcing the outsole 108 to telescope toward a relaxed state. As an example, first telescoping component 111 telescopes outwardly as each piece of first telescoping outsole member 110 is moved further from base 156 of midsole 106 in the vertical direction 152. For example, the midsole 106 forces the first piece 114 to extend vertically away from the second piece 116. This extending of the first piece 114 helps to accommodate the midsole as the midsole contributes to provide further shock absorption.

Figure 10:
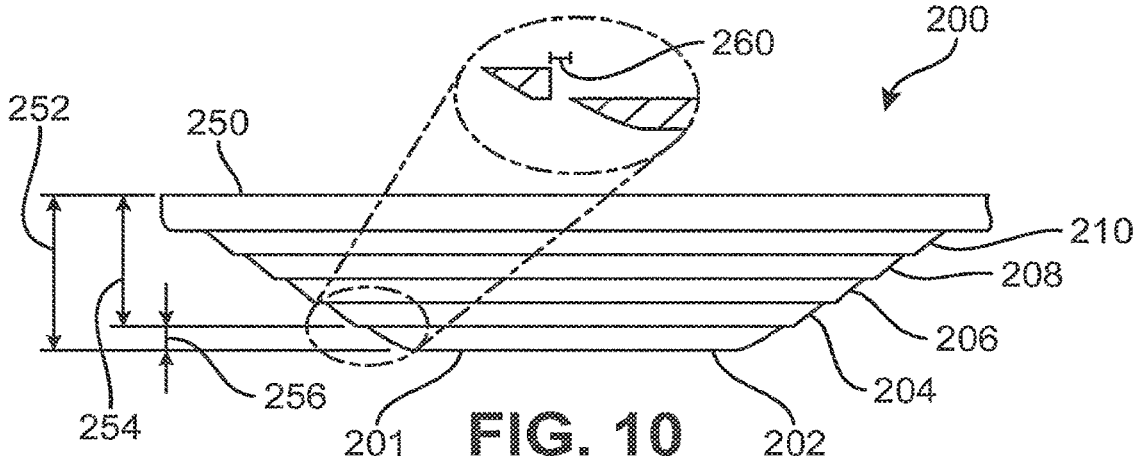
FIG. 10 is a side view of a telescoping component, in accordance with an exemplary embodiment.
Figure 11:
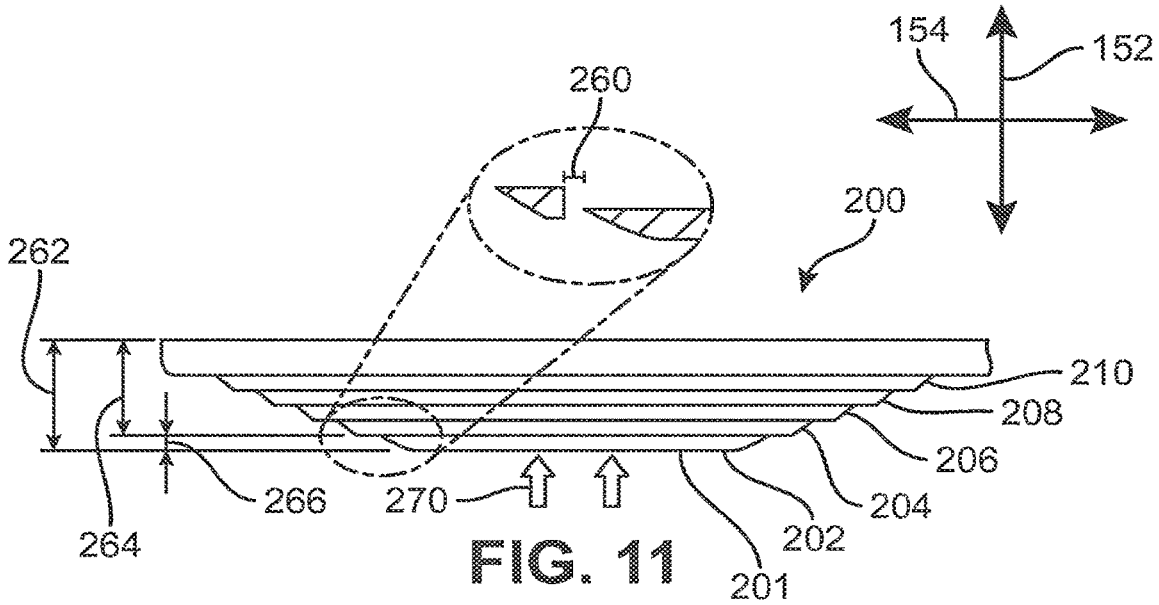
FIG. 11 is a side view of the telescoping component of FIG. 10 during a moderate compression, in accordance with an exemplary embodiment.
Figure 12:
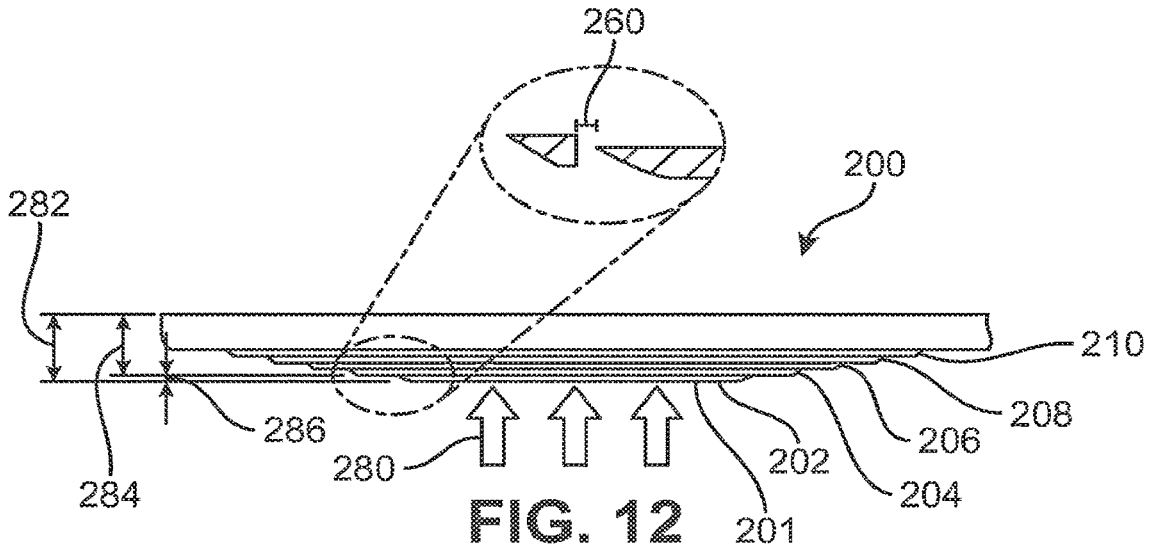
FIG. 12 is a side view of the telescoping component of FIG. 10 during a severe compression, in accordance with an exemplary embodiment.

In some embodiments, the telescoping component may be configured to compress from a resting state into a compressed state for shock absorbency. For example, FIGS. 10-12, illustrate a transition from a resting state into a compressed state. As shown in FIG. 10, the telescoping component 200 (previously discussed and shown in FIGS. 5-7) is in a resting state, in accordance to an exemplary embodiment. In some embodiments, the telescoping outsole member of the telescoping component has a vertical position of its parts that can change between a resting state and a compressed state. For example, in the resting state, first piece 202 of telescoping outsole member 201 may be spaced from base 250 by first vertical distance 252 and second piece 204 of telescoping outsole member 201 may be spaced apart from base 250 by second vertical distance 254. As shown in FIG. 10, first piece 202 may be spaced apart from second piece 204 by vertical separation distance 256. As used herein, the vertical distance may be associated with vertical direction 152.

In some embodiments, the telescoping outsole member may have a horizontal position that remains constant in a transition from a resting state into a compressed state. For example, in the resting state, the first piece 202 of telescoping outsole member 201 may be spaced from base 250 by horizontal separation distance 260. In some embodiments, the resting horizontal distance may extend in the horizontal direction. For example, as shown in FIG. 10, horizontal separation distance 260 may extend in the horizontal direction 154.

As shown in FIG. 11, a compression force begins to compress the telescoping component 200. The compression force 270 may, for example, result from the telescoping component 200 impacting a playing surface. Accordingly, as noted above, the compression of the telescoping component 200 may help to absorb shocks from such an impact.

In some embodiments, the compression force causes a compression of a midsole, thereby decreasing a separation distance between the base and the first piece from the first vertical distance of FIG. 10 to the first compression distance of FIG. 11. For example, the compression force 270 causes a compression of midsole 106, thereby decreasing a separation distance between the base 250 and the first piece 202 from the first vertical distance 252 of FIG. 10 to the first compression distance 262 of FIG. 11. Similarly, in various embodiments, the compression force causes a compression of a midsole, thereby decreasing a separation distance between the base and the second piece from the first vertical distance of FIG. 10 to the first compression distance of FIG. 11. For example, the compression force 270 causes a compression of midsole 106, thereby decreasing a separation distance between the base 250 and the second piece 204 from the second vertical distance 254 of FIG. 10 to the second compression distance 264 of FIG. 11.

In some embodiments, the compression of the telescoping component may reduce a difference between the first vertical distance and the second vertical distance. As shown, in some embodiments, the first vertical distance 252 of FIG. 10 extending between the base 250 and the first piece 202 is reduced to a first compression distance 262 during a compression of telescoping component 200. In some embodiments, the compression force may reduce a distance between the first piece and the second piece from a vertical separation distance to a compression vertical separation distance. For example, the compression force may reduce a distance between the first piece 202 and the second piece 204 from the vertical separation distance 256 of FIG. 10 to compression vertical separation distance 266 of FIG. 11 during a compression of telescoping component 200.

In some embodiments, the telescoping component may have a horizontal position that remains constant during a compression of the telescoping component. For example, as shown in FIGS. 10-11, first piece 202 may be spaced apart from second piece 204 by horizontal separation distance 260 before the compression of the telescoping component 200 by compression force 270 and after the compression of the telescoping component 200 by the compression force 270.

As shown in FIG. 12, the compression force 280 may compress telescoping component 200 into a compressed state. As used herein a compressed state may be when a component reduces in size in response to a compression force. In some embodiments, when the compression force is removed, a component may be configured to return to a relaxed or uncompressed state.

In some embodiments, the telescoping component may be configured to compress for shock absorbency into a compressed state. For example, as shown in FIG. 12, first piece 202 may be spaced apart from second piece 204 by compressed vertical separation distance 286 during compression force 280. In the example, first piece 202 may be spaced apart from the base 250 by first compressed distance 282 during compression force 280. In the example, second piece 204 may be spaced apart from base 250 by second compressed distance 284 during the compression force 280.

FIGS. 13-16 illustrate an exemplary telescoping component configured to collapse. As discussed further, such a collapse may result in enhanced attachment and reduce unwanted drag against a ground surface.

Figure 13:
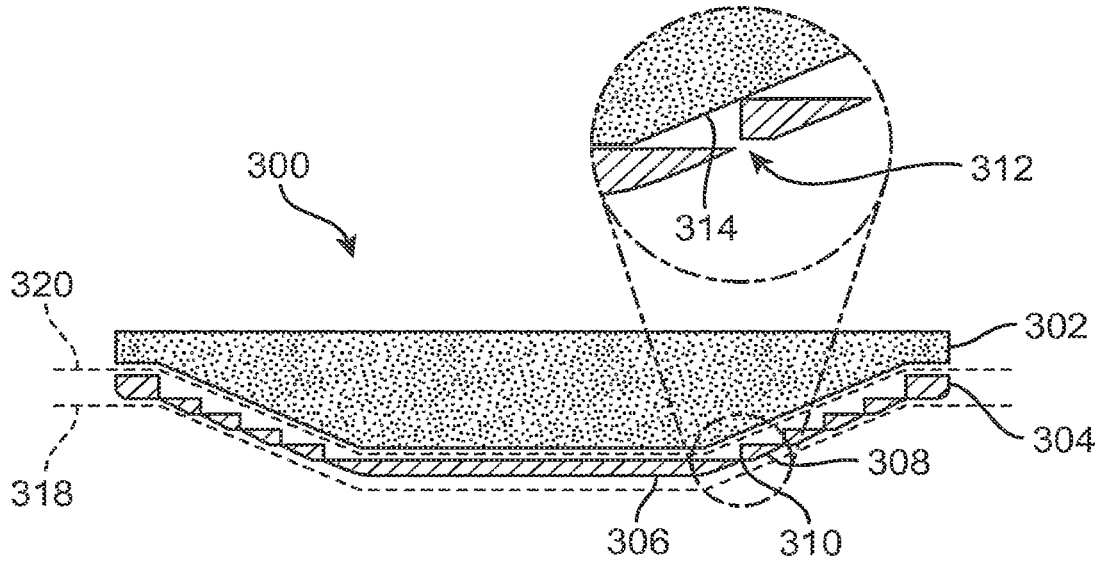
FIG. 13 is a schematic view of a telescoping component, in accordance with an exemplary embodiment.

In some embodiments, a telescoping component may have a protrusion structure and a telescoping outsole member. Referring to FIG. 13, telescoping component 300 may include protrusion structure 302 and telescoping outsole member 304. In other embodiments, the telescoping component may be formed differently.

In some embodiments, a protrusion structure of a telescoping component and a telescoping outsole member of a telescoping component may have a substantially similar uncompressed surface area. Referring to FIG. 13, telescoping outsole member 304 may have uncompressed surface area 318. In the example, protrusion structure 302 may have uncompressed surface area 320. In the example, uncompressed surface area 318 of telescoping outsole member 304 may be substantially similar to uncompressed surface area 320 of protrusion structure 302. As used herein, a first surface area and a second surface area are substantially similar when a difference between the first surface area and the second surface area is less than twenty percent of a total surface area of either the first surface area or the second surface area. In other embodiments, a protrusion structure of a telescoping component and a telescoping outsole member of a telescoping component may have different uncompressed surface areas.

In some embodiments, the telescoping component 300 is substantially similar to telescoping component 111. For example, the protrusion structure 302 may have features substantially corresponding with protrusion structure 160. In another example, telescoping outsole member 304 may have features substantially corresponding with telescoping outsole member 110. In other embodiments, telescoping component 300 is different than telescoping component 111.

In those instances where a telescoping outsole member is used, the telescoping outsole member may include any suitable number of pieces. In some embodiments, the telescoping outsole member may include at least two pieces. Referring to FIG. 13, telescoping outsole member 304 may include first piece 306 and second piece 308. As previously noted, the telescoping outsole member may include any number of pieces. Moreover, as shown, the first piece and the second piece may be representative of other pieces of the telescoping outsole member. For example, the telescoping outsole member may include a third piece disjoined from first piece 306 and disjoined from second piece 308.

In certain instances it is desirable to form an outsole using a sipe to separate an outsole member into multiple pieces. Referring to FIG. 13, telescoping outsole member 304 of telescoping component 300 may include sipe 310 to separate first piece 306 of telescoping outsole member 304 from the second piece 308 of telescoping outsole member 304. In other embodiments, an outsole member may be formed differently.

In some embodiments, the telescoping component may include any number of gaps that extend through the telescoping outsole member of the outsole. In some embodiments, a gap may extend through the outsole along a side surface of the midsole to expose the side surface. For example, as shown in FIG. 13, the gap 312 exposes the side surface 314.

In those instances where a gap is used, the gap may be formed by any suitable method. In some embodiments, a gap may be formed by a sipe. Referring to FIG. 13, gap 312 may be formed by sipe 310. In other embodiments, a gap may be formed by other methods.

Figure 14:
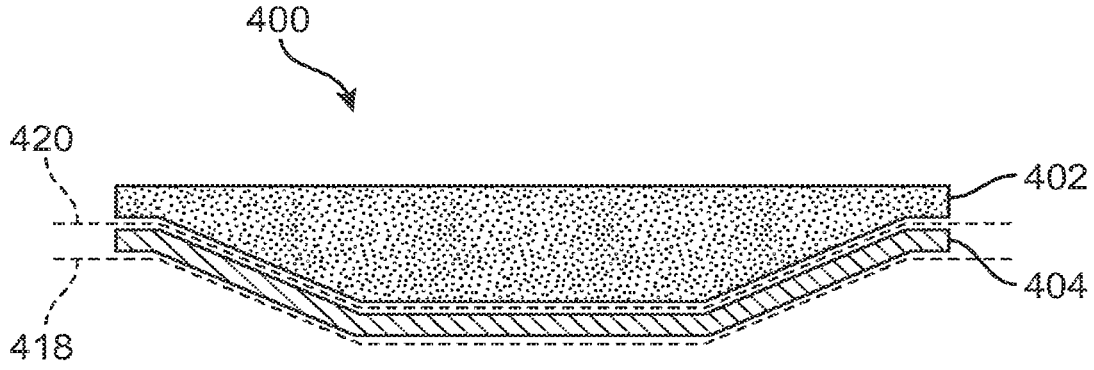
FIG. 14 is a schematic view of an outsole of another embodiment.

In contrast, an article 400 may have a midsole 402 and an outsole 404. As shown in FIG. 14, the outsole 404 comprises one monolithic element substantially extending over the midsole 402. In some embodiments, the outsole has an uncompressed surface area. For example, as shown in FIG. 14, the outsole 404 includes an uncompressed surface area 418. Similarly, the midsole has a compressed surface area. For example, as shown in FIG. 14, the midsole 402 includes a surface area 420. In various embodiments, the uncompressed surface area of the outsole is substantially similar to the uncompressed surface area of the midsole. For example, as shown, the uncompressed surface area 418 of the outsole 404 is substantially similar to the surface area 420 of the midsole 402.

Figure 15:
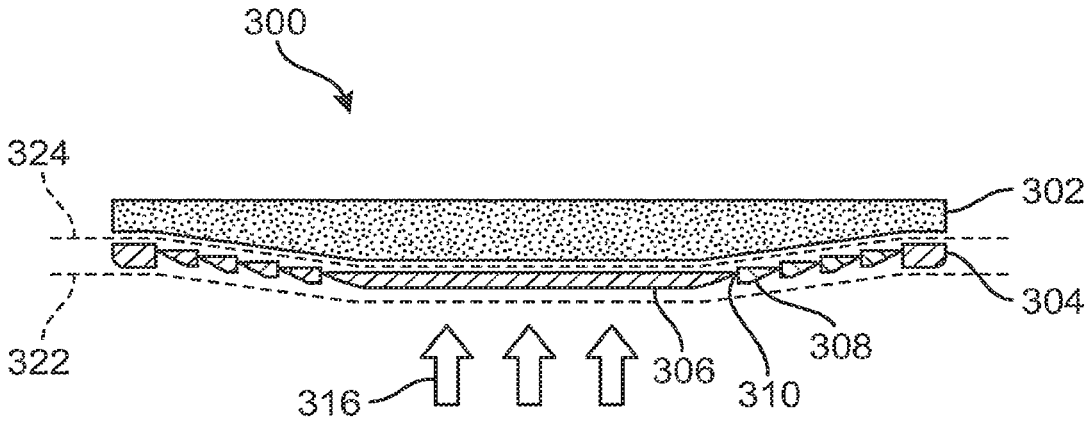
FIG. 15 is a schematic view of the telescoping component ole of FIG. 13 during a compression, in accordance with an exemplary embodiment.

As noted above, in some instances, it may be desirable to configure the telescoping component to collapse in an effort to enhance attachment and reduce unwanted drag against a ground surface. Referring to FIG. 15, telescoping component 300 may be exposed to a compression force 316. In the example, telescoping outsole member 304 may allow protrusion structure 302 to compress. Referring to FIGS. 13 and 15, the surface area of the protrusion structure 302 may reduce from uncompressed surface area 320 to compressed surface area 324. In the example, the surface area of the telescoping outsole member 304 may reduce from uncompressed surface area 318 to compressed surface area 322. As shown, compressed surface area 324 of the protrusion structure 302 may be substantially similar to compressed surface area 322 of telescoping outsole member 304, thereby facilitating enhanced attachment and reducing unwanted drag against a ground surface.

Figure 16:
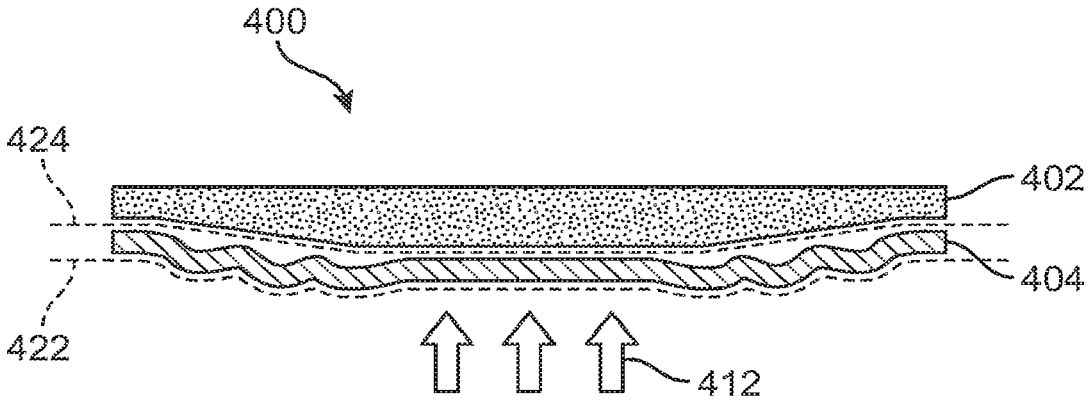
FIG. 16 is a schematic view of the outsole of FIG. 14 during a compression.

Similarly, the article 400 may be exposed to a compression force 412. Moreover, as shown in FIGS. 14 and 16, the surface area of the midsole 402 may reduce from the uncompressed surface area 420 to the compressed surface area 424. However, in the example, the surface area of the outsole 404 may remain substantially constant when changing from the uncompressed surface area 418 to the compressed surface area 422. Accordingly, in the example, the outsole 404 may bulge, bubble, and wrinkle, which, in some cases, may cause issues with attachment, unwanted drag against a ground surface, and the like.

Figure 17:
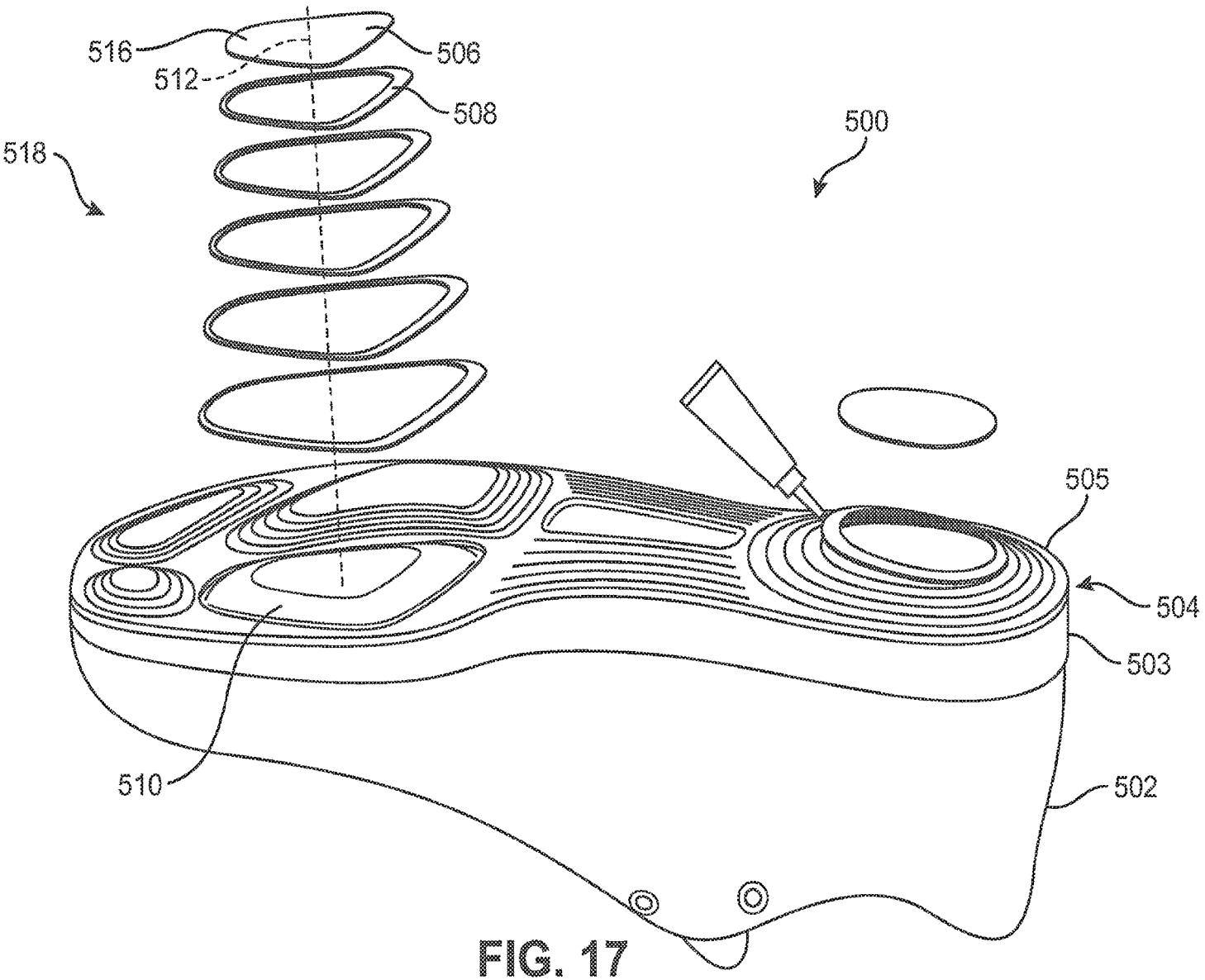
FIG. 17 is a schematic view of a method of making an article of footwear by attaching a first piece of a telescoping outsole member to a telescoping structure of a midsole, in accordance with an exemplary embodiment.

FIG. 17 illustrates a method for a fabrication of an article. As shown, the article 500 may include an upper 502 and a sole structure 504. In some embodiments, the sole structure 504 includes a midsole 503 and an outsole 505.

In some embodiments, an upper may be provided. For example, FIG. 17 illustrates an upper 502. In some embodiments, the upper 502 is substantially similar to the upper 102. In other embodiments, the upper 502 is different than the upper 102.

In some embodiments, the upper may be attached to the midsole. For example, upper 502 may be stitched to the sole structure 504 or the upper 502 may be glued to sole structure 504.

In various embodiments, a first piece for an outsole may be provided. For example, as shown in FIG. 17, first piece 506 of telescoping outsole member 516 of telescoping component 518 may be formed using traditional methods. Such traditional methods may include, for example, forming the first piece 506 in a mold, cutting the first piece 506 from a molded material, and the like.

In some embodiments, a second piece for an outsole may be provided. For example, as shown in FIG. 17, the second piece 508 is formed using traditional methods. Such traditional methods may include, for example, forming the second piece 508 in a mold, cutting the second piece 508 from a molded material, and the like. In some embodiments, any number of pieces for the outsole may be provided. For purposes of clarity, the first piece 506 and the second piece 508 are representative of the various pieces for the outsole.

In some embodiments, the method attaches the first piece and the second piece such that the attached first piece and the second piece have a common center position. For example, the first piece 506 may be centered at the first center position 512 and the second piece 508 may be centered at the first center position 512. In various embodiments, the method attaches any number of pieces such that the attached pieces have a common center position.

In some embodiments, the midsole may have a first protrusion structure centered at the first center position to allow the protrusion structure, the first piece, and the second piece to have a common center. For example, the midsole 503 may have a first protrusion structure 510 centered at the first center position 512. In the example, the first piece 506 is centered at the first center position 512 and the second piece 508 is centered at the first center position 512. Accordingly, in the example, the protrusion structure 510, the first piece 506, and the second piece 508 have a common center, thereby allowing enhanced shock absorption while maintaining an attachment of the outsole 505 to the midsole 503.

Figure 18:
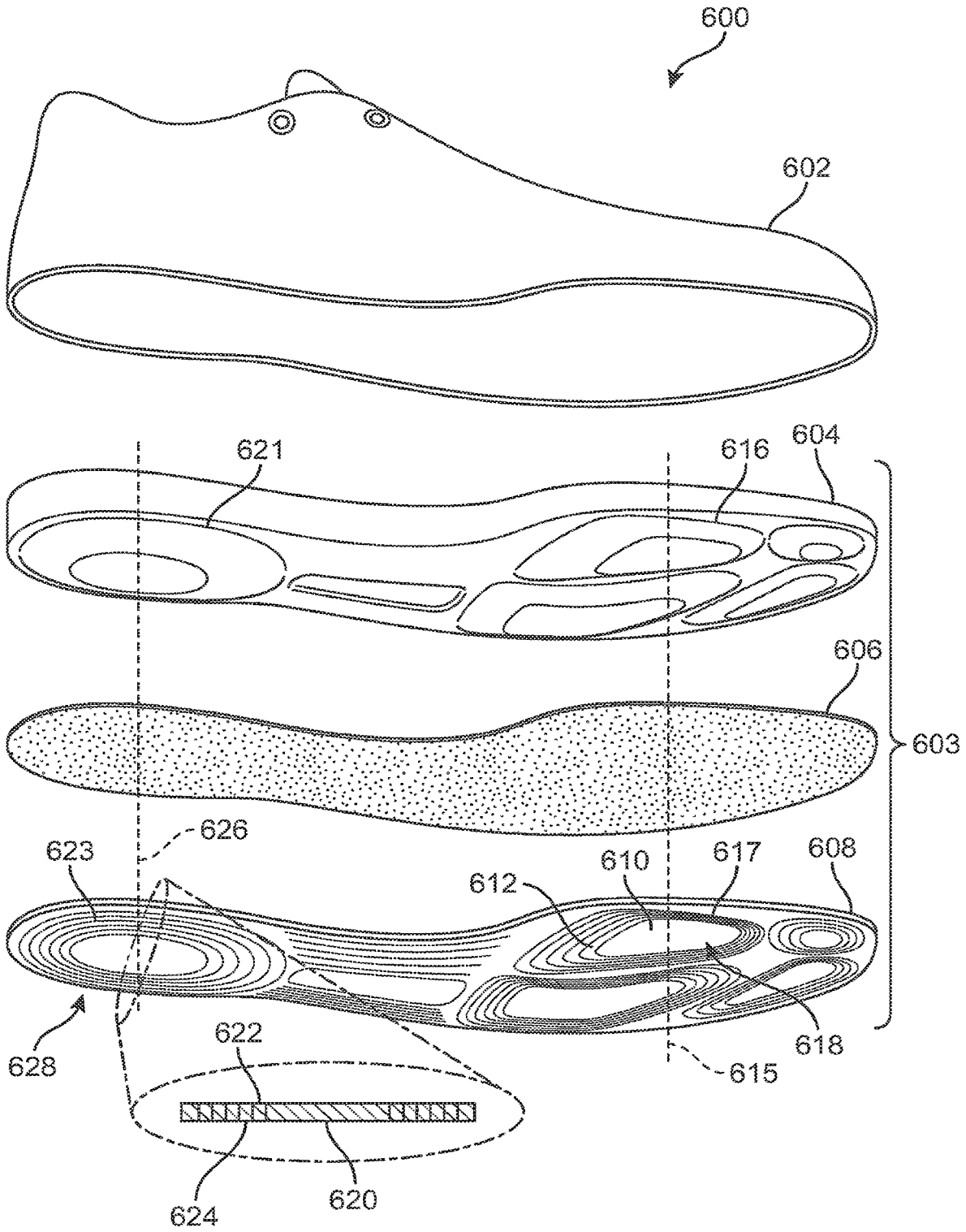
FIG. 18 is an illustration of parts for an article of footwear, in accordance with an exemplary embodiment.

In some instances an elastic layer may be used to simplify an attaching of a telescoping outsole. For example, as illustrated in FIG. 18, a method for fabricating an article 600 includes providing an upper 602, a midsole 604, an elastic layer 606, and an outsole 608.

In some embodiments, article of footwear 600 may be substantially similar to article of footwear 100. In other embodiments, the article of footwear may be different. Referring to FIGS. 1 and 18, upper 602 may be substantially similar to the upper 102. In the example, sole structure 603 may be substantially similar to sole structure 104. In the example, sole structure 603 may include a first telescoping component 618 that may be substantially similar to first telescoping component 111. In the example, sole structure 603 may include a second telescoping component 628 that may be substantially similar to second telescoping component 121. In the example, midsole 604 may be substantially similar to the midsole 106. That is, as shown in FIG. 18, midsole 604 may include a first protrusion structure 616 that may be substantially similar to first protrusion structure 160. In the example, midsole 604 may include a second protrusion structure 621 that may be substantially similar to second protrusion structure 182. In other embodiments, midsole 604 may be different than the midsole 106.

In some embodiments, the elastic layer is provided having a shape substantially corresponding to a shape of the midsole. For example, as shown in FIG. 18, the elastic layer 606 and the midsole 604 are provided having a shape substantially corresponding to a foot. In other embodiments, the elastic layer 606 and the midsole 604 have different shapes. For example, the elastic layer 606 may have a shape corresponding to the first protrusion structure 616.

In some embodiments, the elastic layer is provided having a shape substantially corresponding to a shape of the outsole. For example, as shown in FIG. 18, the elastic layer 606 and the outsole 608 are provided having a shape substantially corresponding to a foot. In other embodiments, the elastic layer 606 and the outsole 608 have different shapes. For example, the elastic layer 606 may have a circular shape corresponding to the second protrusion structure 621.

In some embodiments, the elastic layer is substantially planar. For example, as shown in FIG. 18, the elastic layer 606 is substantially flat. In some instances, the elastic layer has a surface corresponding to a surface of the outsole 608 prior to attachment. For example, as shown, the elastic layer 606 is planar and the outsole 608 is planar.

In some embodiments, the outsole 608 is substantially similar to the outsole 108. In other embodiments, the outsole 608 is different than the outsole 108. As shown in FIG. 18, In some embodiments, the outsole 608 may be substantially flat.

In some embodiments, the outsole may include a first telescoping outsole member. For example, as shown in FIG. 18, outsole 608 may include the first telescoping outsole member 617. In some embodiments, the first telescoping outsole member includes a first piece. For example, as illustrated, the first telescoping outsole member 617 includes a first piece 610. In some embodiments, the first telescoping outsole member includes a second piece. For example, as illustrated, the first telescoping outsole member 617 includes a second piece 612. In some embodiments, the outsole includes providing any number of pieces for the first telescoping outsole member. In the example, the first piece 610 and the second piece 612 are representative of other pieces for the first telescoping outsole member 617.

In those instances where the sole structure includes a second telescoping component, the second telescoping component may be configured to include a telescoping outsole member having any suitable number of pieces. In some embodiments, the second telescoping outsole member may include a plurality of pieces. Referring to FIG. 18, second telescoping outsole member 623 of second telescoping component 628 may include third piece 620, fourth piece 622, and fifth piece 624. In the example, the third piece 620, the fourth piece 622, and the fifth piece 624 may be representative of other pieces for second telescoping outsole member 623 of second telescoping component 628.

In some embodiments, the first piece may be attached to the elastic layer. For example, the first piece 610 may be glued to the elastic layer 606. In another example, the first piece 610 may be stitched to the elastic layer 606 (not shown). In some embodiments, the second piece may be attached to the elastic layer. For example, the second piece 612 may be glued to the elastic layer 606. In another example, the second piece 612 may be stitched to the elastic layer 606 (not shown).

In some embodiments, it is desirable to configure the elastic layer 606 to elastically attach the first piece and the second piece. For example, as previously illustrated in FIGS. 5-7, it may be desirable for the first piece 610 and the second piece 612 to move relative to each other and to return to a relaxed state after a compression into a compressed state. For example, the elastic layer 606 may have a low Young's modulus of less than 10. In another example, the elastic layer 606 may have a low Young's modulus of less than 5. In yet another example, the elastic layer 606 may have a low Young's modulus of less than 3. In one example, the elastic layer 606 may have a low Young's modulus of less than 2. In a further example, the elastic layer 606 may have a low Young's modulus of less than 1. In some examples, the elastic layer 606 may have a low Young's modulus of less than 0.5. The elastic layer may be formed of various materials. For example, the elastic layer 606 may be formed of a synthetic polymer. In some embodiments, synthetic polymer includes, for example, nylon. In yet another example, the elastic layer 606 is formed of a thermoplastic. In some embodiments, thermoplastic includes polypropylene.

In some embodiments, the first telescoping outsole member may be centered at a center. Referring to FIG. 18, first piece 610 of first telescoping outsole member 617 may be centered at first center position 615. In the example, second piece 612 of first telescoping outsole member 617 may be centered at first center position 615. In other embodiments, the first telescoping outsole member may be arranged differently.

In various embodiments, the second telescoping outsole member may be centered at a position. Referring to FIG. 18, third piece 620 of second telescoping outsole member 623 may be centered at second center position 626. In the example, fourth piece 622 of second telescoping outsole member 623 may be centered at second center position 626. In the example, fifth piece 624 of second telescoping outsole member 623 may be centered at second center position 626. In other embodiments, the second telescoping outsole member may be arranged differently.

Figure 19:
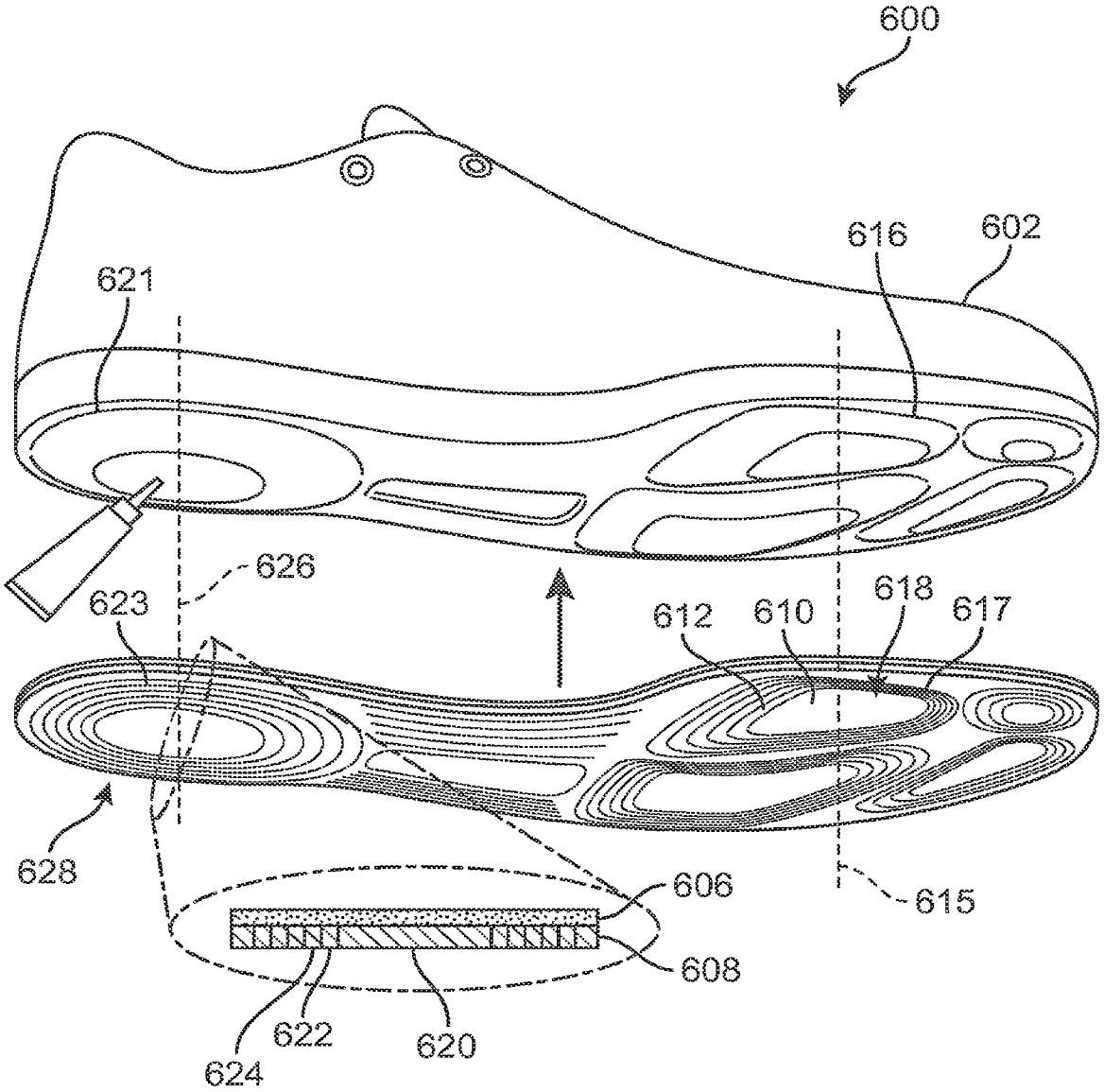
FIG. 19 is a schematic view of a method of making an article of footwear using the parts of FIG. 18, in accordance with an exemplary embodiment.

In some embodiments, the elastic layer may be attached to the midsole. For example, as shown in FIG. 19, the elastic layer 606 may be glued to the midsole 604. In another example, the elastic layer 606 may be stitched to the midsole 604 (not shown).

In some embodiments, it is desirable to attach the first piece and the second piece to the elastic layer such that the attached first piece and the attached second piece have a common center position. For example, as shown in FIG. 19, the first piece 610 is centered at a first center position 615. In the example, the second piece 612 is also centered at a first center position 615.

In some embodiments, it is desirable to attach the elastic layer to the midsole such that the attached first piece and a protrusion structure of the midsole have a common center position. For example, as shown in FIG. 19, the first piece 610 is centered at a first center position 615. In the example, the first protrusion structure 616 is centered at the first center position 615.

In various embodiments, it is desirable to attach the elastic layer to the midsole such that the attached second piece and a protrusion structure of the midsole have a common center position. For example, as shown in FIG. 19, the second piece 612 is centered at a first center position 615. In the example, the first protrusion structure 616 is centered at the first center position 615.

Figure 20:
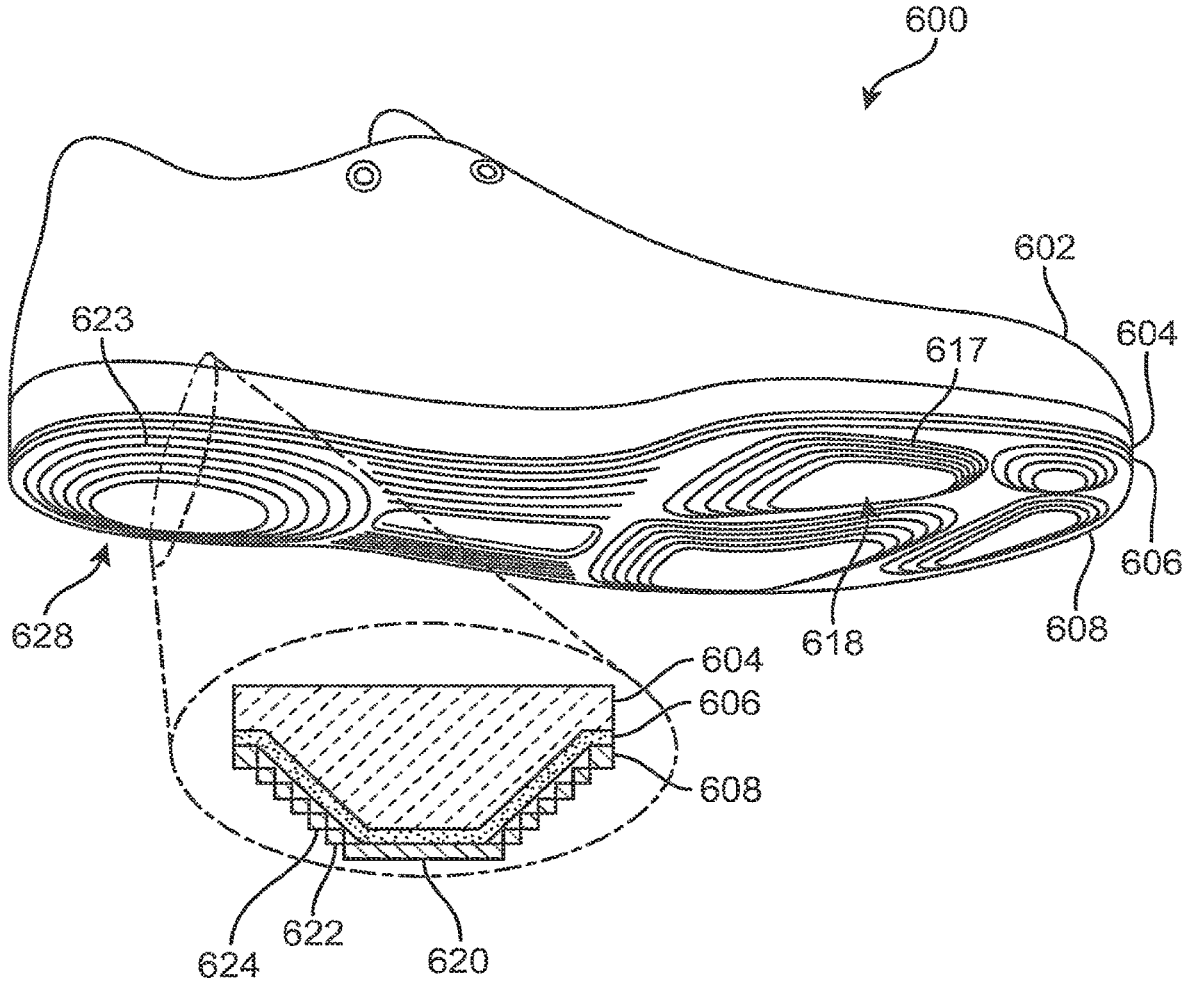
FIG. 20 is an article of footwear resulting from the method illustrated in FIGS. 18 and 19.

In some embodiments, the elastic layer may conform to a shape of the midsole after attachment. For example, as shown in FIG. 20, the elastic layer 606 conforms to a shape of the midsole 604 after attachment. Similarly, in various embodiments, the outsole conforms to a shape of the midsole after attachment. For example, as shown in FIG. 20, the outsole 608 conforms to a shape of the midsole 604 after attachment.

Figure 21:
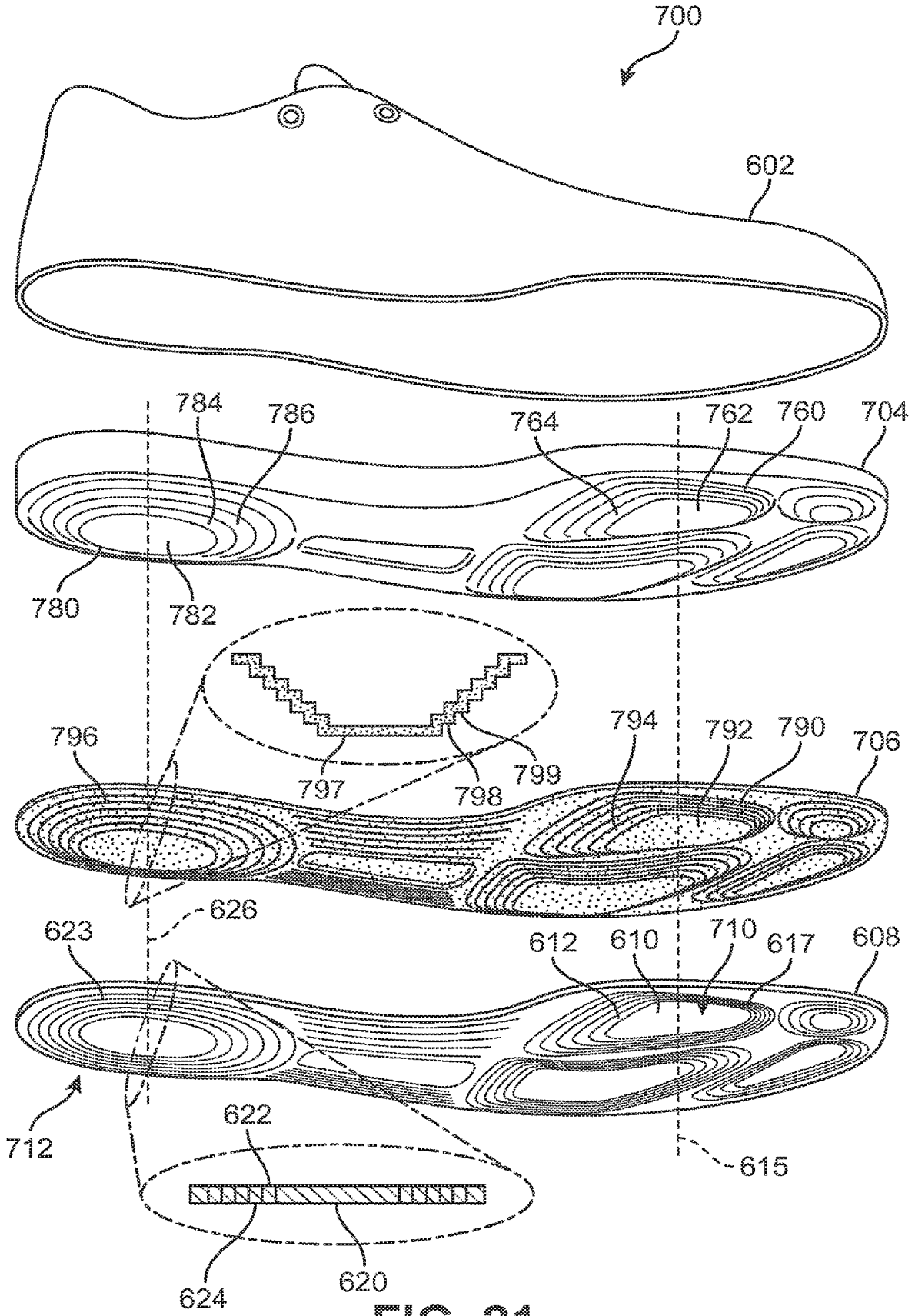
FIG. 21 is an illustration of parts for an article of footwear, in accordance with an exemplary embodiment.

In some embodiments, it is desirable for the elastic layer to have a surface substantially corresponding to the midsole. For example, as shown in FIG. 21, a method of fabricating an article 700 includes providing the upper 602, providing a stepped midsole 704, providing a shaped elastic layer 706, and providing an outsole 608. In other embodiments a shaped elastic layer may be omitted.

In some embodiments, the stepped midsole 704 is substantially similar to the midsole 106 (see FIG. 6). In some embodiments, the detailed midsole may include a first protrusion structure. For example, the stepped midsole 704 may include a first protrusion structure 760 of first telescoping component 710. In another example, stepped midsole 704 may include a second protrusion structure 780 of second telescoping component 712. In other embodiments, the stepped midsole 704 and the midsole 106 are different.

As noted, the first protrusion structure of the first telescoping component may include any number of surfaces. In some embodiments, the first protrusion structure includes a first surface. For example, first protrusion structure 760 of first telescoping component 710 may include a first surface 762. In some embodiments, the first protrusion structure may include a second surface. For example, first protrusion structure 760 may include second surface 764. In some embodiments, the first surface may be centered at a first center position. For example, first surface 762 may be centered at a first center position 615. In another embodiment, the second surface may be centered at a first center position. For example, second surface 764 may be centered at first center position 615.

In those instances where a second protrusion structure is used, the second protrusion structure of the second telescoping component may include any number of surfaces. Referring to FIG. 21, second protrusion structure 780 of second telescoping component 712 may include third surface 782. In the example, second protrusion structure 780 of second telescoping component 712 may include fourth surface 784. In the example, second protrusion structure 780 of second telescoping component 712 may include a fifth surface 786. In other embodiments, the second protrusion structure may be different.

In those instances where a second protrusion structure is used, surfaces of the second protrusion structure may be centered at a position. Referring to FIG. 21, third surface 782 may be centered at second center position 626. In the example, fourth surface 784 may be centered at the second center position 626. In the example, fifth surface 786 may be centered at the second center position 626. In other embodiments, the surfaces of the second protrusion structure may be arranged differently.

In those instances where a shaped elastic layer is used, the shaped elastic layer may have an exposed surface corresponding to one or more protrusion structures of the detailed midsole. Referring to FIG. 21, shaped elastic layer 706 may include first shaped region 790 corresponding to first protrusion structure 760. In the example, shaped elastic layer 706 may include a second shaped region 796 corresponding to the second protrusion structure 780. In other embodiments, the shaped elastic layer may have a different exposed surface.

In some embodiments, the first shaped region of the shaped elastic layer may include any number of attachment surfaces corresponding with pieces of an outsole. Referring to FIG. 21, first shaped region 790 of shaped elastic layer 706 may include first attachment surface 792 corresponding with the first piece 610 of second outsole member 710 of outsole 608. In the example, first shaped region 790 includes a second attachment surface 794 of shaped elastic layer 706 corresponding with the second piece 612 of second outsole member 710 of outsole 608. In other embodiments, the first shaped region may be different.

In some embodiments, the second shaped region may include any number of attachment surfaces corresponding with pieces of an outsole. Referring to FIG. 21, second shaped region 796 of shaped elastic layer 706 may include third attachment surface 797 corresponding with third piece 620 of second telescoping outsole member 623. In the example, second shaped region 796 may include fourth attachment surface 798 corresponding with fourth piece 622 of second telescoping outsole member 623. In the example, second shaped region 796 of shaped elastic layer 706 may include fifth attachment surface 799 corresponding with the fifth piece 624 of second telescoping outsole member 623. In other embodiments, the second shaped region may be different.

In some embodiments, the first shaped region may be centered at a point during an attachment. Referring to FIG. 21, first shaped region 790 of shaped elastic layer 706 may be centered at first center position 615 during attachment. In some embodiments, the first attachment surface may be centered at the first center point during attachment. For example, first attachment surface 792 may be centered at first center position 615 during attachment. In some embodiments, the second attachment surface may be centered at the first center point during attachment. For example, second attachment surface 794 may be centered at the first center position 615 during attachment.

In some embodiments, the second shaped region may be centered at a point during an attachment. Referring to FIG. 21, second shaped region 796 may be centered at second center position 626 during attachment. In some embodiments, the third attachment surface may be centered at the second center point during attachment. For example, third attachment surface 797 may be centered at second center position 626 during attachment. In some embodiments, the fourth attachment surface may be centered at the second center point during attachment. For example, fourth attachment surface 798 may be centered at the second center position 626 during attachment. In some embodiments, the fifth attachment surface may be centered at the second center point during attachment. For example, fifth attachment surface 799 may be centered at the second center position 626 during attachment.

Figure 22:
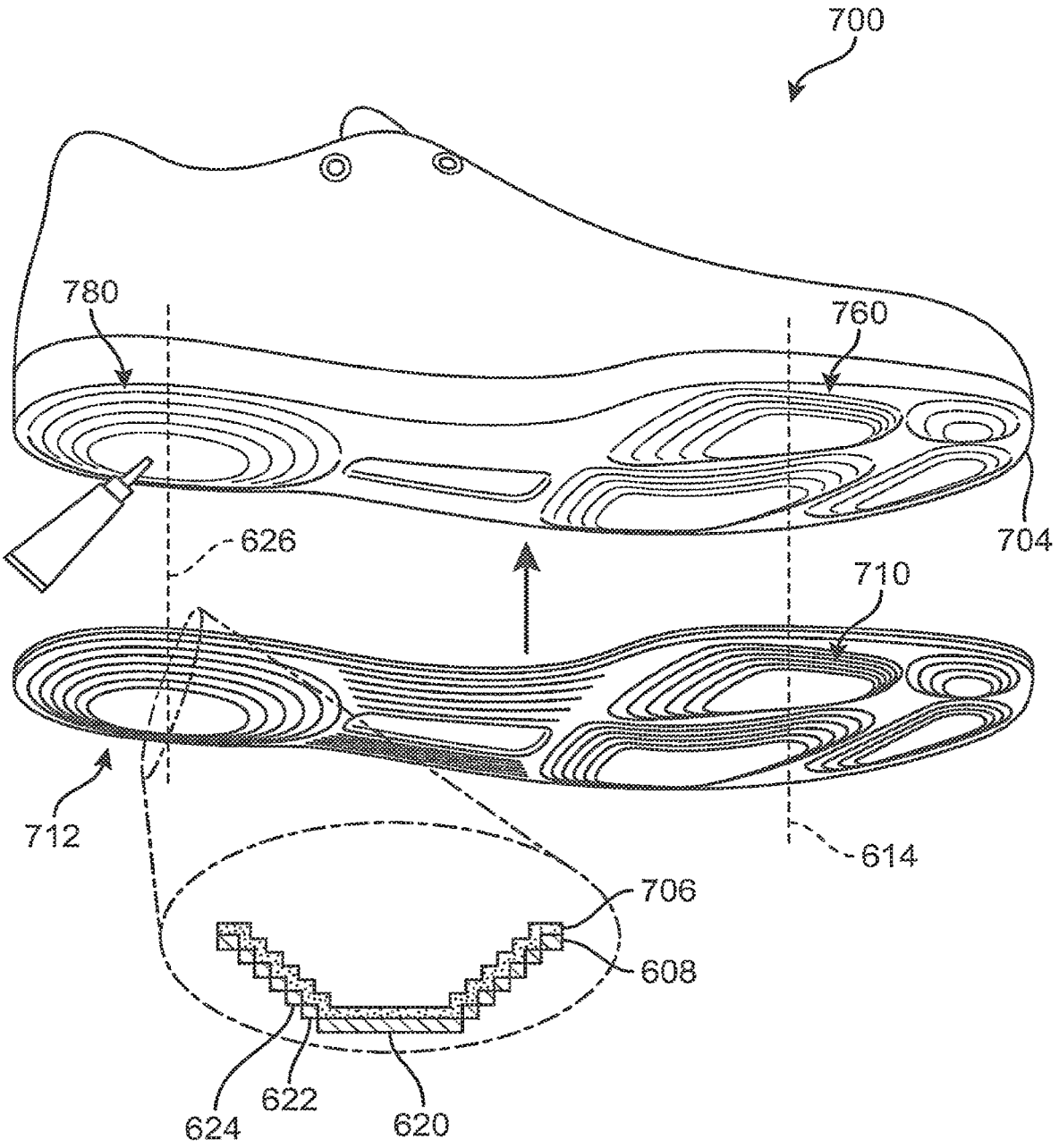
FIG. 22 is a schematic view of a method of making an article of footwear using the parts of FIG. 21, in accordance with an exemplary embodiment.

In some embodiments, the outsole may conform to a shape of the midsole after attachment. For example, as shown in FIG. 22, outsole 608 may conform to a shape of the stepped midsole 704 after attachment. Similarly, in various embodiments, the outsole may conform to a shape of the elastic layer after attachment. For example, as shown in FIG. 22, outsole 608 may conform to a shape of shaped elastic layer 706 after attachment.

In some embodiments, the sole structure of an article of footwear may include components having different shapes. For example, sole structure 104 may include first telescoping component 111 having a polygon shape and second telescoping component 121 having a polygon shape (see FIGS. 2-4). Alternatively, the sole structure can have multiple components, also referred to in FIGS. 23-26 as rounded components. Referring to FIGS. 23-26, sole structure 804 may have a rounded component 821 having a teardrop shape and a rounded component 811 having a polygon shape. In some embodiments, sole structure 804 may be substantially similar to sole structure 104 except that sole structure 804 includes rounded component 821 and rounded component 811 rather than first telescoping component 111 and second telescoping component 121 (see FIGS. 2-4 and 23-26). In other embodiments, the sole structure 104 and sole structure 804 may be different.

In order to support different uses of an article of footwear, the various components of a sole structure may extend different distances outward from the midsole. For example, telescoping component 111 may extend significantly outward from midsole 106 (see FIG. 3). As used herein, a component extends significantly outward from a midsole when the component extends a distance outward from the midsole of greater than a quarter of a total thickness of the midsole. Alternatively, referring to FIGS. 23-26, rounded component 811 may extend moderately outward from midsole 858. In the example, rounded component 821 may extend moderately outward from midsole 858. As used herein, a component may extend moderately outward from a midsole when the component extends a distance outward from the midsole of less than a quarter of a total thickness of the midsole. In other embodiments, components of a sole structure may extend outward from the midsole differently.

Figure 23:
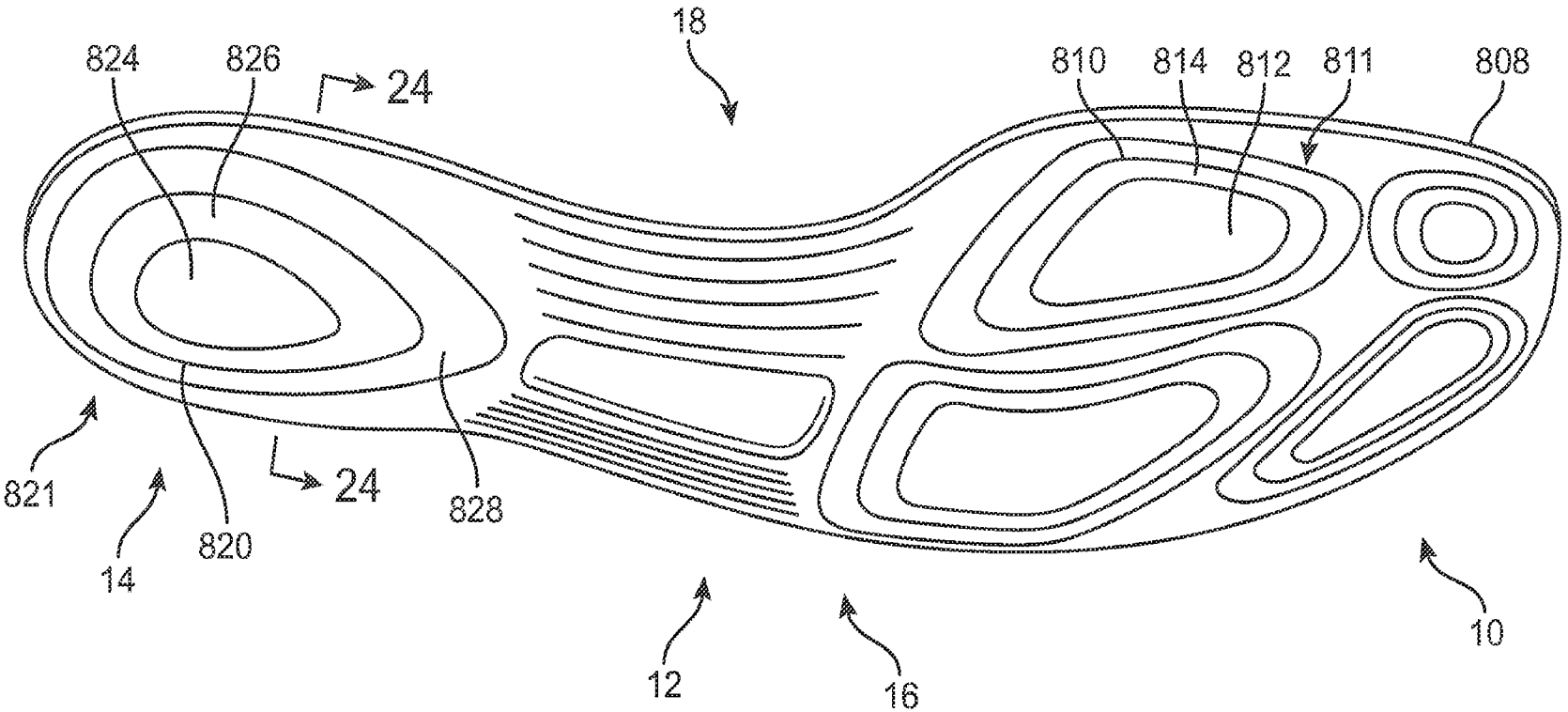
FIG. 23 is a schematic view of a rounded component during a resting state, in accordance with an exemplary embodiment.
Figure 24:
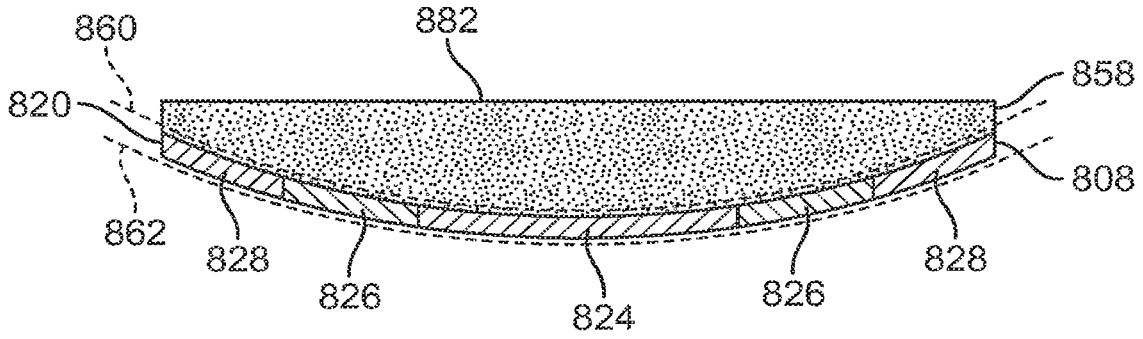
FIG. 24 is a schematic view of a heel portion of the rounded component of FIG. 23 during the resting state, in accordance with an exemplary embodiment.

In those embodiments where a rounded component is used, a rounded component may be formed of any suitable portions of a sole structure. In some embodiments, a rounded component may include portions of a midsole and of an outsole. Referring to FIGS. 23-24, rounded component 821 may include rounded outsole member 820 of outsole 808 and rounded structure 882 of midsole 858. In the example, rounded component 821 may include a rounded outsole member and a rounded structure (not shown). In other embodiments, a rounded component may be formed of other portions of sole structure.

In those instances where a midsole is used, it should be understood that midsole 858 may be substantially similar to midsole 106 and/or midsole 158. For example, midsole 858 and midsole 106 may have a same shape. In another example, midsole 858 and midsole 106 may be formed of a same material.

In those instances where an outsole is used, outsole 808 may be substantially similar to outsole 108. In other embodiments, the outsole 808 may be different than the outsole 108.

In those instances where a rounded component is formed of a portion of a rounded outsole member, the rounded outsole member may include any suitable number of pieces. In some embodiments, the rounded outsole member may include two or more pieces. Referring to FIG. 23, rounded outsole member 820 of rounded component 821 may include rounded piece 824, rounded piece 826, and rounded piece 828. In the example, rounded outsole member 810 of rounded component 811 may include rounded piece 812 and rounded piece 814. In other embodiments, rounded outsole member 810 of rounded component 811 may have a different number of pieces than rounded outsole member 820 of rounded component 821. Similarly, in other embodiments, rounded member 810 may have two pieces, or more than three pieces. Further, in some embodiments, rounded outsole member 820 may have two pieces, or more than three pieces.

In some embodiments, each piece of the outsole may extend along a contour of the midsole. Referring to FIG. 24, rounded structure 882 of midsole 858 may have rounded midsole contour 860. In the example, rounded piece 824 may extend along rounded midsole contour 860. Similarly, rounded piece 826 may extend along rounded midsole contour 860. Further, in the example, rounded piece 828 may extend along the rounded midsole contour 860. In this manner, a substantial portion of rounded structure 882 of midsole 858 may be directly contacting rounded outsole member 820 of outsole 808. As used herein, a substantially portion is directly contacted when more than eighty percent of a total exposed surface area is directly contacted.

In some embodiments, the rounded outsole member may have an outer contour substantially corresponding with a contour of the protrusion structure of the midsole. Referring to FIG. 24, rounded outsole member 820 of outsole 808 may have rounded outsole contour 862. In the example, rounded outsole contour 862 may substantially correspond with rounded midsole contour 860. As used herein, contours substantially correspond when a first distance between the contours at one point has a difference of less than ten percent of a second distance between the contours at another point. In other embodiments, the rounded outsole member may have an outer contour that is different from a contour of the protrusion structure of the midsole.

Figure 25:
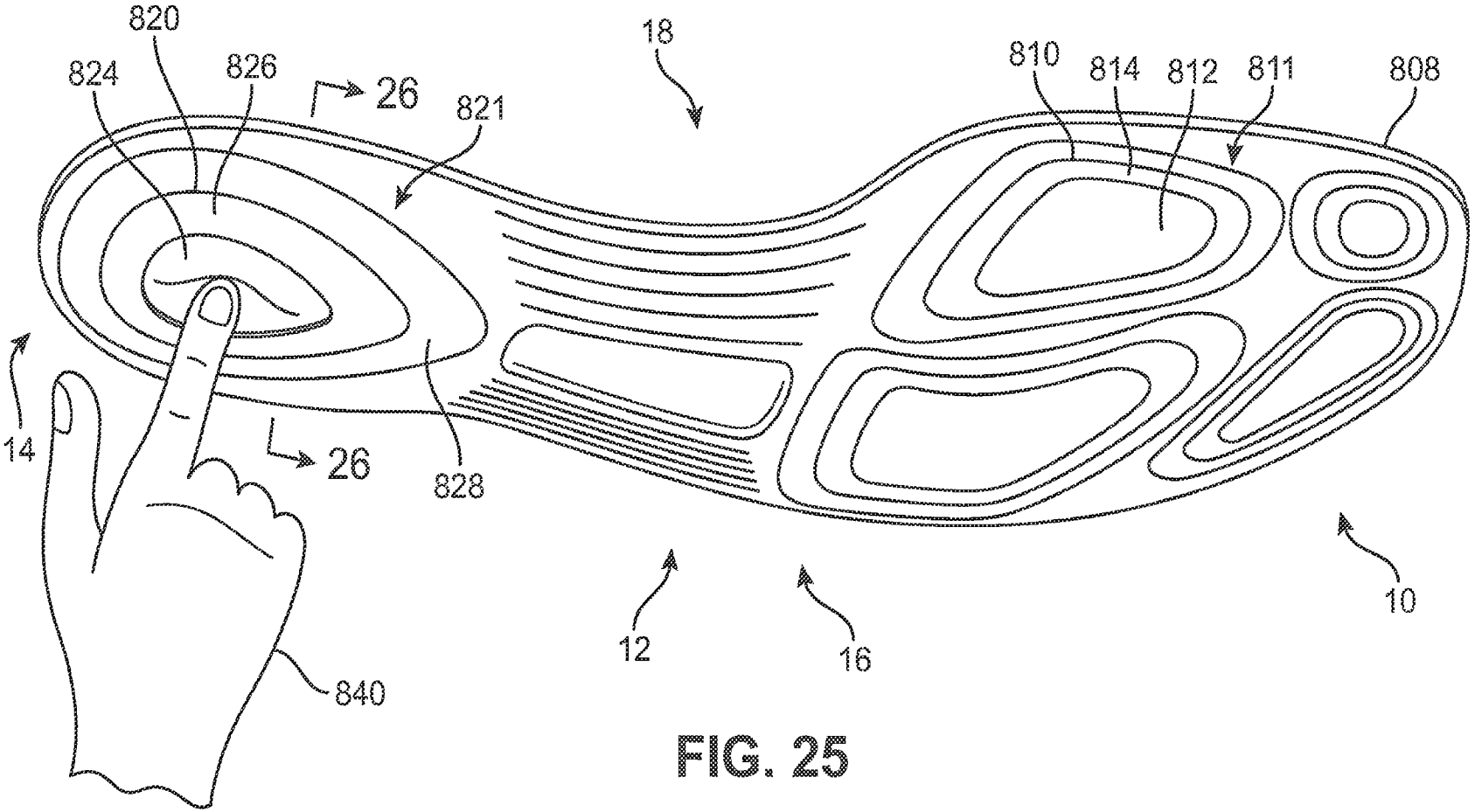
FIG. 25 is a schematic view of a rounded component during a compressed state, in accordance with an exemplary embodiment.
Figure 26:
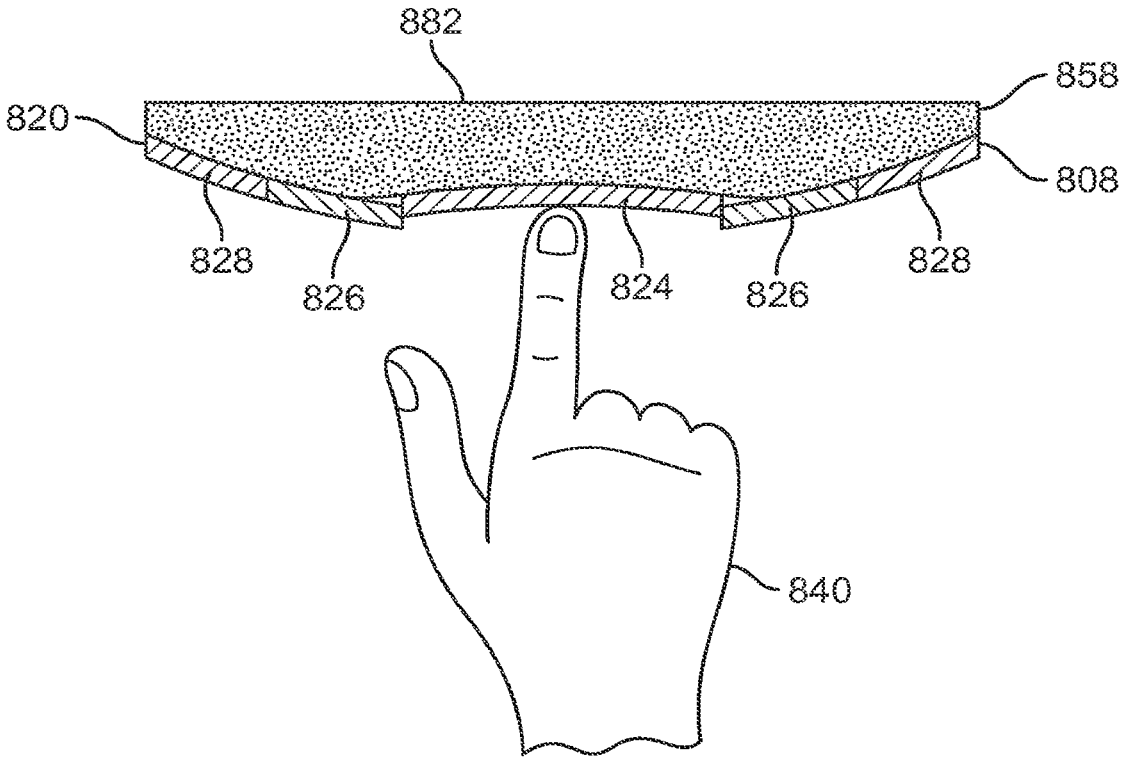
FIG. 26 is a schematic view of a heel portion of the rounded component of FIG. 25 during the compressed state, in accordance with an exemplary embodiment.

In order to allow an improved feel to a user's foot, each piece of the rounded outsole member may move independently from other pieces of the rounded outsole member. Referring to FIGS. 25 and 26, force 840 may be applied to rounded piece 824. In the example, rounded piece 824 may be moved inward by force 840 to a compressed state while rounded piece 826 and rounded piece 828 may remain in a resting state. In this manner, each piece of the rounded outsole member may transition independently between the resting state and the compressed state, thereby allowing for an improved feel of a resulting article of footwear.

It should be understood that any of the pieces of the rounded outsole member may move independently from the other pieces of the outsole. For example, a force may be applied to rounded piece 826. In the example, rounded piece 826 may be moved inward by the force to a compressed state while rounded piece 824 and rounded piece 828 may remain in a resting state (not shown). In another example, a force may be applied to rounded piece 828. In the example, rounded piece 828 may be moved inward by the force to a compressed state while rounded piece 824 and rounded piece 826 may remain in a resting state (not shown).

Figure 27:
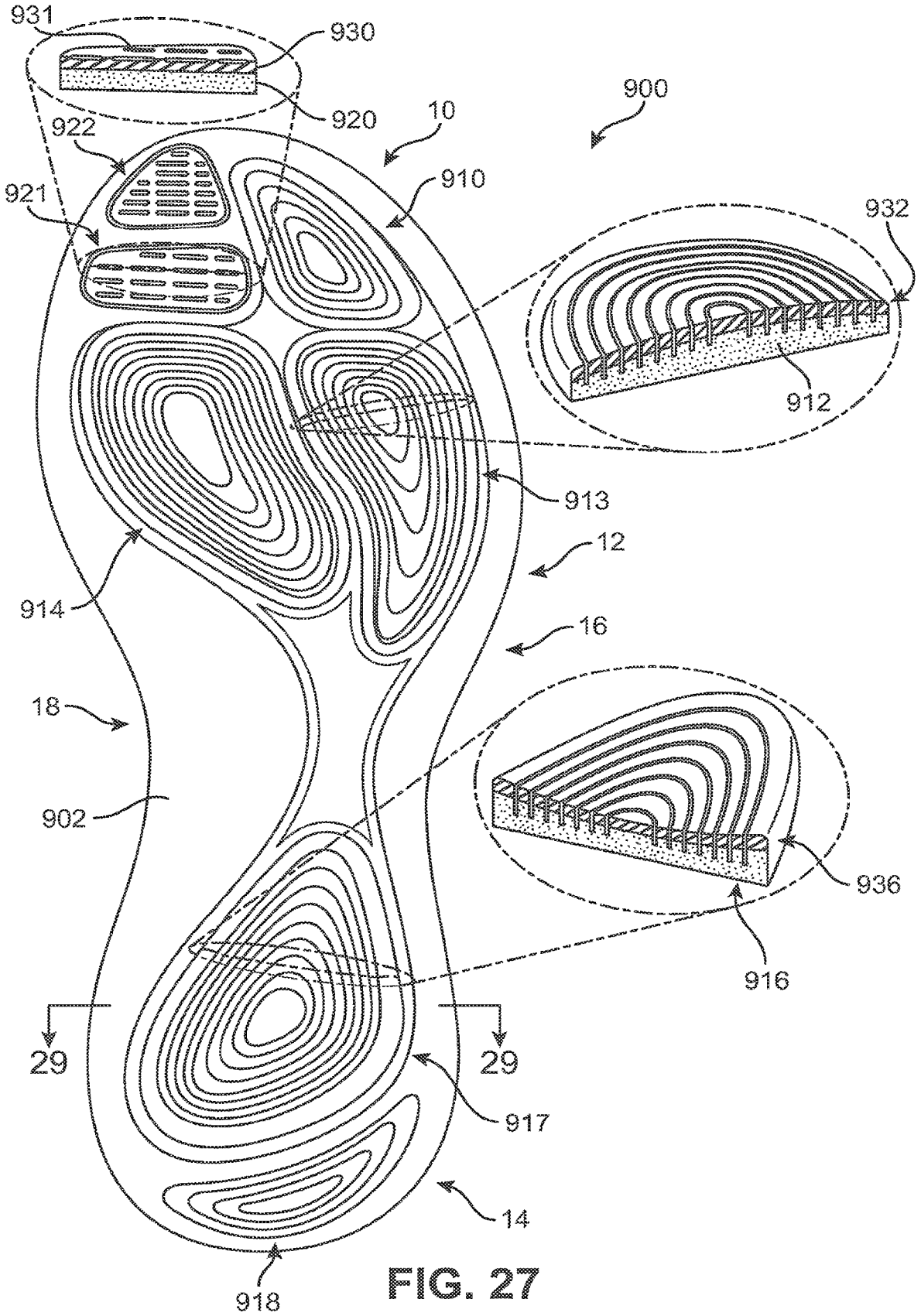
FIG. 27 is a schematic view of a midsole having a tactile component, in accordance with an exemplary embodiment.

Some embodiments can include provisions that permit use of different components of a midsole to facilitate an improved feel of an article of footwear to a user's foot. In some embodiments, such components may include a telescoping component (see FIG. 1). In various embodiments, such components may include a rounded component (see FIG. 23). In some embodiments, such components may include a tactile component, which is further characterized below. Referring to FIG. 27, article 900 may include toe box component 910. In some embodiments, a component may be a flat traction pad. Referring to FIG. 27, article 900 may include flat traction component 921 having a flat surface. In some embodiments, a component may be a cleat (not shown). In some embodiments, a component may be a spike (not shown). In other embodiments, components may be different.

As discussed in further detail below, the embodiments may incorporate tactile components which are further comprised of a tactile structure in the midsole and a tactile outsole member disposed over the tactile structure. The enlarged views of the tactile structures (e.g., fifth metatarsal head structure 912) may include sipes or grooves that divide the structure into a plurality of distinct tactile surfaces. Further, the tactile outsole members (e.g., fifth metatarsal head outsole member 932) are comprised of distinct tactile pieces separated by sipes (or grooves).

Some embodiments may include provisions that permit disposing a component (e.g., a tactile component) in different positions of a longitudinal direction of an article of footwear to improve a feel of an article of footwear on a user's foot. In some embodiments, a component may be disposed in a forefoot component of an article of footwear. Referring to FIG. 27, toe box component 910 may be disposed in forefoot portion 10. In some embodiments, a component may be disposed in a heel component of an article of footwear. Referring to FIG. 27, heel component 917 may be disposed in heel portion 14. In another example, heel strike component 918 may be disposed in heel portion 14. In some embodiments, a component may be disposed in other components of an article of footwear. For example, a midfoot component (not shown) may be disposed in midfoot portion 12. In other embodiments, other components may be disposed on other positions of the longitudinal direction of the article of footwear.

Some embodiments may include provisions that permit disposing a component in different positions of a lateral direction of an article of footwear to improve a feel of an article of footwear on a user's foot. In some embodiments, a component may be disposed on a lateral side of an article of footwear. Referring to FIG. 27, fifth metatarsal head component 913 may be disposed in the forefoot portion 10 and on the lateral side 16. In other embodiments, a component may be disposed on the medial side of a forefoot portion of the article of footwear. Referring to FIG. 27, first metatarsal head component 914 may be disposed in the forefoot portion 10 and on the medial side 18. In other embodiments, other components may be disposed on other positions of the lateral direction of the article of footwear.

Some embodiments may include provisions that permit components to have different shapes. In some cases, components may have a circular shape. Referring to FIG. 27, heel strike component 918 may have a semi-circle shape. In some embodiments, components may have a teardrop shape. Referring to FIG. 27, fifth metatarsal head component 913 may have an elongated teardrop shape. In another example, first metatarsal head component 914 may have a shortened teardrop shape. In some embodiments, components may have a triangular shape. Referring to FIG. 27, heel component 917 may have a triangular shape with rounded corners. In other embodiments, components may have different shapes.

Some embodiments may include provisions that permit components to have different sizes. In some embodiments, components may have a large size, which is further defined below. In various embodiments, components may have a small size, which is further defined below. In other embodiments, components may have other sizes.

In those instances where a component may have a large size, various dimensions of a component may be used. In some embodiments, a component is large when the component is disposed on a substantial width of portion of an article of footwear. As used herein, a component may extend over a substantial width of a portion when it extends over at least fifty percent of a width of the portion. Alternatively, a component may extend over a substantial width of a portion when it extends over at least seventy-five percent of a width of the surface. Referring to FIG. 27, heel component 917 may have a large size since it extends over a substantial width of the heel portion 14.

In some embodiments, a component is large when the component is disposed on a substantial surface area of a portion of an article of footwear. As used herein, a component may extend over a substantial surface area of a portion when it extends over at least fifty percent of a width of the portion. Alternatively, a component may extend over a substantial surface area of a portion when it extends over at least seventy-five percent of a surface area of the surface. Referring to FIG. 27, heel component 917 may have a large size since it extends over a substantial surface area of the heel portion 14.

In some embodiments, a component is small when the component is disposed on less than half of a width of a portion of an article of footwear. Referring to FIG. 27, toe box component 910 may have a small size since it is disposed on less than half of a width of the forefoot portion 10. In some embodiments, a component is small when the component is disposed on less than twenty-five percent of a width of forefoot portion 10 (not shown).

In some embodiments, a component is small when the component is disposed on less than half of a surface area of a portion of an article of footwear. Referring to FIG. 27, toe box component 910 may have a small size since it is disposed on less than half of a surface area of the forefoot portion 10. In the example, heel strike component 918 may have a small size since it is disposed on less than half of a surface area of the heel portion 14. In some embodiments, a component is small when the component is disposed on less than twenty-five percent of a surface area of a portion of an article of footwear. Referring to FIG. 27, heel strike component 918 may have a small size since it is disposed on less than twenty-five percent of a surface area of the heel portion 14.

In some embodiments, a component may include portions of a midsole and of an outsole. Referring to FIG. 27, flat traction component 921 may include a flat traction structure 920 and a flat outsole member 930. In other embodiments, a component may be formed of other portions of a sole structure.

In some embodiments components may have different numbers of surfaces. In some cases, a component may have a single surface. Referring to FIG. 27, flat traction structure 920 of flat traction component 921 may be a single surface. In some embodiments, a component may have multiple disjoint or separated surfaces. Referring to FIG. 27, heel strike component 918 may have four surfaces. In the example, heel structure 916 of heel component 917 may have eight surfaces. Additionally, fifth metatarsal head structure 912 of fifth metatarsal head component 913 may have nine surfaces. In other embodiments, components may have other numbers of surfaces.

In some embodiments, components may have different surface geometries. Exemplary geometries include flat surfaces or surfaces that deviate from a flat surface. In some embodiments, a surface geometry may include one or more grooves or ridges to improve a traction with a playing surface. Referring to FIG. 27, flat traction component 921 may include grooves. In other embodiments, a component may have a smooth surface geometry (not shown).

Some embodiments may include provisions that permit components to have surfaces having different surface profiles, also referred to simply as profiles. As used herein, the surface profile of a component indicates the general overall curvature of the component. In some embodiments, components of a midsole may have a substantially planar surface profile (or simply planar profile). As used herein, a surface may be substantially planar when a surface deviates from planar by less than five degrees. In other embodiments, components of a midsole may have a non-planar surface profile.

In those instances where a component has a non-planar profile, the non-planar profile may extend outward to form any suitable profile. In some embodiments, a component may have a convex profile. As used herein, a convex profile may refer to a surface profile that deviates from planar by greater than five degrees and has a convex shape. Referring to FIG. 27, fifth metatarsal head component 913 may have a convex profile. In the example, toe box component 910, first metatarsal head component 914, and heel strike component 918 may each have convex profiles. In some embodiments, a component may have a concave profile. As used herein, a concave profile may refer to a profile that deviates from planar by greater than five degrees and has a concave shape. Referring to FIG. 27, heel component 917 may have a concave profile. In other embodiments, a component may have a non-planar profile having a combination of convex and/or concave portions.

In those instances where a component may have a non-planar profile, a steepness of a profile may be varied. In some embodiments, a component may have a steep profile. As used herein a profile may be steep if it forms an angle with a ground engaging surface of greater than twenty degrees. Referring to FIG. 27, heel component 917 may have a steep profile. In the example, fifth metatarsal head component 913 may have a steep profile. In some embodiments, a component may have a shallow profile. As used herein a profile may be shallow if it forms an angle with a ground engaging surface of less than twenty degrees. Referring to FIG. 27, flat traction component 921 may have a shallow profile. In other embodiments, non-planar profiles may have a different steepness.

Some embodiments can include provisions that permit a component to include an outsole member. In some cases, the outsole member may form a substantial exposed portion of the component. As used herein, an outsole member substantially forms an exposed portion of a component if the outsole member is at least seventy-five percent of a total exposed area of the component. In some cases, the outsole member covers a small portion of an exposed portion of the component (not shown). In other cases, an outsole member may be omitted.

In those instances where an outsole member is used, different components may have outsole members having different thicknesses. As used herein, a first outsole member attached to a first component and a second outsole member attached to a second component may have different thicknesses when a difference between the first outsole member and the second outsole member is at least twenty percent of the thickness of the first outsole member. In some embodiments, different outsole members having substantially similar thicknesses may be attached to different components of an article of footwear. As used herein, a first outsole member attached to a first component and a second outsole member attached to a second component may have substantially similar thicknesses when a difference between the first outsole member and the second outsole member is less than twenty percent of the thickness of the first outsole member.

In those instances where an outsole member is used, different components may have outsole members being formed of different materials. Referring to FIG. 27, heel outsole member 936 of heel component 917 and flat outsole member 930 of flat traction component 921 may be formed of different materials. In some embodiments, outsole members being formed of similar materials may be attached to components of an article of footwear. Referring to FIG. 27, heel outsole member 936 of heel component 917 and fifth metatarsal head outsole member 932 of fifth metatarsal head component 913 may be formed of a similar material.

Some embodiments can include provisions that permit a component to be a tactile component to improve a feel of an article of footwear. In other embodiments, a tactile component may be omitted.

In those embodiments where a sole structure includes a tactile component, a tactile component may be formed of any suitable portions of a sole structure. In some embodiments, a tactile component may include portions of a midsole. In some embodiments, a tactile component may include a tactile structure that is formed as part of the midsole. Referring to FIG. 27, heel component 917 may include heel structure 916 which is part of midsole 902 of article 900. In the example, fifth metatarsal head component 913 may include fifth metatarsal head structure 912 which is part of midsole 902 of article 900. In other embodiments, a tactile component may be formed of other portions of sole structure.

Figure 28:
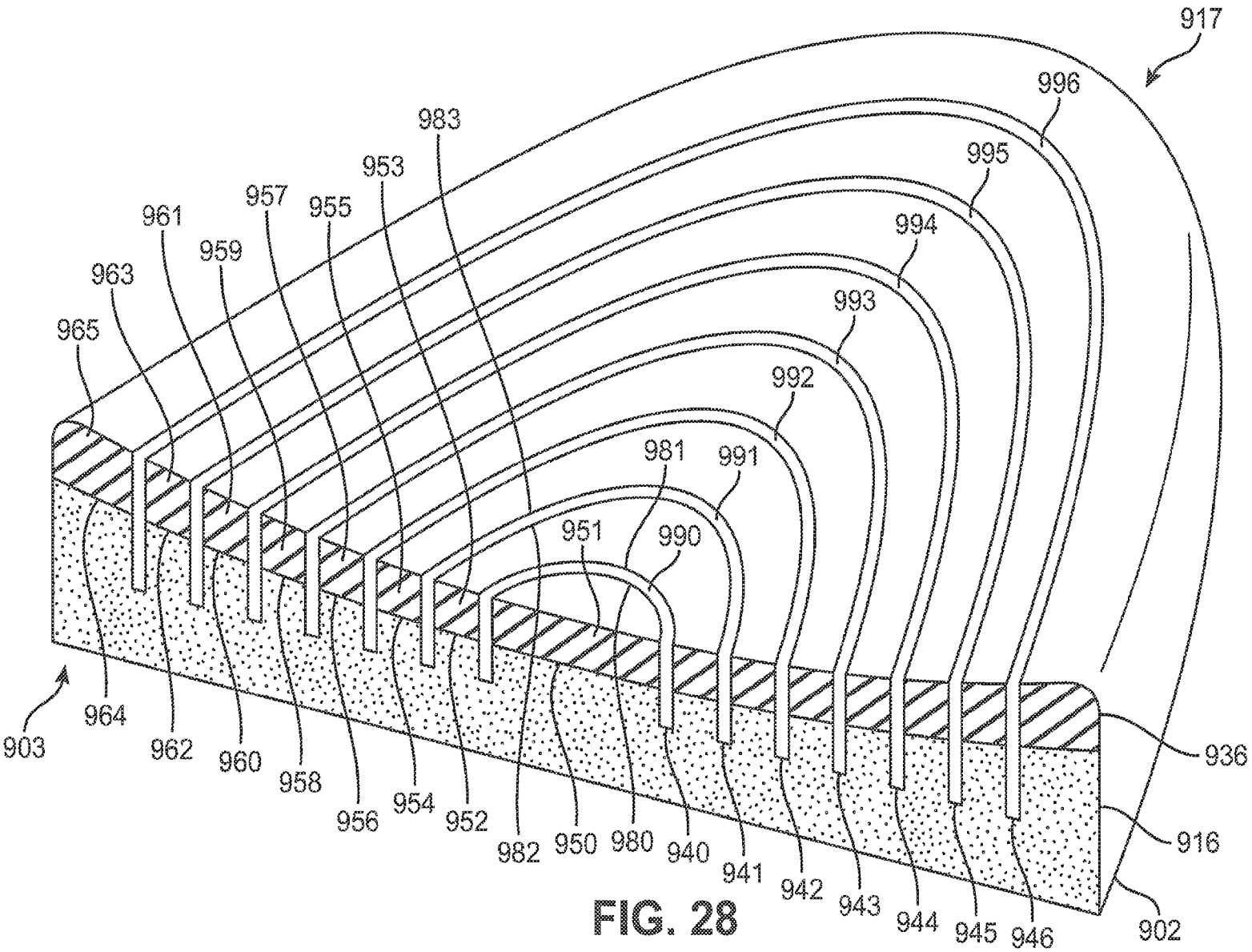
FIG. 28 is a schematic view of a tactile component of FIG. 27, in accordance with an exemplary embodiment.
Figure 29:
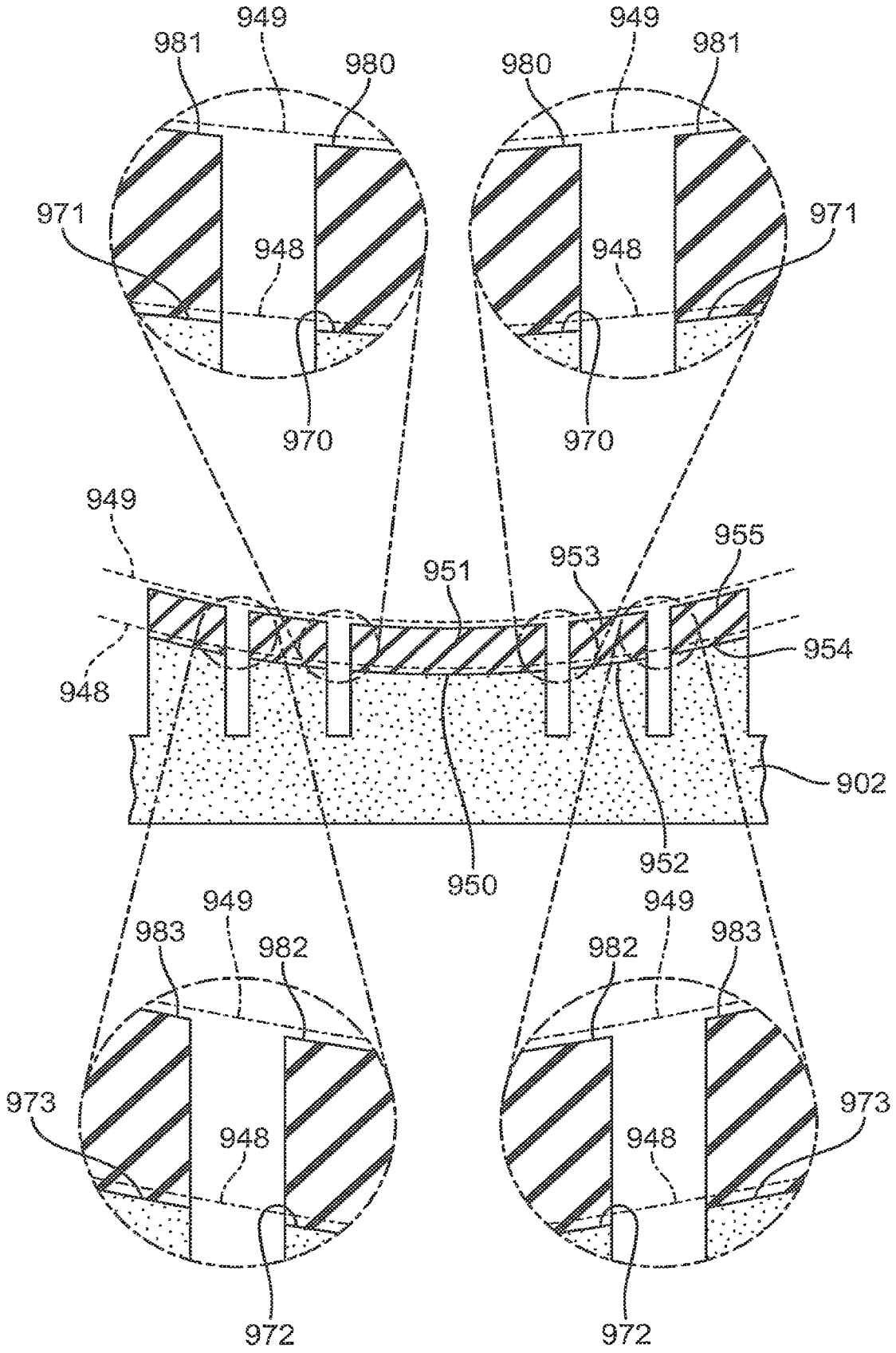
FIG. 29 is a schematic view of a tactile surface of the tactile component of FIG. 28, in accordance with an exemplary embodiment.

In those instances where a tactile component includes a tactile structure, the tactile structure may include any suitable number of tactile surfaces. In some embodiments, a tactile structure includes two or more surfaces. Referring to FIGS. 28-29, a midsole contour 948 may be formed by first tactile surface 950, second tactile surface 952, third tactile surface 954, fourth tactile surface 956, fifth tactile surface 958, sixth tactile surface 960, seventh tactile surface 962, and eighth tactile surface 964. In other embodiments, a tactile component may have other contours. As discussed further detail below, these surfaces may be separated by sipes or grooves formed in the midsole at the tactile structure.

In those instances where a tactile structure includes two or more tactile surfaces, the tactile surfaces may be disposed in any suitable configuration. In some embodiments, a tactile structure may have a set of tactile surfaces being concentrically arranged. In other embodiments, a tactile component may be arranged differently.

In those instances where a tactile component has a set of tactile surfaces being concentrically arranged, the tactile surfaces may be arranged in any suitable manner to facilitate a natural feel on a user's foot. In some embodiments, an outer tactile surface may surround an inner tactile surface. Referring to FIG. 28, second tactile surface 952 may surround first tactile surface 950. In the example, third tactile surface 954 may surround second tactile surface 952. Further, fourth tactile surface 956 may surround third tactile surface 954. Fifth tactile surface 958 may surround fourth tactile surface 956. Sixth tactile surface 960 may fifth tactile surface 958. Seventh tactile surface 962 may surround sixth tactile surface 960. Eighth tactile surface 964 may surround seventh tactile surface 962. In other embodiments, tactile surfaces of a tactile component may be arranged differently.

In some embodiments, the tactile structure may be concave, as described further below. In some embodiments, the tactile structure may be convex. In such cases, the surfaces further from a center could be disposed closer to inner surface 903 of midsole 902 than surfaces that are more central. In other embodiments, the tactile structure may have a combination of convex and/or concave portions.

In those instances where a tactile structure is concave, surfaces of the tactile component may be arranged with any suitable profile. In some embodiments, the surfaces central to the tactile structure could be disposed closer to inner surface 903 of midsole 902 than surfaces that are further from the center. Referring to FIG. 28, second tactile surface 952 may extend outward from inner surface 903 of midsole 902 more than first tactile surface 950. In the example, third tactile surface 954 may extend outward from inner surface 903 of midsole 902 more than second tactile surface 952. Further, fourth tactile surface 956 may extend outward from inner surface 903 of midsole 902 more than third tactile surface 954. Fifth tactile surface 958 may extend outward from inner surface 903 of midsole 902 more than fourth tactile surface 956. Sixth tactile surface 960 may extend outward from inner surface 903 of midsole 902 more than fifth tactile surface 958. Seventh tactile surface 962 may extend outward from inner surface 903 of midsole 902 more than sixth tactile surface 960. Eighth tactile surface 964 may extend outward from inner surface 903 of midsole 902 more than seventh tactile surface 962. In other embodiments, surfaces of a component may be arranged differently.

Some embodiments can include provisions that permit a tactile structure to have a natural feel on a user's foot. In some embodiments, adjacent tactile surfaces of a tactile structure of a tactile component may have substantially similar shapes in the planar directions (i.e., longitudinal and lateral directions). Referring to FIG. 28, first tactile surface 950 and second tactile surface 952 may have substantially similar shapes. In other embodiments, adjacent tactile surfaces of a tactile structure may have different shapes.

As seen in FIGS. 28-29, the tactile surfaces of each tactile structure may together form a smooth contour in order to provide a natural feel for a user, even though the surfaces may be separated by one or more sipes or gaps. In particular, the tactile surfaces may be aligned with a single smooth contour with constant or slowly varying curvature. For example, as shown in FIG. 29, first tactile surface 950, second tactile surface 952 and third tactile surface 954 form a smooth contour 948 (i.e., these surfaces are aligned with contour 948). Although not shown in FIG. 29, the remaining tactile surfaces of midsole 902 may likewise be aligned with, or form part of, contour 948, so as to present a smooth outer surface for midsole 902 at heel component 917.

In some embodiments, peripheral edges of adjacent tactile surfaces may be arranged so as to form a near continuous surface for a tactile structure. Referring to FIG. 29, outer peripheral portion 970 of first tactile surface 950 may be substantially aligned with contour 948 of the heel structure 916 of heel component 917. In the example, inner peripheral portion 971 of second tactile surface 952 may be substantially aligned with contour 948 of the heel structure 916 of heel component 917. In the example, outer peripheral portion 972 of second tactile surface 952 may be substantially aligned with contour 948 of the heel structure 916 of heel component 917. In the example, inner peripheral portion 973 of third tactile surface 954 may be substantially aligned with contour 948 of the heel structure 916 of heel component 917. In other embodiments, peripheral edges of adjacent tactile surfaces may be arranged differently.

In some embodiments, a tactile component includes a tactile outsole member that is attached to a tactile structure of a midsole. In some cases, the tactile outsole member substantially covers an outer portion of the tactile component. As used herein, a tactile outsole member substantially covers an outer portion of a tactile component if it covers at least seventy-five percent of the tactile component. In some embodiments, the tactile outsole member covers a smaller part of the outer portion of the tactile member. In other embodiments, a tactile outsole member may be omitted.

In some embodiments a tactile outsole member may be configured with a similar contour to the contour formed by the underlying tactile structure of the midsole. In some embodiments, a contour of a tactile structure may be substantially similar to a contour of a tactile outsole member. Referring to FIG. 29, outsole contour 949 may be substantially similar to midsole contour 948. In other embodiments, a contour of a midsole may be different to a contour of an outsole (not shown).

Some embodiments can include provisions that permit a tactile outsole member to have a set of tactile pieces being concentrically arranged. In some embodiments, an outer tactile piece may surround an inner tactile piece. Referring to FIG. 28, second tactile piece 953 may surround first tactile piece 951. In the example, third tactile piece 955 may surround second tactile piece 953. Further, fourth tactile piece 957 may surround third tactile piece 955. Fifth tactile piece 959 may surround fourth tactile piece 957. Sixth tactile piece 961 may fifth tactile piece 959. Seventh tactile piece 963 may surround sixth tactile piece 961. Eighth tactile piece 965 may surround seventh tactile piece 963. In other embodiments, pieces of a tactile outsole member may be arranged differently.

In those instances where a tactile outsole member is used, tactile pieces of the tactile outsole member may extend outward from a surface of a midsole. In some embodiments, the tactile outsole member may be concave, as described further below. In some embodiments, the tactile outsole member may be convex. In such cases, the pieces further from a center could be disposed closer to inner surface 903 of midsole 902 than pieces that are more central. In other embodiments, the tactile outsole member may have a combination of convex and/or concave portions.

In those instances where a tactile outsole member is concave, tactile pieces of the tactile outsole member may be arranged with any suitable profile. In some embodiments, the pieces central to the tactile outsole member could be disposed closer to inner surface 903 of midsole 902 than pieces that are further from the center. Referring to FIG. 28, second tactile piece 953 may extend outward from inner surface 903 of midsole 902 more than first tactile piece 951. In the example, third tactile piece 955 may extend outward from inner surface 903 of midsole 902 more than second tactile piece 953. Further, fourth tactile piece 957 may extend outward from inner surface 903 of midsole 902 more than third tactile piece 955. Fifth tactile piece 959 may extend outward from inner surface 903 of midsole 902 more than fourth tactile piece 957. Sixth tactile piece 961 may extend outward from inner surface 903 of midsole 902 more than fifth tactile piece 959. Seventh tactile piece 963 may extend outward from inner surface 903 of midsole 902 more than sixth tactile piece 961. Eighth tactile piece 965 may extend outward from inner surface 903 of midsole 902 more than seventh tactile piece 963. In other embodiments, pieces of a tactile outsole member may be arranged differently.

Some embodiments can include provisions that permit a tactile outsole member to have a natural feel on a user's foot. In some embodiments, adjacent tactile pieces of a tactile outsole member may have substantially similar shapes in the planar directions (i.e., longitudinal and lateral directions). Referring to FIG. 28, first tactile piece 951 and second tactile piece 953 may have substantially similar shapes. In other embodiments, adjacent tactile pieces of a tactile outsole member may have different shapes.

As seen in FIGS. 28-29, the tactile pieces of each tactile outsole member may together form a smooth contour in order to provide a natural feel for a user, even though the pieces may be separated by one or more sipes or gaps. In particular, the tactile pieces may be aligned with a single smooth contour with an approximately constant or slowly varying curvature. In some cases, the contour may have some variation in curvature, but may not change from a concave curvature to a convex curvature. For example, as shown in FIG. 29, first tactile piece 951, second tactile piece 953 and third tactile piece 955 form a smooth contour 949 (i.e., these pieces are aligned with contour 949). Although not shown in FIG. 29, the remaining tactile pieces of midsole 902 may likewise be aligned with, or form part of, contour 949, so as to present a smooth outer surface for midsole 902 at heel component 917. Moreover, contour 949 is seen to be concave along the entirety of heel component 917 and does not include any regions of convex curvature.

In some embodiments, peripheral edges of adjacent tactile pieces may be arranged so as to form a near continuous surface for a tactile outsole member. Referring to FIG. 29, outer peripheral portion 980 of first tactile piece 951 may be substantially aligned with contour 949 of the heel outsole member 936 of heel component 917. In the example, inner peripheral portion 981 of second tactile piece 953 may be substantially aligned with contour 949 of the heel outsole member 936 of heel component 917. In the example, outer peripheral portion 982 of second tactile piece 953 may be substantially aligned with contour 949 of heel outsole member 936 of heel component 917. In the example, inner peripheral portion 983 of third tactile piece 955 may be substantially aligned with contour 949 of the heel outsole member 936 of heel component 917. In other embodiments, peripheral edges of adjacent tactile pieces may be arranged differently.

Figure 30:
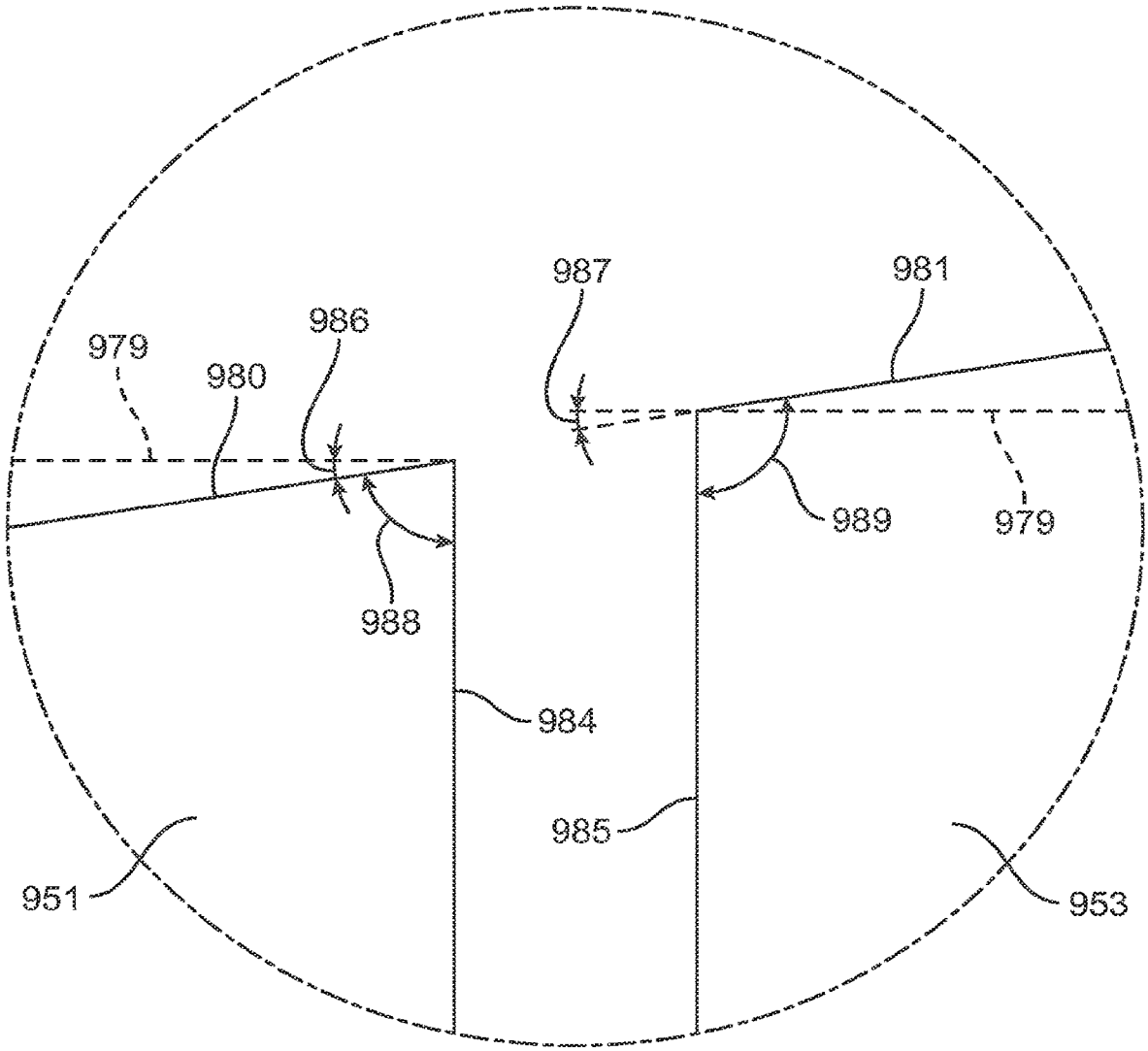
FIG. 30 is a schematic view of adjacent edges of tactile pieces of a tactile outsole member of a tactile component of FIG. 29, in accordance with an exemplary embodiment.

In some embodiments, adjacent edges of tactile pieces of a tactile outsole member may form substantially similar angles with a plane. As used herein, edges may form substantially similar angles with a plane when a difference between an angle formed by a first edge and the plane and an angle formed by a second edge and the plane is less than ten degrees. Referring to FIG. 30, outer peripheral portion 980 of first tactile piece 951 forms angle 986 with plane 979 and inner peripheral portion 981 of second tactile piece 953 forms angle 987 with plane 979. In the example, angle 986 and angle 987 may be substantially similar. In other embodiments, adjacent edges of a tactile outsole member may form different angles.

In those instances where adjacent edges of a tactile outsole member may form substantially similar angles with a plane, any suitable plane may be used. In some embodiments, the plane may be parallel with a surface of the tactile component. Referring to FIGS. 29 and 30, plane 979 may be parallel with first tactile surface 950 of heel structure 916 of heel component 917. In some embodiments, the plane may be parallel with a ground engaging surface of the article of footwear. In other embodiments, the plane may be aligned differently.

In those instances where adjacent edges of a tactile outsole member may form substantially similar angles with a plane, a sidewall of a tactile piece may form any suitable angle with the plane. In some embodiments, a sidewall of a tactile piece may be approximately perpendicular to the plane. As used herein, a sidewall may be approximately perpendicular to a plane, when an angle formed between the sidewall and the plane is between seventy-five degrees and one-hundred-five degrees. Referring to FIG. 30, first sidewall 984 of first tactile piece 951 may be approximately perpendicular to plane 979. In the example, second sidewall 985 of second tactile piece 953 may be approximately perpendicular to plane 979. In other embodiments, a sidewall of a tactile piece may form a different angle with the plane.

In some embodiments, interior angles of adjacent edges of tactile pieces of a tactile outsole member may form a combined angle of approximately one-hundred-eighty degrees. As used herein, interior angles of adjacent edges may form a combined angle of one-hundred-eighty degrees when a combination of an interior angle of one interior edge and an interior angle of another interior edge is between one-hundred-sixty degrees and two-hundred degrees. Referring to FIG. 30, outer peripheral portion 980 of first tactile piece 951 may have interior angle 988 and inner peripheral portion 981 of second tactile piece 953 may have interior angle 989. In the example, interior angle 988 and interior angle 989 may be approximately one-hundred-eighty degrees. In other embodiments, adjacent edges of tactile pieces of a tactile outsole member may have other interior angles.

Some embodiments can include provisions that permit use of a sipe. In some embodiments, a sipe may be used in a tactile component. In some embodiments, a sipe may be used in a telescoping component. In some embodiments, a sipe may be used in a rounded component. In other embodiments, a sipe may be used in other components.

In some embodiments, a sipe may extend through an outsole member of a component. Referring to FIG. 28, sipe 990 extends through heel outsole member 936 of heel component 917. In some embodiments sipe 991 may be representative of other sipes of an article of footwear. For example, sipe 992 may extend through heel outsole member 936 of heel component 917. For example, sipe 992 may extend through heel outsole member 936 of heel component 917. For example, sipe 993 may extend through heel outsole member 936 of heel component 917. For example, sipe 994 may extend through heel outsole member 936 of heel component 917. For example, sipe 995 may extend through heel outsole member 936 of heel component 917. For example, sipe 996 may extend through heel outsole member 936 of heel component 917. In other embodiments, a sipe may extend differently into a component.

In some embodiments, a sipe may expose a portion of a midsole. Referring to FIG. 28, sipe 990 may expose heel structure 916 of heel component 917. In some embodiments, a sipe may be representative of other sipes. For example, sipe 991 may expose heel structure 916 of heel component 917. In the example, sipe 992 may expose heel structure 916 of heel component 917. In the example, sipe 993 may expose heel structure 916 of heel component 917. In the example, sipe 994 may expose heel structure 916 of heel component 917. In the example, sipe 995 may expose heel structure 916 of heel component 917. In the example, sipe 996 may expose heel structure 916 of heel component 917. In other embodiments, sipe may be different.

In some embodiments, a sipe may extend through a portion of a midsole. Referring to FIG. 28, sipe 990 may extend through portion 940 of heel structure 916 of heel component 917. Sipe 991 may extend through portion 941 of heel structure 916 of heel component 917. Sipe 992 may extend through portion 942 of heel structure 916 of heel component 917. Sipe 993 may extend through portion 943 of heel structure 916 of heel component 917. Sipe 994 may extend through portion 944 of heel structure 916 of heel component 917. Sipe 995 may extend through portion 945 of heel structure 916 of heel component 917. Sipe 996 may extend through portion 946 of heel structure 916 of heel component 917. In other embodiments, a sipe may extend through other portions of a midsole.

In some embodiments, a sipe may surround a tactile surface of a tactile component. Referring to FIG. 28, sipe 990 surrounds first tactile surface 950 of heel structure 916 of heel component 917. Sipe 991 surrounds second tactile surface 952 of heel structure 916 of heel component 917. Sipe 992 surrounds third tactile surface 954 of heel structure 916 of heel component 917. Sipe 993 surrounds fourth tactile surface 956 of heel structure 916 of heel component 917. Sipe 994 surrounds fifth tactile surface 958 of heel structure 916 of heel component 917. Sipe 995 surrounds sixth tactile surface 960 of heel structure 916 of heel component 917. Sipe 996 surrounds seventh tactile surface 962 of heel structure 916 of heel component 917. In other embodiments, a sipe may be disposed differently with a surface of a component.

In some embodiments, a sipe may be disposed between tactile surfaces of a tactile component. Referring to FIG. 28, sipe 990 is disposed between first tactile surface 950 and second tactile surface 952. Sipe 991 is deposed between second tactile surface 952 and third tactile surface 954. Sipe 992 is disposed between third tactile surface 954 and fourth tactile surface 956. Sipe 993 is disposed between fourth tactile surface 956 and fifth tactile surface 958. Sipe 994 is disposed between fifth tactile surface 958 and sixth tactile surface 960. Sipe 995 is disposed between sixth tactile surface 960 and seventh tactile surface 962. Sipe 996 is disposed between seventh tactile surface 962 and eighth tactile surface 964. In other embodiments, a sipe may be disposed differently with a tactile surface of a tactile component.

In some embodiments, a sipe and a tactile surface may have substantially similar shapes in a planar direction associated with the longitudinal and lateral directions. Referring to FIG. 28, sipe 990 and first tactile surface 950 may have substantially similar shapes. In the example, sipe 990 and second tactile surface 952 may have substantially similar shapes. In other embodiments, a sipe and a tactile surface may have different shapes.

In some embodiments, a sipe may surround a tactile piece of a tactile outsole member. Referring to FIG. 28, sipe 990 surrounds first tactile piece 951 of heel outsole member 936 of heel component 917. Sipe 991 surrounds second tactile piece 953 of heel outsole member 936 of heel component 917. Sipe 992 surrounds third tactile piece 955 of heel outsole member 936 of heel component 917. Sipe 993 surrounds fourth tactile piece 957 of heel outsole member 936 of heel component 917. Sipe 994 surrounds fifth tactile piece 959 of heel outsole member 936 of heel component 917. Sipe 995 surrounds sixth tactile piece 961 of heel outsole member 936 of heel component 917. Sipe 996 surrounds seventh tactile piece 963 of heel outsole member 936 of heel component 917. In other embodiments, a sipe may be disposed differently with a tactile piece of a tactile outsole member.

In some embodiments, a sipe may be disposed between tactile pieces of a tactile outsole member. Referring to FIG. 28, sipe 990 is disposed between first tactile piece 951 and second tactile piece 953. Sipe 991 is deposed between second tactile piece 953 and third tactile piece 955. Sipe 992 is disposed between third tactile piece 955 and fourth tactile piece 957. Sipe 993 is disposed between fourth tactile piece 957 and fifth tactile piece 959. Sipe 994 is disposed between fifth tactile piece 959 and sixth tactile piece 961. Sipe 995 is disposed between sixth tactile piece 961 and seventh tactile piece 963. Sipe 996 is disposed between seventh tactile piece 963 and eighth tactile piece 965. In other embodiments, a sipe may be disposed differently with a tactile piece of a tactile outsole member.

In some embodiments, a sipe and a tactile piece may have substantially similar shapes. Referring to FIG. 28, sipe 990 and first tactile piece 951 may have substantially similar shapes. In the example, sipe 990 and second tactile piece 953 may have substantially similar shapes. In other embodiments, a sipe and a tactile piece may have different shapes.

Some embodiments can include provisions that permit surfaces of a component to move independently in order to improve a feel of an article of footwear. In some cases, tactile surfaces may independently move using sipes. In some embodiments, telescoping surfaces may independently move using sipes (see FIG. 5). In other embodiments, surfaces may independently move using other suitable methods.

In instances where a sipe is used to permit tactile surfaces of a tactile component to move independently, any suitable sipe may be used. In some embodiments, a sipe may extend through a tactile outsole member. In some embodiments, a sipe may expose a tactile component. In some embodiments, a sipe may extend through a portion of a midsole. In other embodiments, a sipe may be different.

Some embodiments may include provisions to permit tactile surfaces of a tactile component to move independently between any number of states. In some embodiments, tactile surfaces of a tactile component may move independently between three states. In other embodiments, another number of states may be used.

In those instances where tactile surfaces of a tactile component may move independently between three states each state may correspond with a different amount of compression. In some embodiments, a first state may be uncompressed. In some embodiments, a second state may be partially compressed. In some embodiments, a third state may be fully compressed. In other embodiments, the states may correspond with different amounts of compression.

Figure 31:
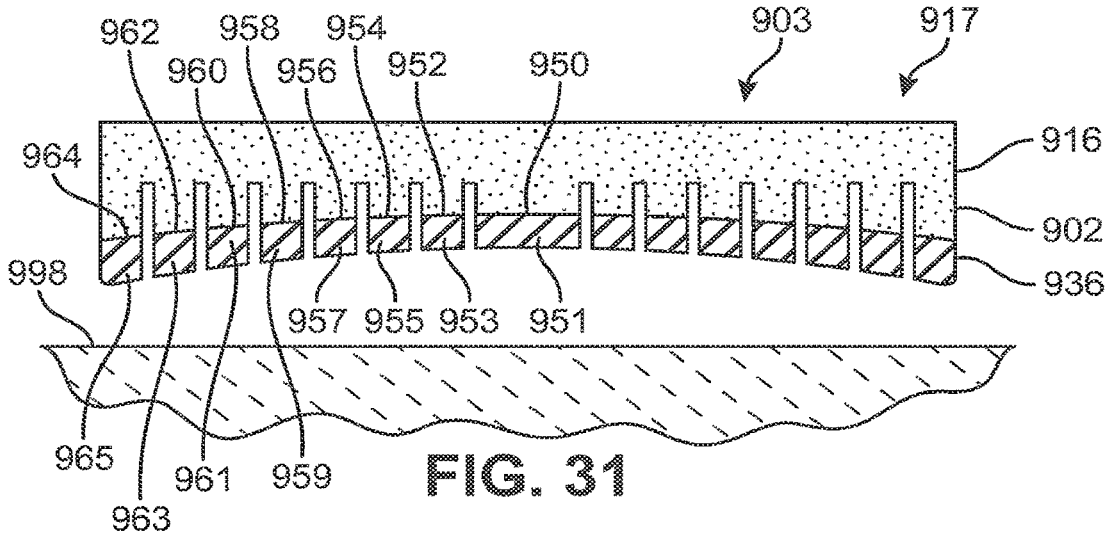
FIG. 31 is a schematic view of a tactile component of FIG. 27 during a resting state, in accordance with an exemplary embodiment.

In those instances where a first state is uncompressed, any configuration of tactile surfaces of a tactile component may be used. In some embodiments, a tactile component may have a concave profile. Referring to FIG. 31, eighth tactile surface 964 extends from inner surface 903 of midsole 902 further than seventh tactile surface 962. Seventh tactile surface 962 extends from inner surface 903 of midsole 902 further than sixth tactile surface 960. Fifth tactile surface 958 extends from inner surface 903 of midsole 902 further than fourth tactile surface 956. Fourth tactile surface 956 extends from inner surface 903 of midsole 902 further than third tactile surface 954. Third tactile surface 954 extends from inner surface 903 of midsole 902 further than second tactile surface 952. Second tactile surface 952 extends from inner surface 903 of midsole 902 further than first tactile surface 950. In other embodiments, a tactile component has a different profile.

Some embodiments may include a tactile outsole member for protecting the tactile component from abrasion. Referring to FIG. 31, heel component 917 may include heel outsole member 936. In other embodiments, an outsole may be omitted.

In those instances where a tactile outsole member is used, the tactile outsole member may have any suitable profile in the first state. In some embodiments, a tactile outsole member may have profile substantially similar to profile of a tactile structure in the first state. Referring to FIG. 31, eighth tactile piece 965 may extend from inner surface 903 of midsole 902 further than seventh tactile piece 963. Seventh tactile piece 963 may extend from inner surface 903 of midsole 902 further than sixth tactile piece 961. Sixth tactile piece 961 may extend from inner surface 903 of midsole 902 further than fifth tactile piece 959. Fifth tactile piece 959 may extend from inner surface 903 of midsole 902 further than fourth tactile piece 957. Fourth tactile piece 957 may extend from inner surface 903 of midsole 902 further than third tactile piece 955. Third tactile piece 955 may extend from inner surface 903 of midsole 902 further than second tactile piece 953. Second tactile piece 953 may extend from inner surface 903 of midsole 902 further than first tactile piece 951. In other embodiments, a tactile outsole member and a tactile structure may have different profiles in the first state.

Figure 32:
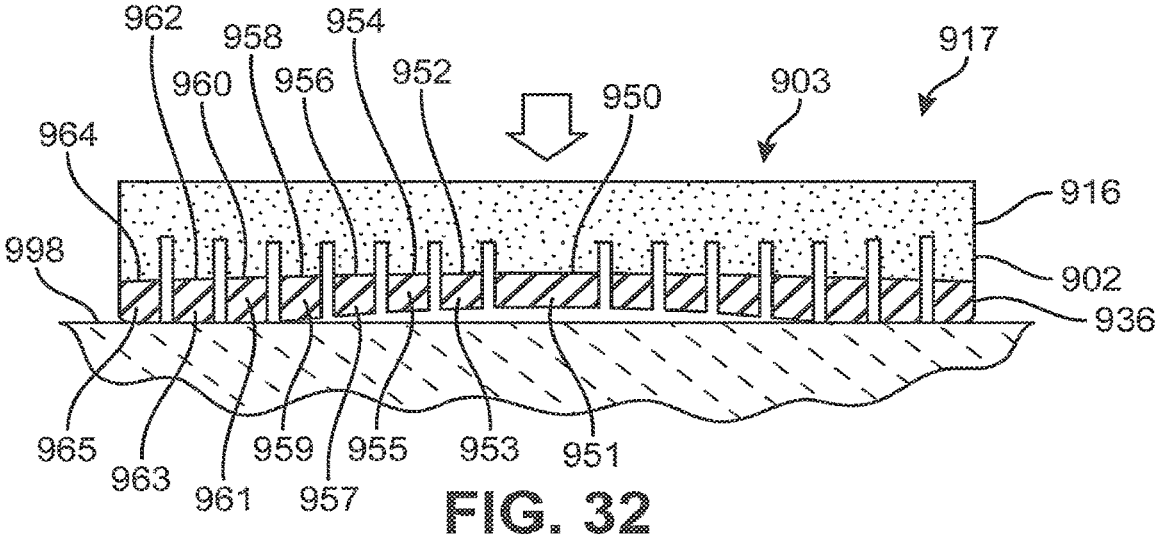
FIG. 32 is a schematic view of the tactile component of FIG. 31 during a partially compressed state, in accordance with an exemplary embodiment.

In those instances where a second state is partially compressed, any suitable configuration of tactile surfaces of a tactile structure may be used. In some embodiments, a tactile structure may have a concave profile during the second state. Referring to FIG. 32, some tactile surfaces of article 900 may contact playing surface 998 and be partially compressed in a second state for heel component 917. In the second state, eighth tactile surface 964, seventh tactile surface 962, and sixth tactile surface 960 may obtain an approximately similar vertical position (i.e., the surfaces are disposed an approximately similar distance from inner midsole surface 903). In contrast, some other surfaces like first tactile surface 950 and second tactile surface 952 may not be displaced and may still be disposed closer to inner midsole surface 903 than seventh tactile surface 962 and/or sixth tactile surface 960.

In those instances where a second state is partially compressed, any suitable configuration of tactile piece of a tactile structure may be used. In some embodiments, a tactile outsole member may have a concave profile during the second state. Referring to FIG. 32, some tactile pieces of article 900 may contact playing surface 998 and be partially compressed in a second state for heel component 917. In the second state, eighth tactile piece 965, seventh tactile piece 963, and sixth tactile piece 961 may obtain an approximately similar vertical position (i.e., the pieces are disposed an approximately similar distance from inner midsole surface 903). In contrast, some other pieces like first tactile piece 951 and second tactile piece 953 may not be displaced and may still be disposed closer to inner midsole surface 903 than seventh tactile piece 963 and/or sixth tactile piece 961.

Figure 33:
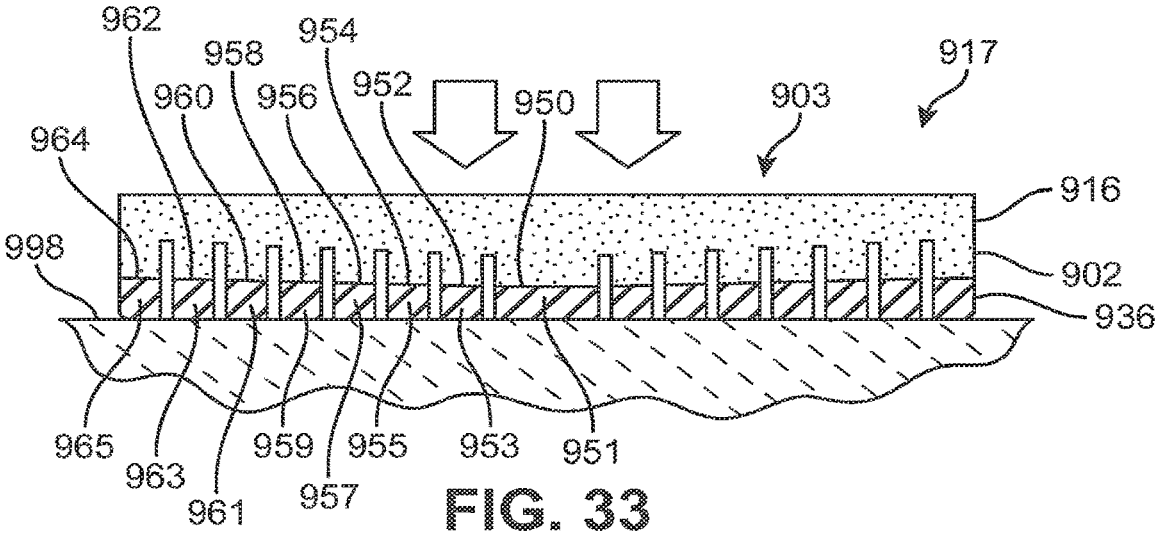
FIG. 33 is a schematic view of the tactile component of FIG. 31 during a fully compressed state, in accordance with an exemplary embodiment.

In those instances where a third state is fully compressed, any configuration of the surfaces of a component may be used. In some embodiments, a tactile component may have a concave profile. Referring to FIG. 33, during the third state article 900 contacts playing surface 998 and the tactile surfaces may all obtain a similar position. Specifically, eighth tactile surface 964 is compressed inward to have a similar vertical position as first tactile surface 950. During the second state seventh tactile surface 962 is compressed inward to the position of first tactile surface 950. During the second state sixth tactile surface 960 is compressed inward to the position of first tactile surface 950. In the example, during the second state fifth tactile surface 958 is compressed inward to the position of first tactile surface 950. During the second state fourth tactile surface 956 is compressed inward to the position of first tactile surface 950. During the second state third tactile surface 954 is compressed inward to the position of first tactile surface 950. During the second state second tactile surface 952 is compressed inward to the position of first tactile surface 950. During the second state first tactile surface 950 is compressed to conform to a profile of playing surface 998.

In those instances where a tactile outsole member is used, the tactile outsole member may have any suitable profile in the third state. In some embodiments, a profile of a tactile outsole member is substantially similar to a profile of a tactile structure in the third state. Referring to FIG. 33, during the third state article 900 contacts playing surface 998 and the tactile surfaces may all obtain a similar position. Specifically, eighth tactile piece 965 is compressed inward to have a similar vertical position as first tactile piece 951. During the second state, seventh tactile piece 963 is compressed inward to the position of first tactile piece 951. During the second state, sixth tactile piece 961 is compressed inward to the position of first tactile piece 951. During the second state, fifth tactile piece 959 is compressed inward to the position of first tactile piece 951. During the second state, fourth tactile piece 957 is compressed inward to the position of first tactile piece 951. During the second state, third tactile piece 955 is compressed inward to the position of first tactile piece 951. During the second state, second tactile piece 953 is compressed inward to the position of first tactile piece 951.

Figure 34:
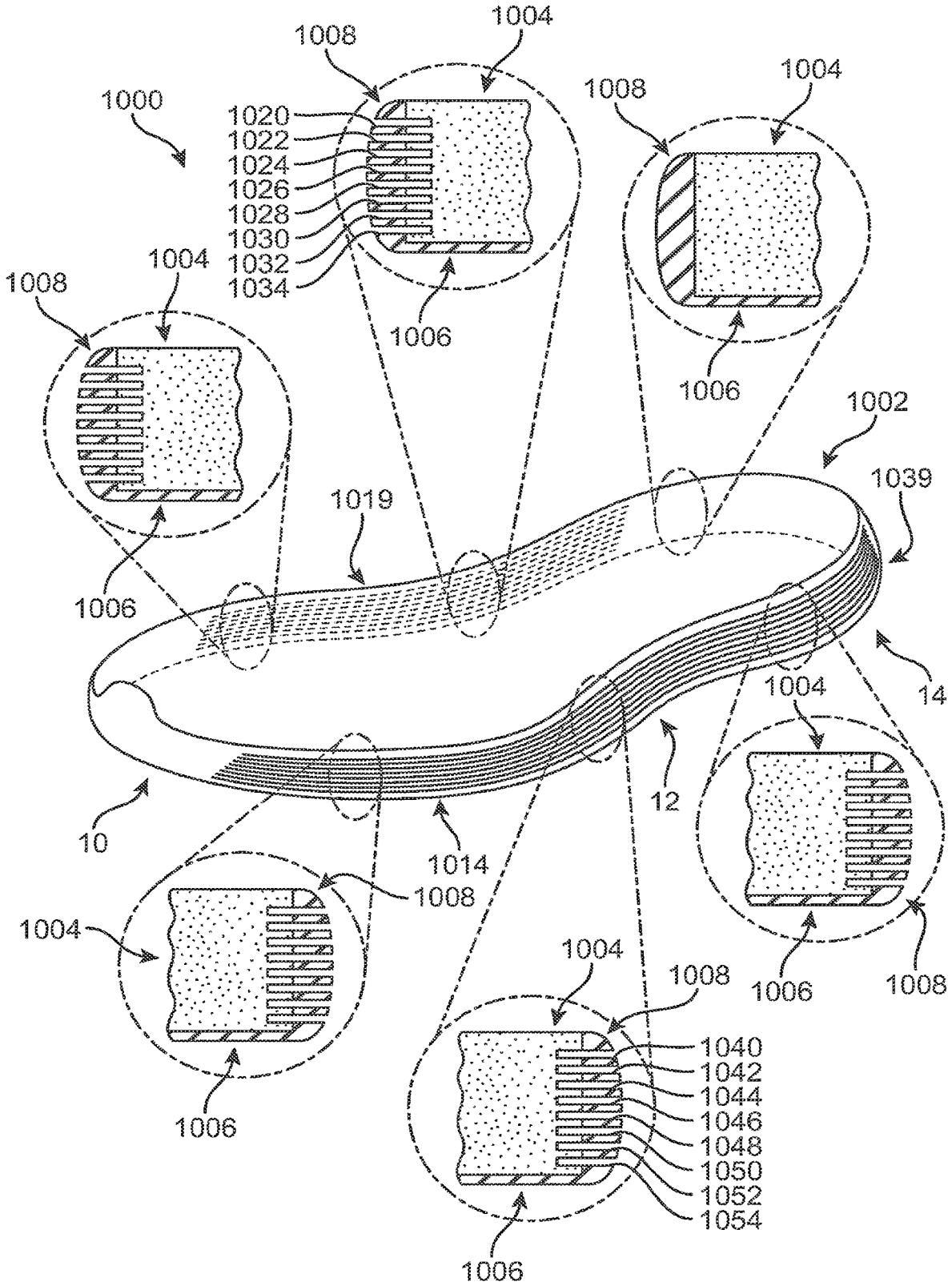
FIG. 34 is a schematic view of a midsole having a sipe, in accordance with an exemplary embodiment.

Some embodiments may include provisions for flexing a midsole itself to improve a feel of the article of footwear on a user's foot. In some cases the structure of a midsole is modified. In some cases, a sipe may be disposed along an outer side surface of a midsole. Referring to FIG. 34, article of footwear 1000 may include sole structure 1002 with midsole 1004 having first sipe 1020 disposed on medial side 18. In other cases, other methods may be used to allow increased flexibility in a midsole.

In those instances where a sipe is used, any suitable type of sipe may be used. In some embodiments, a sipe may extend through a portion of a midsole. Referring to FIG. 34, first sipe 1020 of first set of sipes 1019 may extend into midsole 1004. In other embodiments, a sipe may be different.

In those instances where a sipe is used, a sipe may extend in any suitable direction. In some embodiments, a sipe may extend along a longitudinal direction of an article of footwear. Referring to FIG. 34, first sipe 1020 may extend in the longitudinal direction of article of footwear 1000. In some embodiments, a sipe may extend along a lateral direction of an article of footwear (not shown). In other embodiments, a sipe may extend along other directions.

In those instances where a sipe is used, any type of suitable number of sipes may be used. In some embodiments, a single sipe may be used for flexing a midsole. In other embodiments, multiple sipes are used for flexing a midsole. Referring to FIG. 34, first set of sipes 1019 may include first sipe 1020, second sipe 1022, third sipe 1024, fourth sipe 1026, fifth sipe 1028, sixth sipe 1030, seventh sipe 1032, and eight sipe 1034. Second set of sipes 1039 may include ninth sipe 1040, tenth sipe 1042, eleventh sipe 1044, twelfth sipe 1046, thirteenth sipe 1048, fourteenth sipe 1050, fifteenth sipe 1052, and sixteenth sipe 1054. In other embodiments, other numbers of sipes may be used.

In some embodiments, one or more features of the first sipe may be representative of features of other sipes. Referring to FIG. 34, second sipe 1022 may be disposed on medial side 18. In another example, second sipe 1022 may extend into midsole 1004. In another example, second sipe 1022 may extend along a longitudinal direction. In other embodiments, one or more features of the first sipe and another sipe may be different.

In those instances where a multiple number of sipes are used, the sipes may be disposed on a side of an article of footwear in any suitable arrangement. In some embodiments, the sipes may be stacked along a vertical direction of the article of footwear. Referring to FIG. 34, first sipe 1020 may be disposed vertically above second sipe 1022. Second sipe 1022 may be disposed vertically above third sipe 1024. In the example, second sipe 1022 may be spaced closer to a ground engaging surface 1014 of article of footwear 1000 than first sipe 1020. In other embodiments, the sipes may be arranged differently.

In those instances where a multiple number of sipes are used, the sipes may be disposed on any number of sides of an article of footwear in any suitable arrangement. In some embodiments, a medial side of a midsole may include a sipe and a lateral side of a midsole may include a sipe. Referring to FIG. 34, first sipe 1020 may be disposed on medial side 18 and ninth sipe 1040 may be disposed on lateral side 16. In some embodiments, sipes may be disposed on one side of an article of footwear (not shown). In other embodiments, sipes may be omitted from the sides of a midsole (see FIG. 1).

In some embodiments, a sipe may be disposed in portions of an article of footwear to selectively improve a flexibility of a midsole. In some embodiments, a sipe may extend in a heel portion of an article of footwear. Referring to FIG. 34, ninth sipe 1040 may extend into heel portion 14 of article of footwear 1000. In some embodiments, a sipe may extend into a midfoot portion of an article of footwear. Referring to FIG. 34, ninth sipe 1040 may extend into midfoot portion 12 of article of footwear 1000. In some embodiments, a sipe may extend into a forefoot portion of an article of footwear. Referring to FIG. 34, ninth sipe 1040 may extend into forefoot portion 10 of article of footwear 1000. In other embodiments, a sipe may extend in other portions of an article of footwear.

In some embodiments, a sipe may be spaced apart from a portion of an article of footwear to selectively improve a flexibility of a midsole. In some embodiments, a sipe may be spaced from in a heel portion of an article of footwear. Referring to FIG. 34, first sipe 1020 may be spaced apart from heel portion 14 of article of footwear 1000. In some embodiments, a sipe may be spaced apart from a midfoot portion of an article of footwear (not shown). In some embodiments, a sipe may be spaced apart from a forefoot portion of an article of footwear (not shown). In other embodiments, a sipe may be spaced apart from other portions of an article of footwear.

Some embodiment may include provisions that permit an exposed sidewall to protect an outer side surface of a midsole from abrasion. Referring to FIG. 34, sole structure 1002 may include exposed sidewall 1008. In other embodiments, an exposed sidewall is omitted and the outer side surfaces of a midsole are exposed (not shown).

In those cases where an exposed sidewall is used, the exposed sidewall may be formed of any suitable material. In some cases, exposed sidewalls are made of a material substantially similar to a material of the outsole. Referring to FIG. 34, exposed sidewall 1008 may be formed of a material used to form outsole 1006. In other embodiments, exposed sidewall 1008 and outsole 1006 may be made of different materials.

In those instances where a sipe and sidewall are used, any suitable type of sipe may be used. In some embodiments, a sipe may extend through an exposed sidewall. Referring to FIG. 34, first sipe 1020 may extend though exposed sidewall 1008. In other embodiments, a sipe may be different.

Some embodiments can include provisions that permit a portion of an article of footwear to perform differently than another portion of the article of footwear. In some embodiments, different sides of an article of footwear are configured to perform differently. In other embodiments, other portions of the article of footwear perform differently.

Some embodiments can include provisions that permit a midsole to flex differently on one side than on the other side. In some embodiments, a sipe positioned on one side of an article of footwear may extend to different portions of the article of footwear than a sipe on the other side. Referring to FIG. 34, first sipe 1020 may be disposed on medial side 18 and ninth sipe 1040 may be disposed on lateral side 16. In the example, first sipe 1020 may extend from the forefoot portion 10 to the midfoot portion 12 and first sipe 1020 may be spaced apart from heel portion 14 of article of footwear 1000. In the example, ninth sipe 1040 may extend from forefoot portion 10 through midfoot portion 12 and into heel portion 14. In other embodiments, a sipe positioned on one side of an article of footwear may extend to similar portions of the article of footwear to a sipe on the other side.

Figure 35:
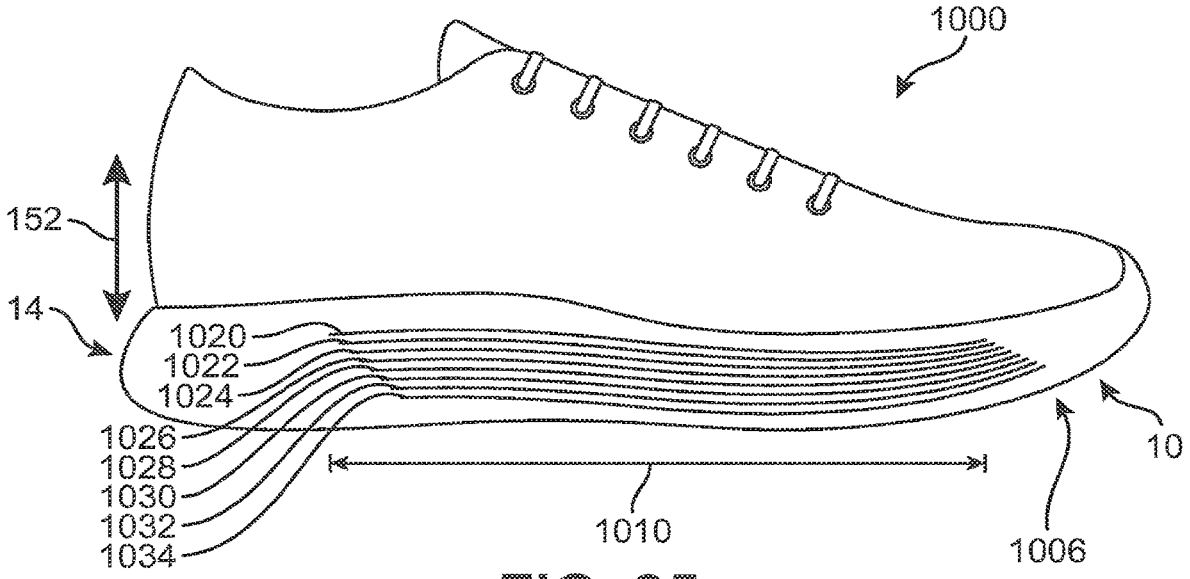
FIG. 35 is a schematic view of a medial side of the midsole of FIG. 34, in accordance with an exemplary embodiment.
Figure 36:
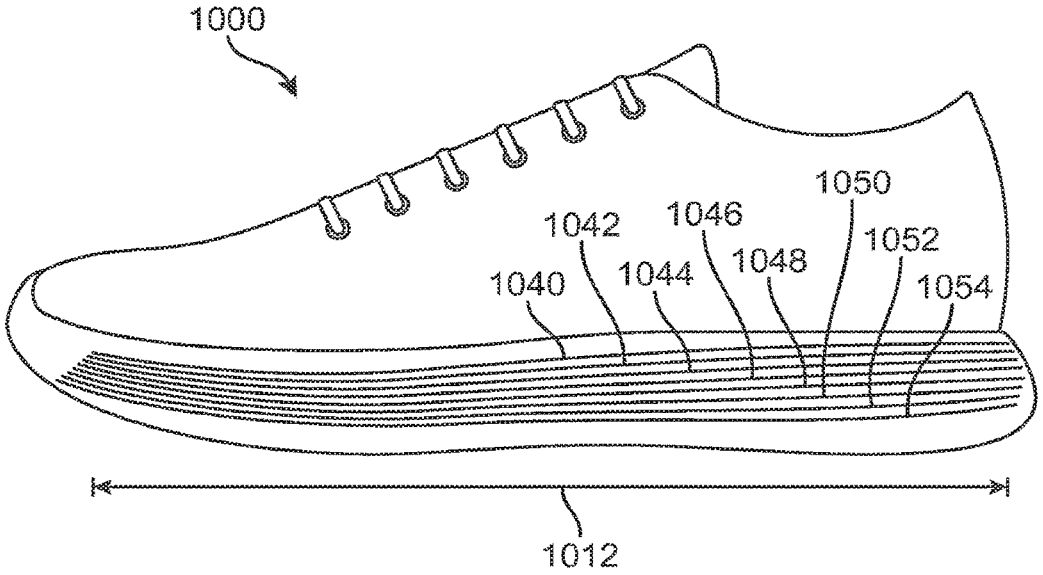
FIG. 36 is a schematic view of a lateral side of the midsole of FIG. 34, in accordance with an exemplary embodiment.

In some embodiments, sipes may have different lengths to selectively control a flexibility of a midsole. In some embodiments, a length of a sipe disposed on one side of a midsole may be different than a length of a sipe disposed on one side of a midsole. Referring to FIG. 35, first sipe 1020 may be disposed on medial side 18 and extend length 1010. Referring to FIG. 36, ninth sipe 1040 may be disposed on lateral side 16 and extend length 1012. In other embodiments, a sipe positioned on one side of an article of footwear may extend a same length as a sipe on the other side.

In some embodiments, sipes positioned on a side of an article of footwear may be tapered. As used herein, tapered may refer to a gradual changing in length of sipes along a vertical direction. In other embodiments, sipes may be disposed differently.

In those instances where sipes are tapered, any suitable direction of tapering may be used. In some embodiments, a tapering of sipes may be along a vertical direction. Referring to FIG. 35, first sipe 1020 and second sipe 1022 may be tapered along vertical direction 152. Specifically, in some embodiments, sipes positioned closer to outsole 1006 may gradually extend less into heel portion 14 than sipes position further from outsole 1006. Referring to FIG. 35, second sipe 1022 may be tapered with first sipe 1020 such that first sipe 1020 gradually extends further into heel portion 14 than second sipe 1022. In the example, second sipe is positioned closer to outsole 1006 than first sipe 1020. In some embodiments, sipes positioned closer to outsole 1006 may gradually extend more into forefoot portion 10 than sipes position further from outsole 1006. Referring to FIG. 35, second sipe 1022 may be tapered with first sipe 1020 such that second sipe 1022 gradually extends further into forefoot portion 10 than first sipe 1020. In the example, second sipe is positioned closer to outsole 1006 than first sipe 1020. In other embodiments, sipes may be positioned differently.

Figure 37:
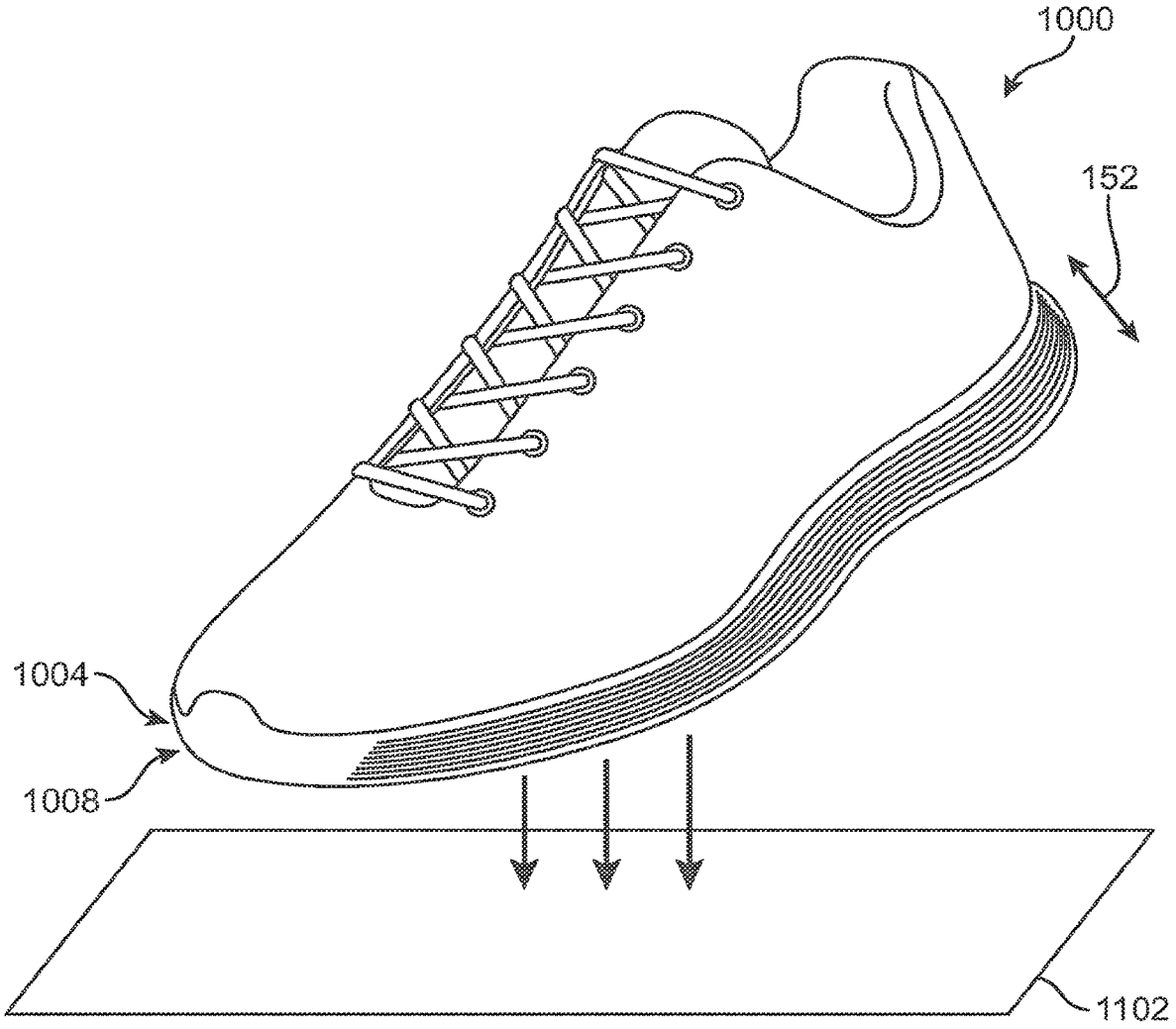
FIG. 37 is a schematic view of a forefoot portion of the midsole of FIG. 34 during a resting state, in accordance with an exemplary embodiment.
Figure 38:
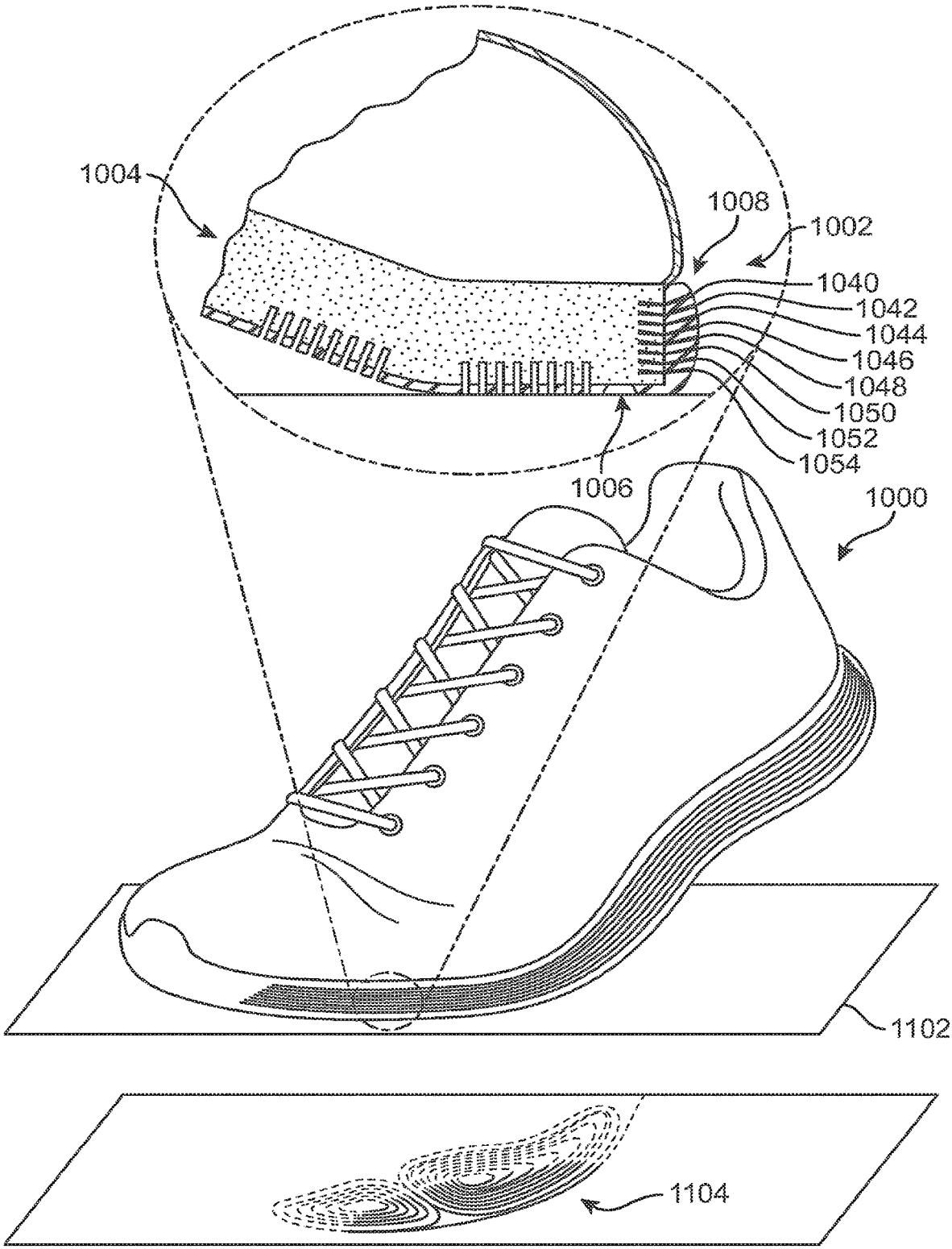
FIG. 38 is a schematic view of a forefoot portion of the midsole of FIG. 34 during a compressed state, in accordance with an exemplary embodiment.

As seen in FIGS. 37 and 38, article of footwear 1000 may be pressed down against playing surface 1102. In the example, midsole 1004 may partially compress. Specifically, both midsole 1004 and exposed sidewall 1008 may compress in the vertical direction 152. This compression may help to facilitate cushioning and reduce the impact on a foot. As seen in FIG. 38, ninth sipe 1040 may compress in response to the article of footwear 1000 impacting playing surface 1102. In the example, the compression of ninth sipe 1040 may permit midsole 1004 to compress, thereby allowing for portion 1104 of outsole 1006 to contact playing surface.

While various embodiments of the embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure for an article of footwear, the sole structure comprising:

a midsole including a top surface, a bottom surface formed on an opposite side of the midsole than the top surface, and an outer surface extending between the top surface and the bottom surface and defining an outer perimeter of the midsole;

an outsole attached to the bottom surface of the midsole and having a bottom surface that defines a ground-engaging surface of the sole structure, the outsole being concave at a heel region of the ground-engaging surface and extending toward the midsole in a neutral state of the article of footwear and being convex at a forefoot region of the ground-engaging surface and extending away from the midsole in the neutral state of the article of footwear;

a first sipe formed through the outsole and extending into the bottom surface of the midsole to expose a first portion of the midsole; and a second sipe concentric with the first sipe, formed through the outsole, and extending into the bottom surface of the midsole to expose a second portion of the midsole, the first sipe being disposed closer to the outer perimeter of the midsole than the second sipe and extending into the midsole to a greater depth than the second sipe in a direction extending from the ground-engaging surface toward the top surface of the midsole.

2. The sole structure of claim 1, wherein the bottom surface of the midsole is arcuate.

3. The sole structure of claim 1, wherein a thickness of the midsole is greater at the outer perimeter of the midsole than at a center of the midsole.

4. The sole structure of claim 1, wherein the first sipe defines a closed-loop.

5. The sole structure of claim 4, wherein the second sipe defines a closed-loop.

6. The sole structure of claim 1, wherein the first sipe and the second sipe are located in the heel region of the sole structure.

7. The sole structure of claim 1, further comprising a third sipe concentric with the first sipe and the second sipe and disposed closer to the outer perimeter of the midsole than the first sipe, the third sipe extending into the midsole to a greater depth than the first sipe in the direction extending from the ground-engaging surface toward the top surface of the midsole.

8. The sole structure of claim 1, wherein the midsole includes a thickness measured in a direction extending between the top surface and the bottom surface, the thickness tapering in a direction toward a center of the midsole to define a depression in the heel region of the sole structure.

9. An article of footwear incorporating the sole structure of claim 1.

10. A sole structure for an article of footwear, the sole structure comprising:

a midsole including a top surface, a bottom surface formed on an opposite side of the midsole than the top surface, and an outer surface extending between the top surface and the bottom surface and defining an outer perimeter of the midsole;

an outsole attached to the bottom surface of the midsole and having a bottom surface that defines a ground-engaging surface of the sole structure, the outsole being concave at a heel region of the ground-engaging surface and extending toward the midsole in a neutral state of the article of footwear, and being convex at a forefoot region of the ground-engaging surface and extending away from the midsole in the neutral state of the article of footwear;

a first sipe formed through the outsole to expose a first portion of the midsole and defining a first closed-loop;

a second sipe formed through the outsole to expose a second portion of the midsole, defining a second closed-loop, and surrounding the first sipe; and a third sipe formed through the outsole to expose a third portion of the midsole, defining a third closed-loop, and surrounding the second sipe, a depth of the third sipe in a direction extending from the ground-engaging surface toward the top surface of the midsole being greater than a depth of the second sipe and the depth of the second sipe in the direction extending from the ground-engaging surface toward the top surface of the midsole being greater than a depth of the first sipe.

11. The sole structure of claim 10, wherein the first sipe extends into the bottom surface of the midsole.

12. The sole structure of claim 11, wherein the second sipe extends into the bottom surface of the midsole.

13. The sole structure of claim 10, wherein the first sipe is concentric with the second sipe.

14. The sole structure of claim 10, wherein the second sipe has a different shape than the first sipe.

15. The sole structure of claim 10, wherein the first sipe and the second sipe are located in the heel region of the sole structure.

16. The sole structure of claim 10, wherein the third sipe is disposed closer to the outer surface of the midsole than the first sipe and the second sipe.

17. The sole structure of claim 10, wherein the midsole includes a thickness measured in a direction extending between the top surface and the bottom surface, the thickness tapering in a direction toward a center of the midsole to define a depression in the heel region of the sole structure.

18. An article of footwear incorporating the sole structure of claim 10.

19. The sole structure of claim 10, wherein the bottom surface of the midsole includes a contour, the bottom surface of the outsole corresponding to the contour of the midsole.

20. The sole structure of claim 1, wherein the bottom surface of the midsole includes a contour, the bottom surface of the outsole corresponding to the contour of the midsole.

* * * * *